US007869755B2

(12) United States Patent
Sano et al.

(10) Patent No.: US 7,869,755 B2
(45) Date of Patent: Jan. 11, 2011

(54) AUTOMATIC DOCUMENT FEEDER, IMAGE READING DEVICE INCLUDING THE SAME, AND IMAGE FORMING APPARATUS INCLUDING THE SAME

(75) Inventors: Motoya Sano, Zama (JP); Hideki Tobinaga, Tokyo (JP); Takashi Fujii, Yokohama (JP); Yasuo Kosuga, Kawasaki (JP); Shinya Kitaoka, Kawasaki (JP); Tatsuaki Nagano, Yokohama (JP); Norio Kimura, Sagamihara (JP)

(73) Assignee: Ricoh Company, Ltd., Tokyo (JP)

( * ) Notice: Subject to any disclaimer, the term of this patent is extended or adjusted under 35 U.S.C. 154(b) by 889 days.

(21) Appl. No.: 11/790,887

(22) Filed: Apr. 27, 2007

(65) Prior Publication Data

US 2007/0264063 A1 Nov. 15, 2007

(30) Foreign Application Priority Data

Apr. 28, 2006 (JP) ..... 2006-126279
May 22, 2006 (JP) ..... 2006-141674

(51) Int. Cl.
*G03G 15/00* (2006.01)
*B65H 85/00* (2006.01)

(52) U.S. Cl. ..... 399/367; 271/291; 271/65; 271/185; 271/186

(58) Field of Classification Search ..... 399/367
See application file for complete search history.

(56) References Cited

U.S. PATENT DOCUMENTS 5,253,860 A 10/1993 Hirose et al.
5,263,697 A 11/1993 Yamazaki et al.
5,330,170 A 7/1994 Uotani et al.
5,431,390 A 7/1995 Hirose et al.
5,449,162 A * 9/1995 Saito et al. ..... 271/122
5,484,143 A 1/1996 Hirose et al.
5,941,519 A 8/1999 Imoto et al.

(Continued)

FOREIGN PATENT DOCUMENTS

JP 10-087187 4/1998

(Continued)

*Primary Examiner*—Daniel J Colilla
*Assistant Examiner*—Allister Primo
(74) *Attorney, Agent, or Firm*—Harness, Dickey & Pierce, P.L.C.

(57) ABSTRACT

An automatic document feeder, for transferring a document through a scanning position three times, includes: a first transfer mechanism to reverse a given document via a reversing path, and transfer the same to a scanning position; a second transfer mechanism to transfer the given document from the scanning position to one of a switchback path and a document discharging part; a switchback mechanism to transfer the given document to a lay-by on the switchback path, and then transfer the given document towards the reversing path via a re-entry path; and a control unit to control the mechanisms so that a second original document passes through the scanning position a first time before a first original document passes through the scanning position a third time, and to pause travel of the second original document at the lay-by as the first original document is passed through the scanning position a third time.

8 Claims, 35 Drawing Sheets

U.S. PATENT DOCUMENTS

| | | | | |
|---|---|---|---|---|
| 6,285,853 | B1 | 9/2001 | Sano | |
| 7,004,464 | B2 | 2/2006 | Hattori et al. | |
| 7,305,198 | B2 * | 12/2007 | Julien | 399/69 |
| 2004/0085595 | A1 * | 5/2004 | Sakaguchi | 358/487 |
| 2005/0179963 | A1 | 8/2005 | Nagano et al. | |
| 2006/0103898 | A1 * | 5/2006 | Okawa | 358/498 |

FOREIGN PATENT DOCUMENTS

| | | | |
|---|---|---|---|
| JP | 2000-143104 | | 5/2000 |
| JP | 2001094712 A | * | 4/2001 |

* cited by examiner

| FIG. 22A |
| --- |
| FIG. 22B |

AUTOMATIC DOCUMENT FEEDER, IMAGE READING DEVICE INCLUDING THE SAME, AND IMAGE FORMING APPARATUS INCLUDING THE SAME

PRIORITY STATEMENT

The present patent application claims priority under 35 U.S.C. §119 upon Japanese Patent Application No. 2006-126279, filed in the Japan Patent Office on Apr. 28, 2006, and Japanese Patent Application No. 2006-141674, filed in the Japan Patent Office on May 22, 2006, the entire contents and disclosures of which are hereby incorporated by reference herein in their entirety.

BACKGROUND

1. Technical Field

The present invention relates to an automatic document feeder, an image reading device, and an image forming apparatus. More particularly, the present invention relates to an automatic document feeder that is of a sheet-through type applicable for reading double face original documents, an image reading device that includes such automatic document feeder, and an image forming apparatus that includes such automatic document feeder.

2. Discussion of the Related Art

Related art automatic document feeders are provided to an image reading device and an image forming apparatus, for example, a copier, facsimile machine, printer, multifunctional machine, and so forth.

Automatic document feeder (hereinafter, referred to as an "ADF") of a sheet-through type has been widely used in recent years.

In such sheet-through type ADF, a double face original document that is an original document having images on both faces is transferred to a scanning position so as to read the image formed on the front face thereof. After the image on the front face thereof is read, the original document is switched back to the scanning position to read the image formed on the reverse face thereof. Then, the original document is switched back again to the scanning position to collate the pages of the original document in a proper order.

To enhance productivity in processing a plurality of double face original documents including a first or preceding original document and a second or following original document, the above-described sheet-through type ADF conducts a document transfer control in which the front face of the second original document is read by passing over the scanning position for the first time before the first original document passes over the scanning position for the third time. By transferring two double face original documents in a substantially concurrent manner in a document transfer path in the ADF, the document transfer control conducted by the ADF can enhance its productivity when handling a plurality of double face original documents.

There are some techniques to enhance productivity in processing double face original documents.

A related art ADF with one of the techniques includes a circulating and reversing passage and a control unit. The circulating and reversing passage includes a scanning position for reading images formed on both front and reverse faces of an original document. The control unit picks up the second original document from an original document stacker before the trailing edge of the first original document passes over the scanning position, at least when causing the first original document after once passing over the scanning position to pass over the scanning position for the second time via the circulating and reversing passage. With the above-described structure, when two original documents are transferred in the ADF in a substantially concurrent manner, the second original document is transferred in an overlaying manner with the first original document in the same document transfer path while the first original document is being held and stopped by a pair of registration rollers.

However, with the above-described operation, the first and second original documents may rub each other. This can cause an adhesion of dirt or a contamination on these original documents and a decrease of the document transfer ability, which may result in an occurrence of jams.

To eliminate such drawbacks, a related art ADF of a sheet through type with another technique includes an automatic document carrying device, a pair of switchback members, and a control unit.

The automatic document carrying device separates and feeds original documents one by one from an original document stacker and switches back the separated original document to transfer to a scanning position.

The pair of switchback members is disposed below the original document stacker, in a switchback path connecting to a reverse path for reversing the read original document. The pair of switchback members that includes a normal and reverse rotation drive roller and a driven roller can rotate in normal and reverse rotations, and the driven roller can separate from and contact to the normal and reverse rotation drive roller.

The control unit controls to drive the automatic document carrying device and the pair of switchback members.

The related art ADF having such structure causes the pair of switchback members to sandwich the first original document, and to separate the driven roller from the normal and reverse rotation drive roller while the first original document is sandwiched by the pair of switchback members. By separating the pair of switchback members, the second original document is transferred to the switchback path. Then, in a condition in which the first and second original documents are overlapped, the driven roller of the pair of switchback members contacts the normal and reverse rotation drive roller again so as to sandwich the first and second original documents while a part of the first original document and a part of the second original document are being overlaid.

In the above-described related art ADF, two original documents are carried and transferred in the document transfer path in the ADF in a constantly sequential manner. Therefore, the two original documents keep a constant distance.

With the above-described structure, when the related art ADF discharges the two original documents, the first original document after being collated in a proper page order is discharged at the transfer speed according to a read scan magnification or a magnification for a read scan of an image.

It is noted that the lower the read scan magnification is set, the greater the reduction ratio becomes, and the faster the transfer speed of the first original document becomes.

Therefore, when the read scan magnification is set to a relatively low ratio, the transfer speed of the first original document is increased by the level of magnification, which can cause the original document jump to a discharging tray.

In other words, by accounting for the stackability of discharged original documents, a document transfer control for double face original documents cannot be conducted with a ratio exceeding a constant read scan magnification.

SUMMARY

An embodiment of the present patent application provides an automatic document feeder for transferring a document through a scanning position three times, the automatic document feeder comprising: an original document stacker to accumulate a plurality of original documents; a first transfer mechanism to separate the plurality of original documents one by one from the original document stacker, reverse a separated given document via a reversing path, and transfer the given document to a scanning position; a second transfer mechanism to transfer the given document from the scanning position to one of a switchback path and a document discharging part; a switchback mechanism to transfer the given document to a lay-by on the switchback path, and transfer the given document in a direction opposite to a previous travel direction thereof towards the reversing path via a re-entry path; and a control unit to control the first transfer mechanism, the second transfer mechanism, and the switchback mechanism, so that a second original document passes through the scanning position a first time before a first original document passes through the scanning position a third time, and so that the switchback mechanism pauses travel of the second original document at the lay-by as the first original document is passed through the scanning position a third time enroute to the document discharging part.

An embodiment of the present patent application provides an image reading device comprising: a plurality of image reading components; and such an automatic document feeder.

An embodiment of the present patent application provides an image forming unit configured to form an image on a recording medium; and such an automatic document feeder.

Additional features and advantages of example embodiments will be more fully apparent from the following detailed description, the accompanying drawings, and the associated claims.

BRIEF DESCRIPTION OF THE DRAWINGS

The accompanying drawings are intended to depict example embodiments of the present invention and should not be interpreted to limit the scope thereof. The accompanying drawings are not to be considered as drawn to scale unless explicitly noted.

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EXAMPLE EMBODIMENTS

Figure 1:
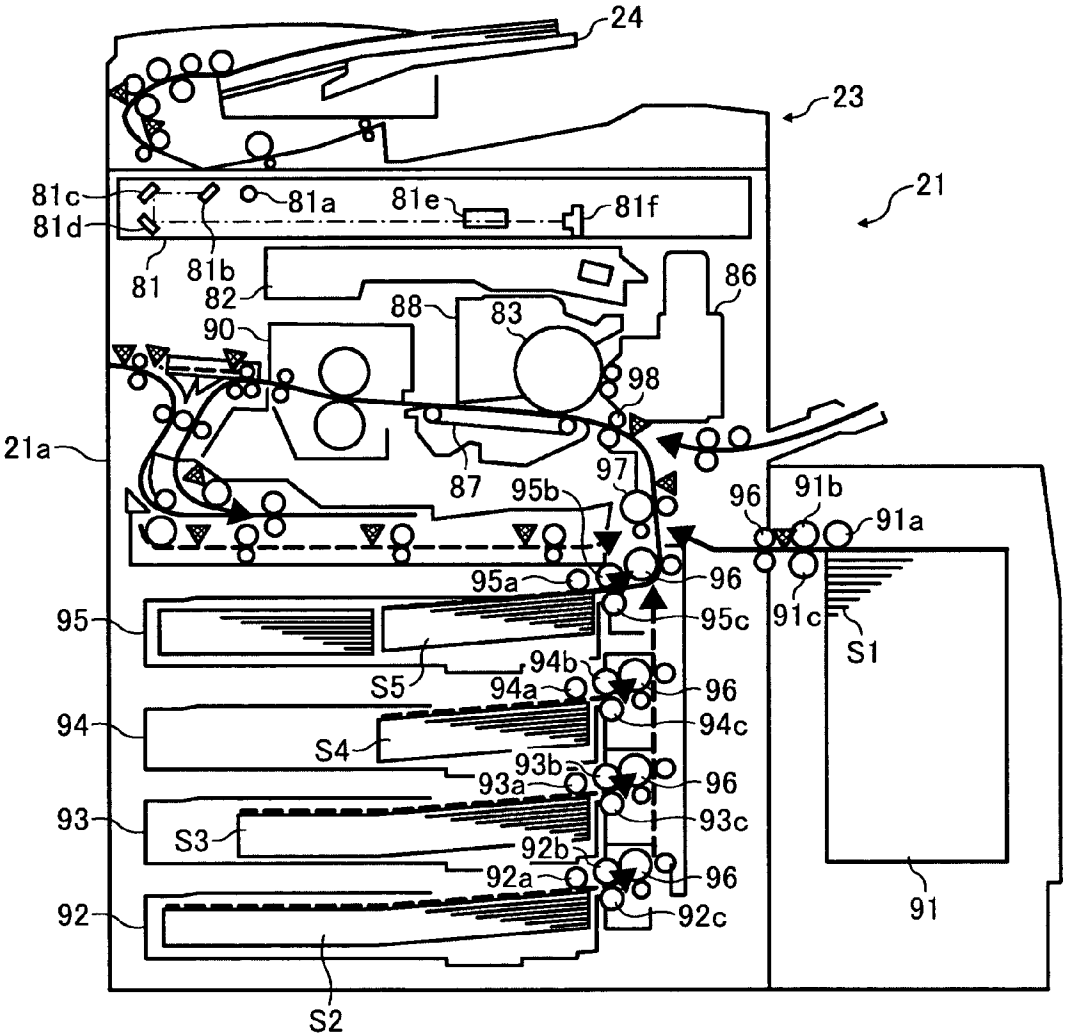
FIG. 1 is a schematic configuration of an image forming apparatus according to an example embodiment of the present invention, including an image reading device according to an example embodiment of the present invention and an automatic document feeder according to an example embodiment of the present invention.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would hen be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, example embodiments of the present patent application are described.

Now, example embodiments of the present invention will be described in detail with reference to the accompanying drawings.

FIGS. 1 through 30 shows an automatic document feeder or ADF according to an example embodiment of the present invention, an image reading device, according to an example embodiment of the present invention, including the ADF, and an image forming apparatus, according to an example embodiment of the present invention, including the ADF.

In an example embodiment, the image forming apparatus includes a copier 21, and an ADF 23 is mounted on the copier 21.

Alternative to the copier 21, an image forming apparatus can be a facsimile machine, printer, and multiple image forming apparatus including at least two functions of copier, facsimile machine, and so forth. In addition, an image reading device can be a scanner, facsimile machine, and multiple image forming apparatus having at least two functions of copier, facsimile machine, and so forth.

Referring to FIG. 1, a schematic configuration of the copier 21 according to an example embodiment of the present invention is described.

In FIG. 1, the copier 21 includes a copy main body 21*a* that includes a contact glass 22*a*, a slit glass 22*b*, and various image forming units and components of the copier 21 so as to form an image on a recording medium.

The contact glass 22*a* (see FIG. 2) is translucent and mounted on the top of the copier main body 21*a*.

The slit glass 22*b*, which includes a scanning position, is also mounted on the top of the copier main body 21*a* and next to the contact glass 22*a*. The slit glass 22*b* is also translucent and has a smaller area than the contact glass 22*a*.

Above the copier main body 21*a*, the ADF 23 that serves as an automatic document feeder is mounted.

The ADF 23 is hinged or attached via a hinging member (not shown) to the copier main body 21*a* so that the contact glass 22*a* can be selectively covered or uncovered.

The copier 21 includes other various image forming components and parts, which will be described later.

Figure 2:
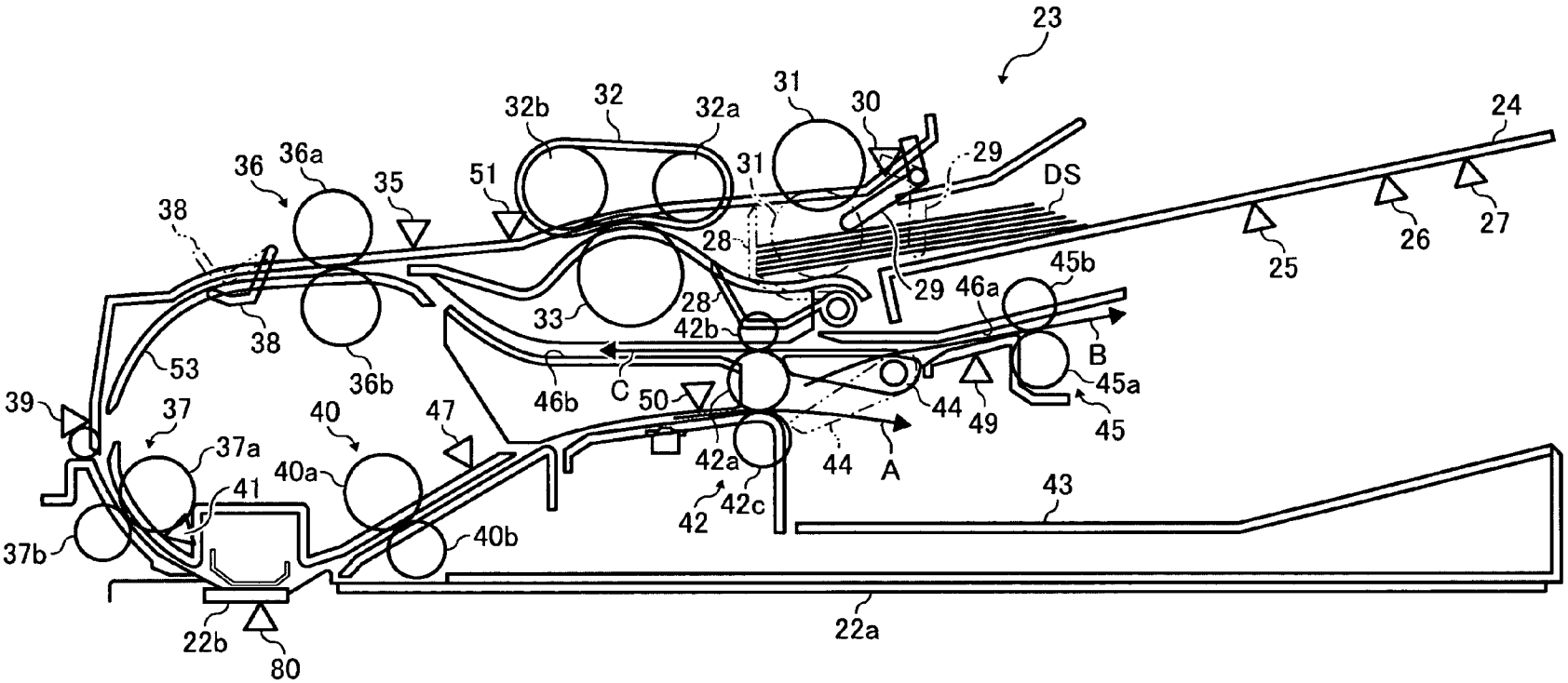
FIG. 2 is a schematic configuration (according to an example embodiment of the present invention) of the automatic document feeder of FIG. 1.
Figure 3:
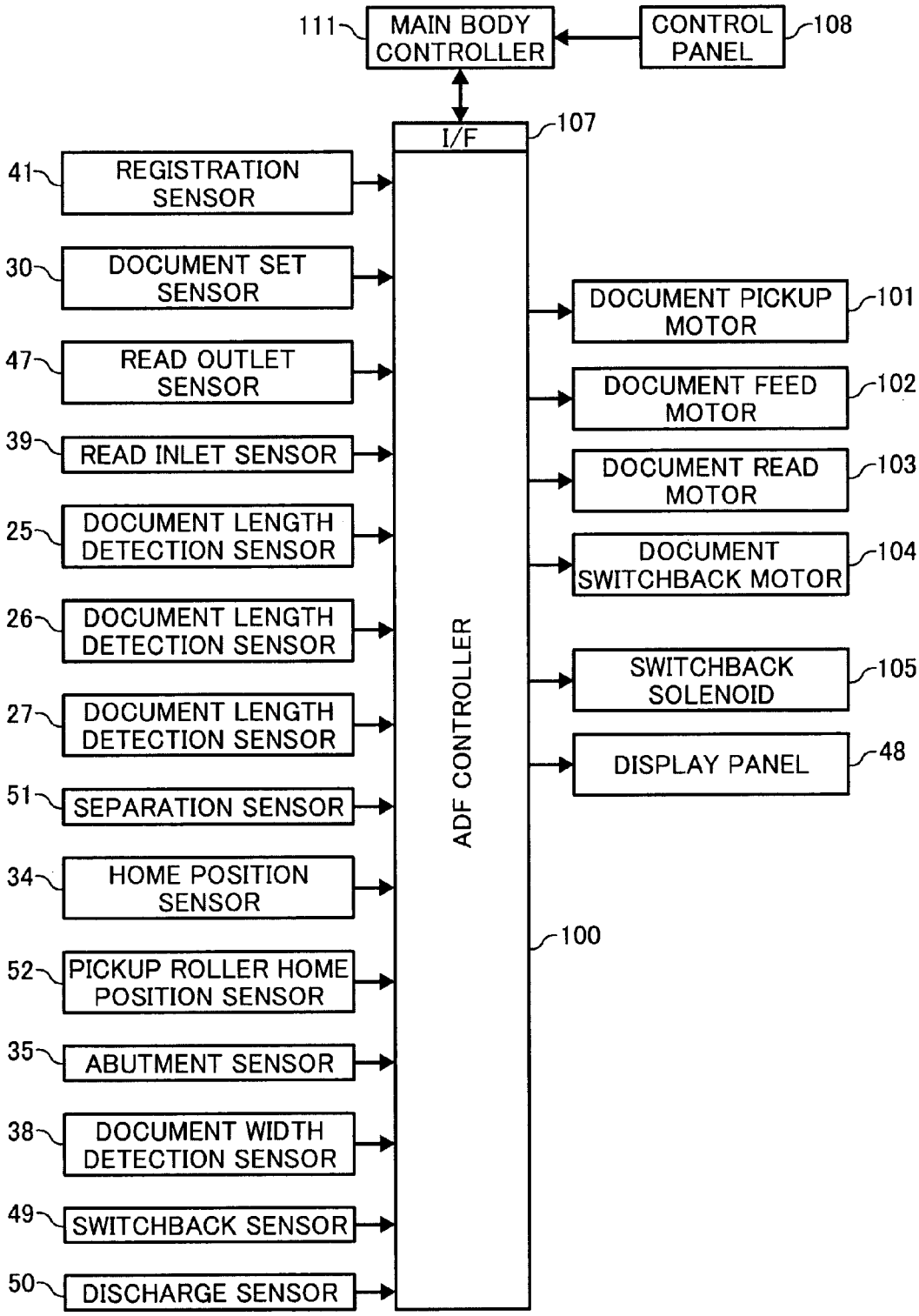
FIG. 3 is a schematic diagram (according to an example embodiment of the present invention) of a controlling part of the image forming apparatus of FIG. 1.

Referring to FIGS. 2 and 3, configurations of the ADF 23 are described.

FIG. 2 is a schematic configuration of the ADF 23 according to an example embodiment of the present invention. FIG. 3 is a block diagram of an ADF controller 100 of the ADF 23 according to an example embodiment of the present invention.

In FIG. 2, the ADF 23 includes a document setting table 24 that serves as an original document stacker. On the document setting table 24, an original document stack DS that is a stack of original documents are placed in a face-up manner.

In the ADF 23, document length detection sensors 25, 26, and 27 are mounted on a table part of the document setting table 24. The document length detection sensors 25, 25, and 27 serve as document length detecting member so as to detect the length of an original document.

Each of the length detection sensors 25, 25, and 27 includes a combination of a light receiving element and a light emitting element.

Specifically, the length detection sensors 25, 25, and 27 are disposed on the document setting table 24 so as to determine at least the orientation (portrait or landscape) of the same size of the original documents.

The ADF controller 100 determines the length in a document travel direction of the original document stacker DS accumulated on the document setting table 24, based on information input from the light receiving elements of the length detection sensors 25, 25, and 27.

A document stopper 28 is disposed at the downstream side in the document travel direction with respect to the document setting table 24. The document stopper 28 serves as a stopping member to move between an abutment position, which is indicated by a dashed line in FIG. 2, to which a document pickup motor 101 may cause the leading edge of the original document stack DS to transfer and abut against, and a home position, which is indicated by a solid line in FIG. 2, to which the document pickup motor 101 may cause the document stopper 28 to retreat therefrom.

When the document stopper 28 is at the abutment position, the leading edge of the original document stack DS is abut to the document stopper 28, thereby the leading edge of the original document stack DS can be aligned.

In addition, by abutting the original document stack DS to side fences (not shown) mounted on the document setting table 24, the width direction of the original document stack DS can be positioned in a direction perpendicular to the document travel direction of the original document.

When the document stopper 28 moves in a downward direction toward its home position, a home position sensor 34 may detect the movement of the document stopper 28 and output the detection result to the ADF controller 100.

On the original document setting table 24 at a side of the leading edge of the original document stack DS, a document set filler 29 and a document set sensor 30 are mounted.

The document set filler 29 may move from a position that is indicated by a dashed line in FIG. 2 to a position that is indicated by a solid line in FIG. 2 when the original document stack DS is mounted on the document setting table 24.

When the document set filler 29 changes its position from the undetected state of the original document stack DS to the detected state of the original document stack DS, the document set sensor 30 may output a signal to the ADF controller 100.

Based on the input signal, the main body controller 111 may shift to a standby condition for reading original documents in the copier main body 21*a*.

Above the document stopper 28, a document pickup roller 31 that serves as a document pickup member is disposed.

Figure 4:
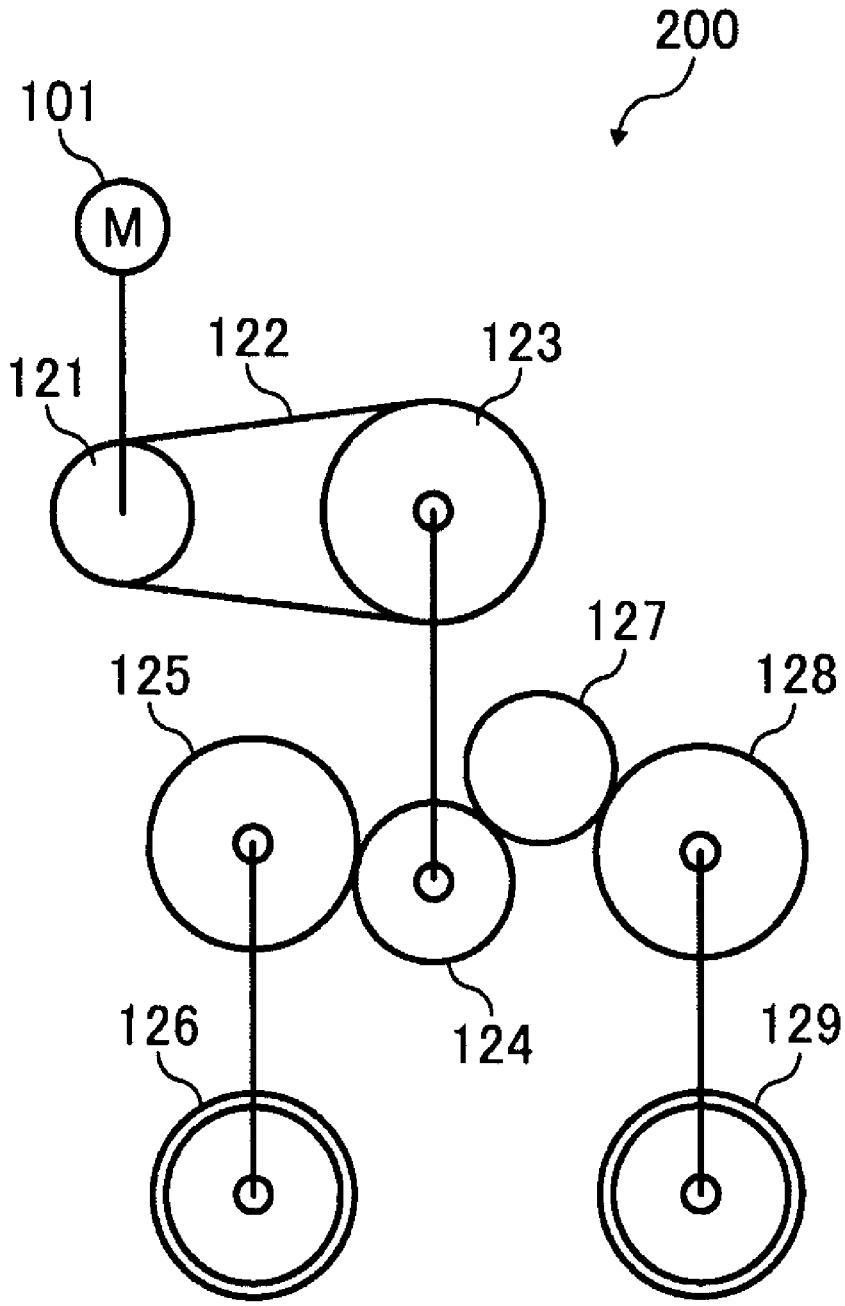
FIG. 4 is a schematic structure (according to an example embodiment of the present invention) of a power transmission mechanism of the image forming apparatus of FIG. 1.

The document pickup roller 31 may transmit the driving force from the document pickup motor 101 via a document pickup cam 126 (see FIG. 4). The document pickup motor 101 and the document pickup cam 126 may cause the document pickup roller 31 to move in a vertical direction between a home position that is indicated by a solid line in FIG. 2 to retreat from the original document stack DS and a contact position that is indicated by a chain double-dashed line in FIG. 2 to contact with the top of the original document stack DS.

When the document pickup roller 31 moves in an upward direction toward its home position, a pickup roller home position sensor 52 may detect the movement of the document pickup roller 31 and output the detection result to the ADF controller 100.

A control panel 108 is mounted in the copier main body 21*a*.

When a print key that is displayed on the control panel 108 is pressed, the main body controller 111 may send a document pickup signal via the I/F 107 to the ADF controller 100. After receiving the document pickup signal, the ADF controller 100 may drive the document pickup motor 101 to rotate in a normal direction so as to cause the document stopper 28 to retreat from the original document stack DS to move in a downward direction.

When the document stopper 28 moves to the home position, the home position sensor 34 may detect the movement of the document stopper 28, and the ADF controller 100 may drive the document pickup motor 101 in a reverse direction so as to cause the document pickup roller 31 to move down to a position to contact with the original document stack DS.

At this time, a document feed motor 102 may rotate in a normal direction. This may cause the document pickup roller 31 to start the feeding of original documents, desirably one document sheet, from the original document stack DS accumulated on the document setting table 24.

The fed original document may be transferred to a document feeding belt 32 and a reverse roller 33 disposed at the downstream side of the document pickup roller 31.

The document feeding belt 32 and the reverse roller 33 may form a separation and transfer mechanism together with some other components.

The document feeding belt 32 shown in FIG. 2 is extended by and spanned around a drive roller 32*a* and a driven roller 32*b*.

When the driving force of the document feed motor 102 is transmitted to the drive roller 32*a*, the document feeding belt 32 in an endless shape may rotate.

When the document feed motor 102 is rotated in a normal direction, the document feeding belt 32 may rotate in the document travel direction, which is a clockwise direction in FIG. 2.

The reverse roller 33 includes a torque limiter (not shown). When the document feed motor 102 is rotated in a normal direction, the reverse roller 33 may be rotated in an opposite direction to the document travel direction, which is a clockwise direction in FIG. 2.

With the above-described operations, an original document placed on the top of the original document stack DS and a next original document placed immediately below the top original document may be separated and only the top original document may be fed.

Specifically, the reverse roller 33 may be held in contact with the document feeding belt 32 with a sufficient pressure.

When being held in contact with the document feeding belt 32 directly or via one original document, the reverse roller 33 may be rotated in a counterclockwise direction with the rotations of the document feeding belt 32.

When two or more original documents are inserted between the document feeding belt 32 and the reverse roller 33, the force of the reverse roller being rotated with the document feeding belt 32 may be set to a value smaller than the torque of the torque limiter.

Accordingly, the reverse roller 33 can rotate in a clockwise direction to push back extra original document(s), so as to reduce, or prevent if possible, a chance of multi-feeding of original documents.

The separately fed original document may be detected by a separation sensor 51 disposed at the downstream side of the document feeding belt 32. The separation sensor 51 may serve as a separated sheet detection unit.

The original document detected by the separation sensor 51 may be further transferred by the document feeding belt 32. When the original document proceeds by a reference amount of X mm after the leading edge of the original document is detected by an abutment sensor 35 that is disposed at the downstream side of the document feeding belt 32, the ADF controller 100 may stop the rotation of the document feed motor 102 in the normal direction.

The reference amount of X mm is set to a distance that is greater than the distance between the abutment sensor 35 and the nip portion of the pair of pull-out rollers 36. That is, the original document transferred thereto may be stopped while being bowed in a constant manner with the leading edge thereof abut against the nip portion of the pull-out drive roller 36*a* and the pull-out driven roller 36*b* that are in sliding contact with each other.

At this time, according to the instructions from the ADF controller 100, the document pickup motor 101 is rotated in a normal direction to retreat the document pickup roller 31 from the top surface of the original document and transfer the original document by the transfer force of the document feeding belt 32 only. Thereby, the leading edge of the original document is abutting against the nip portion formed between the pull-out drive roller 36*a* and the pull-out driven roller 36*b*. This can correct the skew of the original document separated from the original document stack DS.

Further, the pull-out drive roller 36*a* and the pull-out driven roller 36*b* may transfer the original document after the skew thereof is corrected by the reverse rotation of the document feed motor 102, toward a pair of read inlet rollers 37 disposed at the downstream side of the document transfer path via a reversing path 53. The pair of read inlet rollers 37 shown in FIG. 2 includes a read inlet drive roller 37*a* and a read inlet driven roller 37*b*.

Further, when the document feed motor 102 is rotated in a reverse direction, the pull-out drive roller 36*a* may be rotated but the driving force thereof may not be transmitted to the document pickup roller 31 and the document feeding belt 32 due to the function of a later described one-way clutch.

Further, at the downstream side of the pull-out drive roller 36*a* and the pull-out driven roller 36*b*, document width detection sensors 38 is mounted.

The document width detection sensors 38 are arranged along a direction perpendicular to the sheet of FIG. 2, so as to move between a position that is indicated by the solid line and a position that is indicated by the chain double-dashed line in FIG. 2.

When an original document is detected, the document width detection sensors 38 may move to the position that is indicated by the chain double-dashed line. The document width detection sensors 38 may then obtain information on the width direction that runs perpendicular to the document travel direction of the original document transferred by the pull-out drive roller 36*a* and the pull-out driven roller 36*b*, and send the detection result to the ADF controller 100.

The ADF controller 100 may send information of the size of the original document stack DS accumulated on the document setting table 24 to the main body controller 111, based on the detection result of the length of the original document obtained by the document length detection sensors 25, 26, and 27 and the detection result of the width of the original document obtained by the document width detection sensors 38.

Further, the ADF controller 100 may count the number of motor drive pulses that corresponds to a distance of the original document transferred while the abutment sensor 35 is detecting the leading edge and trailing edge of the original document. This may calculate the correct length of an original document.

Further, when the original document is transferred to the pair of read inlet rollers 37 by rotating the pull-out drive roller 36*a*, the transfer speed of the original document may be set to high speed to reduce the time to transfer the original document to the scanning position 80 on the slit glass 22*b*. Specially, from the second original document and after, the high speed of document transfer can reduce a distance between two sequentially processed original documents. This can enhance the productivity in conveying original documents. In addition, when the read inlet sensor 39 detects the leading edge of the original document, the transfer speed may be decreased before the leading edge of the original document comes to the pair of read inlet rollers 37.

The ADF controller 100 may rotate and stop the document feed motor 102 so as to make the transfer distance longer by Y mm than the distance between the read inlet sensor 39 and the pair of read inlet rollers 37. The original document transferred thereto may be stopped while being bowed in a constant manner with the leading edge thereof abut against the nip portion of the pair of read inlet rollers 37 that is being stopped. This can correct the skew occurred when the pair of pull-out rollers 36 is conveying the original document.

In the example embodiment of the present invention, the pair of read inlet rollers 37 may include a pair of rollers for correcting skew.

Further, when an original document is temporarily stopped at the nip portion of the pair of read inlet rollers 37 (which is referred to as a "registration stop"), the ADF controller 100 may send the registration stop signal to the main body controller 111 via the I/F 107.

When the registration stop signal is sent, the ADF controller 100 may receive the read start signal from the main body controller 111. The ADF controller 100 drives a document read motor 103 so that the original document stopped at the nip portion of the pair of read inlet rollers 37 can be transferred at the transfer speed according to the read scan magnification, and causes a pair of read outlet rollers 40 to transfer the original document. The pair of read outlet rollers 40 includes a read outlet drive roller 40*a* and a read outlet driven roller 40*b*.

When the read start signal is received before the leading edge of the original document reaches a registration sensor 41 that is mounted at an upstream side of the slit glass 22*b*, the ADF controller 100 may perform the scanning operation without executing the registration stop.

In the scanning operation without executing the registration stop, the original document may not be stopped at the nip portion of the pair of read inlet rollers 37 and is transferred while the scan transfer speed is maintained.

The registration sensor 41 detects the leading edge of an original document. When the registration sensor 41 detects the leading edge of an original document, the ADF controller 100 may start a pulse count or counting pulses of the document read motor 103. At the timing that the leading edge of the original document reaches the scanning position 80 on the slit glass 22*b*, the ADF controller 100 may send a gate signal that indicates an image area in a sub-scanning direction, to the main body controller 111. The ADF controller 100 generally keeps sending the gate signal until the trailing edge of the original document completely passes over the scanning position 80.

After passing over the scanning position 80 via the reversing path 53, the original document may be reversed from the front face to the reverse face and is transferred by the pair of read outlet rollers 40 and a document discharging roller set 42. After front face side or both faces of the original document are scanned, the original document may be discharged to a document discharging tray 43 that serves as a discharge table for original document.

In addition, the document discharging roller set 42 includes a discharge drive roller 42*a*, an upper discharge driven roller 42*b*, and a lower discharge driven roller 42*c*. At a downstream side of the document discharging roller set 42, a path switching member 44 is disposed.

When scanning the front face of a double face original document in transfer of the double face original document, before the leading edge of the double face original document passing over the scanning position 80 reaches the document discharging roller set 42, a switchback solenoid 105 may drive the path switching member 44 to be switched to the position indicated by the chain double-dashed line in FIG. 2.

At this time, the discharge drive roller 42*a* and the lower discharge driven roller 42*c* driven by the document read motor 103 and a pair of switchback rollers 45 driven by a document switchback motor 104 may transfer the original document to a switchback path 46*a*.

After a read outlet sensor 47 that is disposed at the downstream side of the pair of read outlet rollers 40 has detected the trailing edge of the original document and the drive pulses of the document read motor 103 has reached a reference number of pulses, the ADF controller 100 may determine that the trailing edge of the original document has passed the document discharging roller set 42 and turn off the switchback solenoid 105 to move the path switching member 44 to the position that is indicated by the solid line shown in FIG. 2.

Further, as previously described, after the drive pulse of the document read motor 103 has reached the reference number of pulses, the ADF controller 100 may drive the document switchback motor 104 to rotate in a reverse direction so as to rotate the pair of switchback rollers 45 in a reverse direction. This may switch back the original document toward the pair of pull-out rollers 36.

At this time, the rotation direction of the document read motor 103 is in the normal direction and the rotation direction of the document switchback motor 104 is the opposite or reverse direction of the document transfer direction. The document switchback motor 104 and the document read motor 103 may be driven at high speed, so as to reduce the processing time.

Further, after the switchback of the original document has been started, the drive pulse of the document switchback motor 104 may shortly reach the reference number of pulses. After that, the ADF controller 100 may drive the document feed motor 102 in a reverse direction at high speed, so as to transfer the original document to the pair of pull-out rollers 36 at high speed.

Further, when the switchback sensor 49 detects the trailing edge of the original document that is transferred to the re-entry path 46*b*, the ADF controller 100 may stop the reverse rotation of the pair of switchback rollers 45, based on the detection result obtained from the switchback sensor 49.

After the stop of the pair of switchback rollers 45, the pair of pull-out rollers 36 may correct the skew of the original document.

As described above, one side or front face of the original document is scanned.

Then, the original document may be switched back again into the switchback path 46*a*, and pass through the re-entry path 46*b*, and be transferred toward the scanning position 80.

Thus, the original document may be reversed without being scanned, be collated in a proper page order, and be discharged to the document discharging tray 43.

Further, a discharge sensor 50 is disposed at the upstream side of the document discharging roller set 42.

The discharge sensor 50 may detect the trailing edge of the original document to output a signal to the ADF controller 100. The ADF controller 100 may determine, based on the detection result, that the original document is discharged.

Further, the copier main body 21*a* further includes a display panel 48.

The ADF controller 100 may determine whether a jam has occurred, based on the respective detection results from the abutment sensor 35, the read inlet sensor 39, the registration sensor 41, the read outlet sensor 47, the switchback sensor 49, the discharge sensor 50, the document length detection sensors 25, 26, and 27, and so forth. When it is determined that the jam has occurred, the ADF controller 100 may display a message on the display panel 48 to inform the occurrence of jam.

Referring to FIGS. 4 to 7, schematic structures of respective power transmission mechanisms are described.

Figure 5:
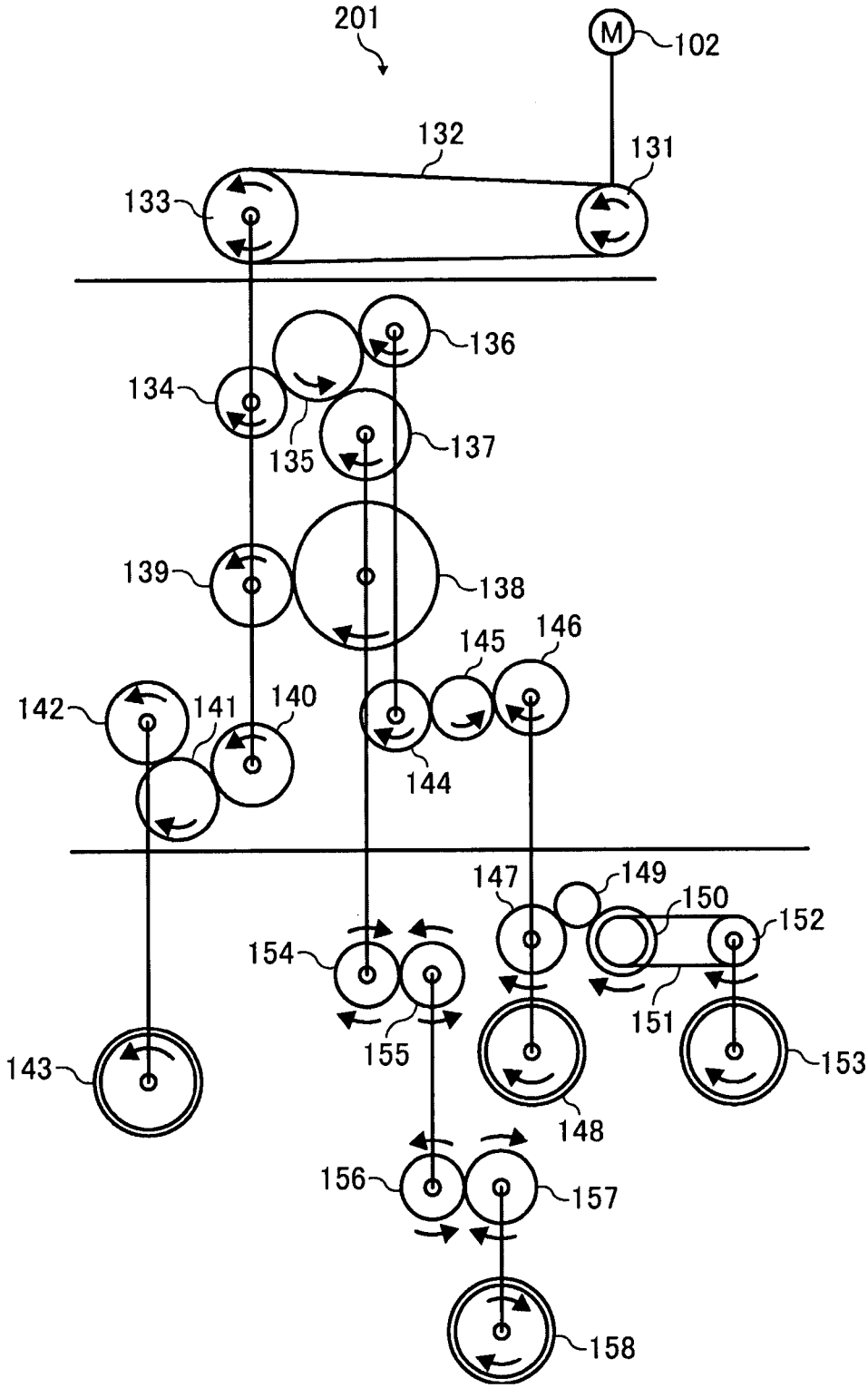
FIG. 5 is a schematic structure (according to an example embodiment of the present invention) of another power transmission mechanism of the image forming apparatus of FIG. 1.
Figure 6:
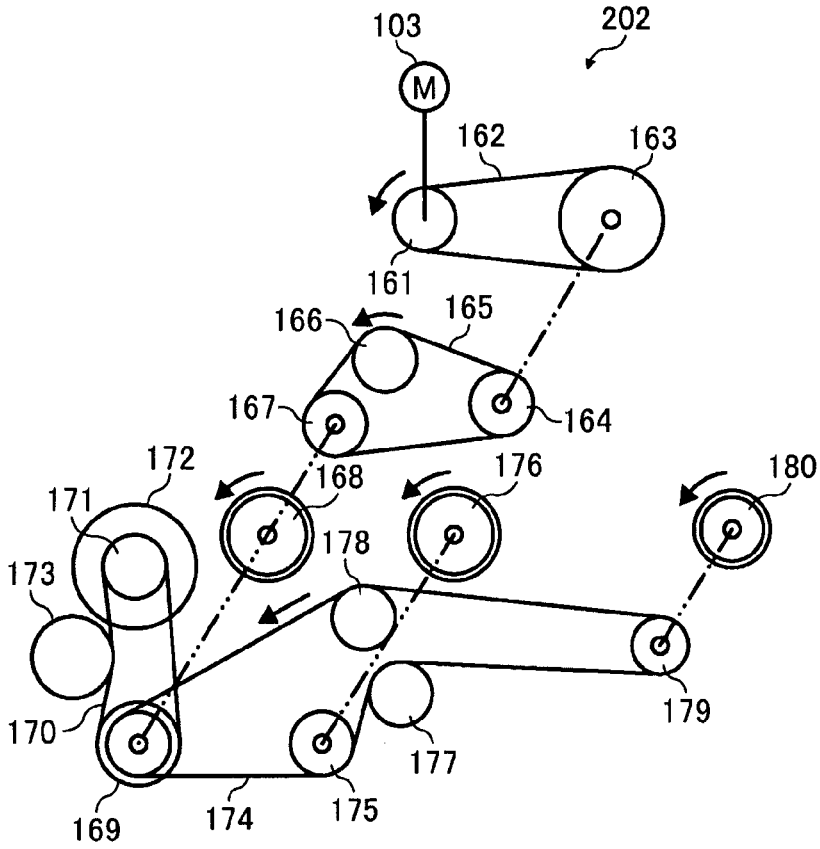
FIG. 6 is a schematic structure (according to an example embodiment of the present invention) of another power transmission mechanism of the image forming apparatus of FIG. 1.
Figure 7:
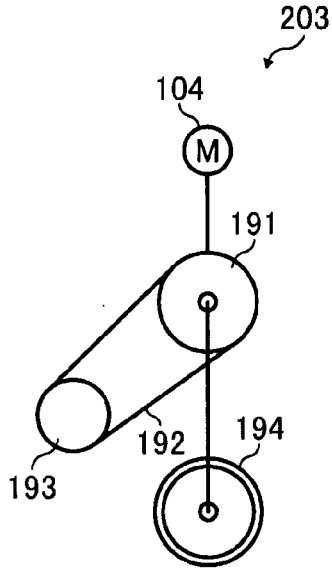
FIG. 7 is a schematic structure (according to an example embodiment of the present invention) of another power transmission mechanism of the image forming apparatus of FIG. 1.

FIG. 4 is a schematic structure of a power transmission mechanism 200 from a document pickup motor 101. FIG. 5 is a schematic structure of a power transmission mechanism 201 from the document feed motor 102. FIG. 6 is a schematic structure of a power transmission mechanism 202 from the document read motor 103. FIG. 7 is a schematic structure of a power transmission mechanism 203 from the document switchback motor 104.

In the power transmission mechanism 200 shown in FIG. 4, a pulley 121 that is connected to the document pickup motor 101 is connected via a timing belt 122 to a pulley 123. When the pulley 123 is rotated by the document feed motor 102, the rotation force may be transmitted from the pulley 123 to a pulley 124.

The pulley 124 is connected to a document feed cam 126 via a pulley 125.

When the document pickup motor 101 is rotated in a normal direction, the pulley 124 rotates the document feed cam 126 in a counterclockwise direction in FIG. 4 to move the document pickup roller 31 to its home position or a position to which the document pickup roller 31 retreats from the original document stack DS.

When the document pickup motor 101 is driven in a reverse direction, the pulley 124 rotates the document feed cam 126 in a clockwise direction in FIG. 4 to move the document pickup roller 31 to its contact position or a position to which the document pickup roller 31 contacts the original document stack DS.

The pulley 124 is connected to a stopper cam 129 via pulleys 127 and 128. The document stopper 28 is controlled to move between the contact position and home position according to the direction of rotations of the stopper cam 129.

In the power transmission mechanism 201 shown in FIG. 5, a pulley 131 that is connected to the document feed motor 102 is connected via a timing belt 132 to a pulley 133. The pulley 133 is connected to a pulley 134.

The pulley 134 is connected to a pulley 147 via pulleys 135, 136, 144, 145, and 146. The pulley 147 is connected via a pulley 149 to a pulley 150. The pulley 150 is connected via a timing belt 151 to a pulley 152. The pulley 152 is connected to a pickup pulley 153 that is connected to the document pickup roller 31.

With the above-described structure, when the document feed motor 102 is rotated in a normal direction, which is in a clockwise direction in FIG. 5, the drive force is transmitted via the pulley 131, the timing belt 132, the pulleys 133, 134, 135, 136, 144, 145, 146, 147, 149, and 150, the timing belt 151, and the pickup pulley 153. Accordingly, the document pickup roller 31 is rotated in a clockwise direction in FIG. 5, so as to separate an original document on top of a stack of original documents accumulated on the original document stack DS.

Further, the pulley 147 is connected to a feed belt drive pulley 148 that drives the drive roller 32*a* of the document feeding belt 32. When the document feed motor 102 is rotated in a normal direction, which is in a clockwise direction in FIG. 5, the pulley 148 is rotated in a counterclockwise direction to move the document feeding belt 32 rotating in a direction to feed the original document stack DS.

The pulleys 134, 136, and 144 respectively include a one-way clutch therein so as to transmit only the driving force in a clockwise direction of the document feed motor 102 to the pickup pulley 153 and the feed belt drive pulley 148.

Further, the pulley 135 is connected via pulleys 137, 154, 155, 156, and 157 to a reverse roller pulley 158 that rotates the reverse roller 33. When the document feed motor 102 rotates in a clockwise direction in FIG. 5, the reverse roller 33 is rotated in a clockwise direction in FIG. 5 via the pulleys 137, 154, 155, 156, and 157 so as to be rotated to separate an original document from the original document stack DS.

The pulley 137 includes a one-way clutch so as to transmit only the driving force in a clockwise direction of the document feed motor 102 to rotate the reverse roller 33.

The pulley 133 is connected to a pulley 139. The pulley 139 is connected to a pulley 138 that is coaxially connected to the pulleys 137 and 154 and is also connected to a pulley 140.

The pulley 140 is connected via pulleys 141 and 142 to a pull-out drive roller pulley 143. The pull-out drive roller pulley 143 is connected to the pull-out drive roller 36*a*.

With the above-described structure, when the document feed motor 102 is reversely rotated in a counterclockwise direction in FIG. 5, the pulley 140 is rotated in a counterclockwise direction in FIG. 5. This rotation of the pulley 140 drives pull-out drive roller pulley 143 in a counterclockwise direction in FIG. 5 via the pulleys 142 and 141. Accordingly, the pair of pull-out rollers 36*a* is caused to transfer an original document to the scanning position 80.

In the power transmission mechanism 202 as shown in FIG. 6, a pulley 161 that is connected to the document read motor 103 is connected via a timing belt 162 to a pulley 163. The pulley 163 is connected to a pulley 164.

The pulley 164 is connected via a timing belt 165 to pulleys 166 and 167. The pulley 167 is connected to a read inlet roller pulley 168 to rotate the read inlet drive roller 37*a*.

With the above-described structure, when the document read motor 103 is rotated in a normal direction, which is in a clockwise direction in FIG. 6, the read inlet driven roller 37*a* is rotated via the pulley 161, the timing belt 162, the pulleys 163 and 164, the timing belt 165, the pulleys 166 and 167, and the read inlet roller pulley 168 in a clockwise direction in FIG. 6, which is a document travel direction.

The pulley 167 includes a one-way clutch to transmit only the driving force in a clockwise direction of the document read motor 103 to the read inlet roller pulley 168.

Further, the read inlet roller pulley 168 is connected to a pulley 169. The pulley 169 is connected via a timing belt 174 to a read outlet roller pulley 175.

The read outlet roller pulley 175 is connected via a read outlet drive roller pulley 176 to the read outlet drive roller 40*a* of the pair of read outlet rollers 40. The read outlet drive roller 40*a* rotates in a counterclockwise direction in FIG. 6, which is the document travel direction, along with the rotation in a counterclockwise direction of the read outlet roller pulley 175.

Further, the timing belt 174 is connected to a sheet discharging roller pulley 179. The sheet discharging roller pulley 179 is connected via a discharge drive roller pulley 180 to the discharge drive roller 42*a* of the document discharging roller set 42. The discharge drive roller 42*a* rotates in a clockwise direction in FIG. 6, which is the document travel direction, along with the rotation in a counterclockwise direction of the sheet discharging roller pulley 179.

The timing belt 174 is connected to pulleys 177 and 178. The pulleys 177 and 178 provide a constant extension force to the timing belt 174 to move the timing belt 174 to rotate.

The timing belt 174 is held in contact with a pulley 177.

Further, the pulley 169 is connected via a tension belt 170 to a pulley 171 of a jam recovery dial 172. The jam recovery dial 172 is provided for operator to use when the operator removes a jammed paper or jammed papers from the document transfer path. When the jam recovery dial 172 is turned, the driving force is transmitted to the pulley 169 via the tension belt 170. When the pulley 169 moves the timing belt 174 to rotate, the jammed paper(s) can be removed.

The tension belt 170 is held in contact with a pulley 173.

In the power transmission mechanism 203 as shown in FIG. 7, a pulley 191 that is connected to the document switchback motor 104 is connected via a timing belt 192 to a pulley 193. When the document switchback motor 104 rotates in either of a normal direction and a reverse direction, the pulley 191 rotates the switchback roller drive roller 45*a* of the pair of switchback rollers 45 in either of a normal direction and a reverse direction, respectively, via a switchback roller drive roller pulley 194.

On the other hand, in transfer of a double face original document, when the length of the original document is equal to or smaller than the reference length based on the detection results from the document length detection sensors 25, 26, and 27, the ADF controller 100 may execute a pre-feeding operation to cause an original document placed on top of the original document stack DS accumulated on the document setting table 24 to separate from the original document stack DS and to pass over the scanning position 80, prior to the third passage over the scanning position 80 for collating the original document in a proper page order.

Specifically, the ADF controller 100 may drive the document feed motor 102 by the reference number of pulses for a period of time from the trailing edge of the original document passes the abutment sensor 35 to the pair of pull-out rollers 36, while reading the reverse face of the preceding or first original document.

At this time, the ADF controller 100 may stop the reverse rotations of the document feed motor 102. When the following or second original document is recognized, the ADF controller 100 may drive the document pickup motor 101 and the document feed motor 102 to execute the pre-feeding operation of the second original document, based on the detection results of the document length detection sensors 25, 26, and 27.

Now, a time required for the trailing edge of a preceding or first original document passing from the scanning position 80 to the document discharging roller set 42 is represented as "Tyo", and a time required for the leading edge of a following or second original document moving from the pair of pull-out rollers 36 to the nip portion of the pair of read inlet rollers 37, which is the registration stop position (reading standby position) for the original document to stop temporarily is represented as "Tpo."

By providing a time "Tdl" that satisfies a relationship of Tyo<(Tpo+Tdl), the ADF controller 100 may transfer the second original document from the pair of pull-out rollers 36.

Thereby, after the trailing edge of the second original document has passed the document discharging roller set 42 and stopped the rotations of the document read motor 103, the leading edge of the second original document may abut against the nip portion of the pair of read inlet rollers 37, so as to correct the skew of the original document.

Further, in transfer of a double face original document, when the first original document is discharged to the document discharging tray 43 after the third passage of the first original document over the scanning position 80, the ADF controller 100 may stop the document switchback motor 104 for a reference period of time and cause the second document to standby at a switchback stop position ST (or, in other words, a type of lay-by) in the switchback path 46*a*.

Figure 23A:
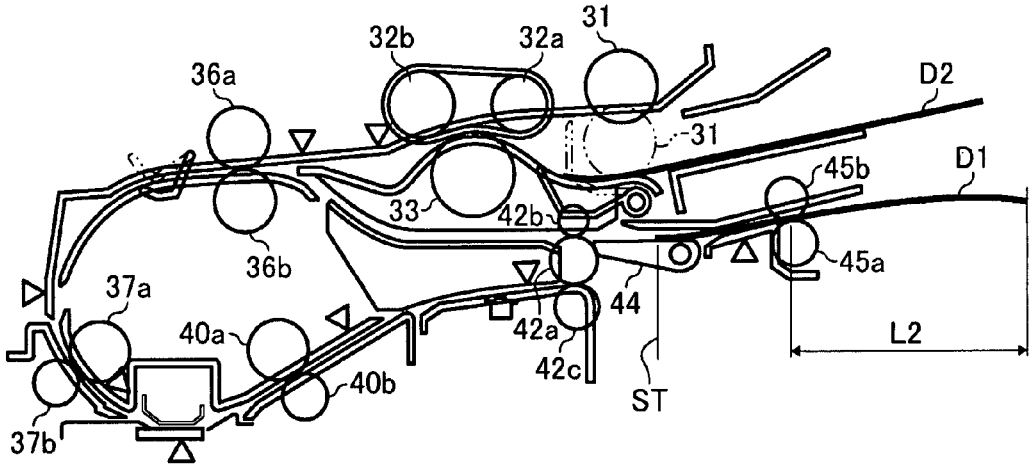
FIGS. 23A-23B are schematic configurations (according to an example embodiment of the present invention) showing the transfer order of a plurality of original documents.

At the switchback stop position ST, an original document is sandwiched by the pair of switchback rollers 45 and a part thereof protrudes to the right side in FIG. 2 by a reference amount or length (L2) (see FIG. 23A). At this time, the leading edge of the original document is positioned to the side of the document discharging roller set 42.

In this example embodiment of the present invention, standby condition of the original document to standby at the switchback stop position ST is set as follows.

When a distance from the pair of read inlet rollers 37 to the pair of switchback rollers 45 is represented as "L1", a distance or length by which an original document protrudes from the nip portion of the pair of switchback rollers 45 to the right side in FIG. 2 is represented as "L2", a transfer distance required to initiate (through up) the document switchback motor 104 is represented as "L3", and a conveyance distance required to stop (through down) the document switchback motor 104 is represented as "L4", the following relationship (1) is satisfied:

$$L1>(L2+L3+L4) \quad (1).$$

The above-described condition has been set so that when the original document that has been standing by at the switchback path 46*a* is transferred toward the scanning position 80, the first original document in the switchback path 46*a* can be completely conveyed out from the switchback path 46*a* and the second original document that has completely been read can be conveyed to the switchback path 46*a*.

Further, the ADF controller 100 may drive the document feed motor 102, the document read motor 103, and the document switchback motor 104 at high speed, so as to transfer the second original document and the first original document that has been standing by at the switchback stop position ST at higher speed than the read scan magnification when the second original document passes over the scanning position 80.

In addition, the ADF controller 100 may rotate the document switchback motor 104 in a reverse direction, so as to transfer the second original document that has been standing by at the switchback stop position ST at higher speed than the read scan magnification when the first original document is completely discharged.

Further, the ADF controller 100 may cause the document switchback motor 104 to rotate in a normal direction after reading the front face of an original document and after reading the reverse face of the original document, so as to change the switchback stop position ST.

The switchback stop position ST after reading the front face of the original document is set closer to the side of the re-entry path 46*b*, which is the side of the document discharging roller set 42, than the switchback stop position ST after reading the reverse face of the original document.

Further, the ADF controller 100 may drive the document feed motor 102, the document read motor 103, and the document switchback motor 104, so that the transfer speed of the original document that is in the standby state at the switchback stop position ST can be transferred at the same speed as the scanning speed when reading the front face of the second original document.

In this example embodiment of the present invention, the document feeding belt 32, the reverse roller 33, the pair of pull-out rollers 36, the document feed motor 102, and the power transmission mechanism 200 form a separation and conveyance mechanism or a first conveying mechanism, and the pair of read inlet rollers 37, the pair of read outlet rollers 40, the document discharging roller set 42, the document read motor 103, and the power transmission mechanism 201 form a read and conveyance mechanism or a second conveying mechanism.

In addition, the pair of switchback rollers 45, the document switchback motor 104, and the power transmission mechanism 202 form a switchback mechanism, and the ADF controller 100 forms a control unit.

The copier main body 21*a* of the copier 21 shown in FIG. 1 further includes an image reading device 81, a writing device 82, and a photoconductive drum 83.

Image data that has read by the image reading device 81 may be exposed by the writing device 82 to the photoconductive drum 83.

The image reading device 81 of FIG. 1 includes a light source 81*a*, a first mirror 81*b*, a second mirror 81*c*, a third mirror 81*d*, a lens 81*e*, and a charge-coupled device (CCD) image sensor 81*f*, which are image forming components.

The light source 81*a* may illuminate an original document placed on the contact glass 22*a* or the slit glass 22*b*.

The first mirror 81*b*, the second mirror 81*c*, and the third mirror 81*d* may respectively reflect light reflected by the original document.

The lens 81*e* may form the light reflected by the third mirror 81*d* to the CCD image sensor 81*f*.

The CCD image sensor 81*f* may convert the light formed as image by the lens 81*e* into an electrical signal.

The light source 81*a* and the first mirror 81*b* are mounted on a first moving member (not shown), and the second mirror 81*c* and the third mirror 81*d* are mounted on a second moving member (not shown).

The first and second moving members may move along the contact glass 22*a* and the slit glass 22*b* in FIG. 1.

When reading or scanning an original document that is placed on the contact glass 22*a*, the first and moving members may be moved or slid under the contact glass 22*a* in the left and right directions in FIG. 1.

When reading or scanning an original document that is passing over the slit glass 22*b*, the first and moving members may be stopped under the slit glass 22*b*.

The writing device 82 may emit a laser light beam that is modulated according to the image data read by the image reading device 81, and expose the charged surface of the photoconductive drum 83 with the laser light beam.

Various image forming components and parts may be arranged around the photoconductive drum 83, which is one of the image forming components and parts. These image forming components and parts are, for example, a developing device 86, a transfer belt 87, a cleaning device 88, a charging device (not shown), and a discharging device (not shown).

The charging device may charge the surface of the photoconductive drum 83 to a constant potential, by a positive corona discharge in the dark that is controlled by a grid.

The writing device 82 may emit a laser diode including image data onto the uniformly charged surface of the photoconductive drum 83 and remove the negative charge on the surface of the photoconductive drum 83 to form an electrostatic latent image.

The developing device 86 may adhere negatively charged toner onto a charge discharged portion on the surface of the photoconductive drum 83 to form a visible toner image.

The transfer belt 87 that is applied with a positive bias may transfer the visible toner image that is negatively charged onto a transfer sheet serving as a recording medium and convey the transfer sheet having the visible toner image thereon.

The cleaning device 88 may include a cleaning blade (not shown) to scrape residual toner remaining on the surface of the photoconductive drum 83.

The discharging device may remove residual charge from the surface of the photoconductive drum 83 by illuminating light-emitting diodes (LEDs) so as to cause the photoconductive drum 83 to be ready for the next image forming onto a next transfer sheet.

The transfer sheet having the visible toner image formed as described above may be transferred to a fixing device 90, by which the visible toner image may be fixed onto the transfer sheet.

In addition, the copier main body 21*a* of the copier 21 of FIG. 1 includes a plurality of sheet cassettes 91, 92, 93, 94, and 95, in which respective transfer sheets S1, S2, S3, S4, and S5 having various sizes are accommodated.

The transfer sheets S1, S2, S3, S4, and S5 accommodated in the plurality of sheet cassettes 91, 92, 93, 94, and 95, respectively, may be picked up and fed to a sheet transfer path by pickup rollers 91*a*, 92*a*, 93*a*, 94*a*, and 95*a*, respectively.

The transfer sheets S1, S2, S3, S4, and S5 may then be separated by sheet feeding rollers 91*b*, 92*b*, 93*b*, 94*b*, and 95*b*, rotating in a sheet travel direction, and reverse rollers 91*c*, 92*c*, 93*c*, 94*c*, and 95*c*, being held in sliding contact with the sheet feeding rollers 91*b*, 92*b*, 93*b*, 94*b*, and 95*b*, respectively, and rotating in a separating direction.

After the separation, the transfer sheets S1, S2, S3, S4, and S5 may be transferred to a pair of registration rollers 98 via a pair of relay rollers 96 and 97.

The transfer sheets S1, S2, S3, S4, and S5 may be fed and stopped at the pair of registration rollers 98. After a reference time, the transfer sheets S1, S2, S3, S4, and S5 may be conveyed to the sheet transfer path formed between the photoconductive drum 83 and the transfer belt 87.

Next, operations of transferring original documents are described, referring to flowcharts shown in FIGS. 8 through 22 and schematic structures of FIGS. 23A through 30B.

The flowcharts of FIGS. 8 through 22 show a document transfer control program that is controlled by the ADF controller 100.

Figure 8:
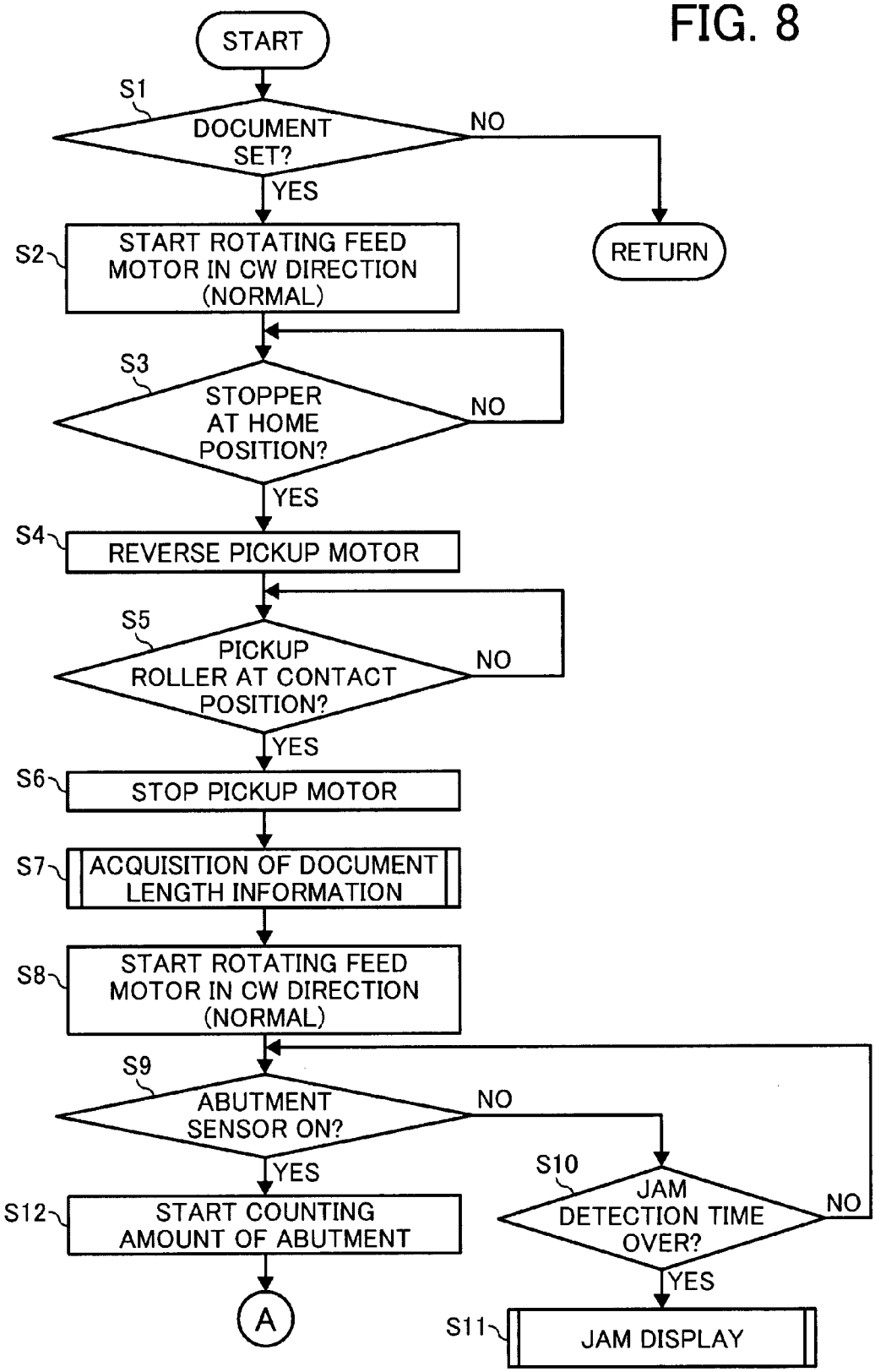
FIG. 8 is a flowchart (according to an example embodiment of the present invention) of a document transfer control performed in the image forming apparatus of FIG. 1.

In step S1 in the flowchart of FIG. 8, the ADF controller 100 determines whether an original document stack DS is set on the document setting table 24, based on the detection result determined by the document length detection sensors 25, 26, and 27.

When a print key on the control panel 108 is pressed, the main body controller 111 sends the document pickup signal to the ADF controller 100 via the I/F 107.

In step S2, the ADF controller 100 drives the document pickup motor 101 to rotate in a normal direction, which is in a clockwise direction.

At this time, the document stopper 28 moves from the leading edge of the original document stack DS.

Then, in step S3, the ADF controller 100 determines whether the document stopper 28 has moved to its home position, based on the detection result of the home position sensor 34.

When it is determined that the document stopper 28 has moved to its home position, the result of step S3 is YES, and the ADF controller 100 rotates the document pickup motor 101 in a reverse direction in step S4.

When it is determined that the document stopper 28 has not moved to its home position, the result of step S3 is NO, and the ADF controller 100 repeats step S3 until it is determined that the document stopper 28 moves to its home position.

After step S4, the ADF controller 100 determines whether the document pickup roller 31 has moved to its contact position in step 55.

When it is determined that the document pickup roller 31 has moved to its contact position, the result of step S5 is YES, and the process proceeds to step S6.

When it is determined that the document pickup roller 31 has not moved to its contact position, the result of step S5 is NO, and the ADF controller 100 repeats step S5 until the document pickup roller 31 moves to the contact position.

In step S6, the ADF control 100 stops the document pickup motor 101, and the process proceeds to step S7.

The ADF controller 100 obtains the length of the original document, based on the result detected by the document length detection sensors 25, 26, and 27 in step S7, and rotates the document feed motor 102 in a normal direction, which is in a clockwise direction.

With the above-described operation, after the document pickup roller 31 has separated an original document on top of the original document stack DS, the original document on top of the original document stack DS can be transferred by the document feeding belt 32 and the reverse roller 33.

After step S8, the process proceeds to step S9.

In step S9, the ADF controller 100 determines whether the abutment sensor 35 has been turned on.

When it is determined that the abutment sensor 35 has not been turned on, the result of step S9 is NO, and the ADF controller 100 determines whether the jam detection time is over or not in step S10.

When it is determined that the jam detection time is not over, the result of step S10 is NO, and the ADF controller 100 repeats step S10 until the jam detection time is over.

When it is determined that the jam detection time is over, the result of step S10 is YES, and abutment sensor 35 has been turned on, the result of step S9 is YES, and the ADF controller 100 determines that a jam indicating that the original document is not abut against the nip portion of the pair of pull-out rollers 36 has occurred and displays a message on the display panel 48 to inform the occurrence of jam in step S11.

When it is determined that the abutment sensor 35 has been turned on, the result of step S9 is YES, and the ADF controller 100 counts the amount or length of abutment of the leading edge of the original document, in step S12.

Specifically, the ADF controller 100 starts counting the drive pulses of the document feed motor 102 that correspond to a reference amount or length of X mm, which is set greater than the distance between the abutment sensor 35 and the pair of pull-out rollers 36.

After step S12, the process proceeds to process A, where process A starts at step S13.

Figure 9:
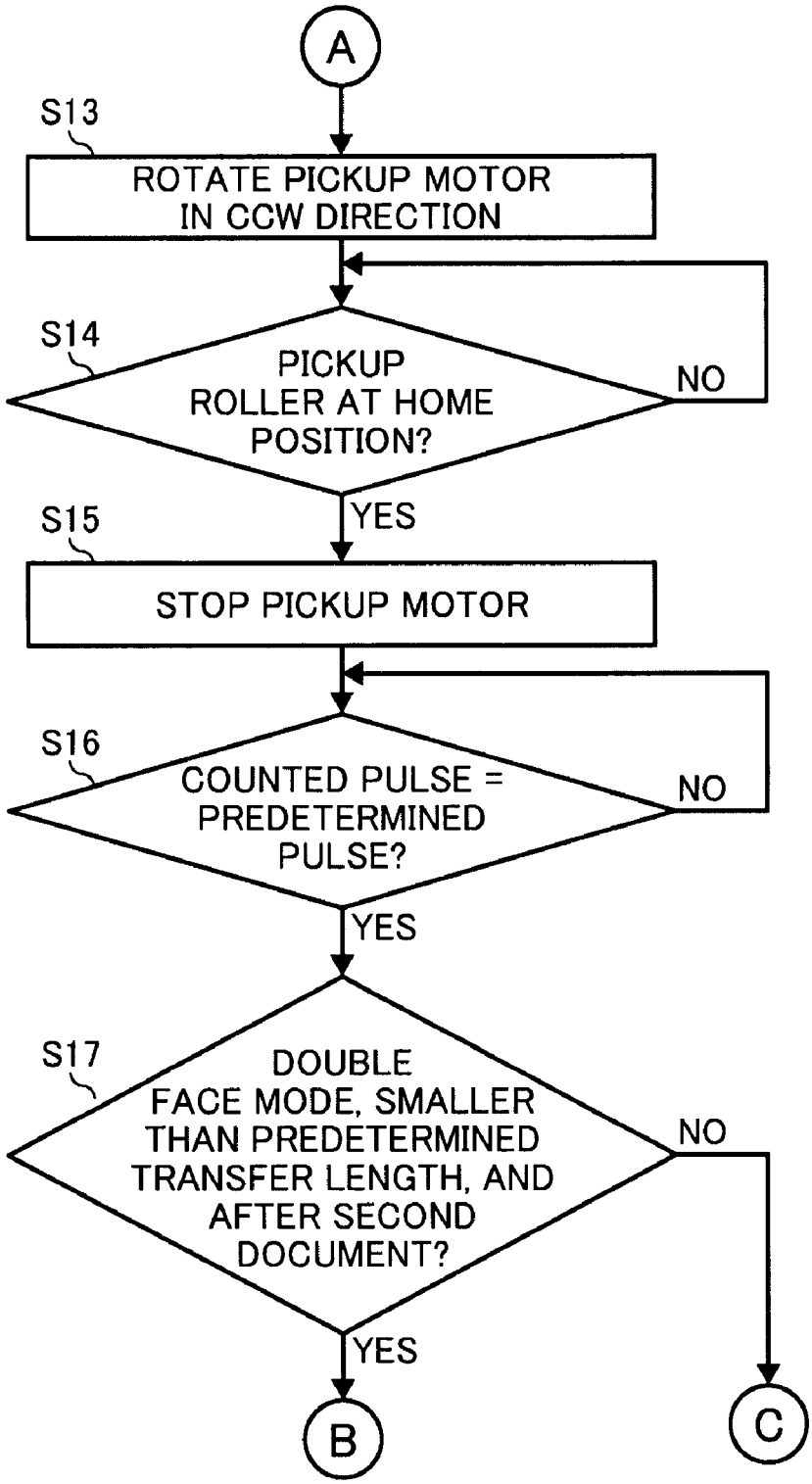
FIG. 9 is a flowchart (according to an example embodiment of the present invention) continued from the flowchart shown in FIG. 8.

As shown in the flowchart of FIG. 9, in step S13, the ADF controller 100 rotates the document pickup motor 101 in a reverse direction, which is a counterclockwise direction, and in step S14, determines whether the document pickup roller 31 has moved to its home position.

When it is determined that the document pickup roller 31 has not moved to the home position, the result of step S14 is NO, and the ADF controller 100 repeats step S14 until the document pickup roller 31 moves to the home position.

When it is determined that the document pickup roller 31 has moved to the home position, the result of step S14 is YES, and the ADF controller stops the rotation of the document pickup motor 101 in step S15. After step S15, the process proceeds to step S16.

In step S16, the ADF controller 100 determines whether the number of counted pulses of the document feed motor 102 has reached the reference number of pulses that corresponds to the amount or length of abutment (X mm).

When it is determined that the number of counted pulses of the document feed motor 102 has not reached the reference number of pulses, the result of step S16 is NO, and the ADF controller 100 repeats step S16 until the number of counted pulses of the document feed motor 102 reaches the reference number of pulses.

When it is determined that the number of counted pulses of the document feed motor 102 has reached the reference number of pulses, the result of step S16 is YES, and the ADF controller 100 determines in step S17 whether the original document while being transferred is (1) in the double face mode, (2) has the transfer length that is equal to or smaller than a reference length, and (3) is the second document or after.

At the timing that the document feed motor 102 has reached the reference number of pulses, the original document is pressed contact to the pair of pull-out rollers 36 while being bowed with a reference amount. Under such condition, the skew caused by the bow with the reference amount is corrected.

When it is determined that the original document while being transferred is in the single face mode, has the transfer length that is equal to or greater than the reference length, and is a first original document, the result of step S17 is NO, and the process proceeds to process C, where process C starts at step S18.

When it is determined that the original document under conveyance is in the double face mode, has the transfer length that is equal to or smaller than a reference length, and is the second sheet or after, the result of step S17 is YES, and the process proceeds to process B, where process B starts at step S19.

Figure 10:
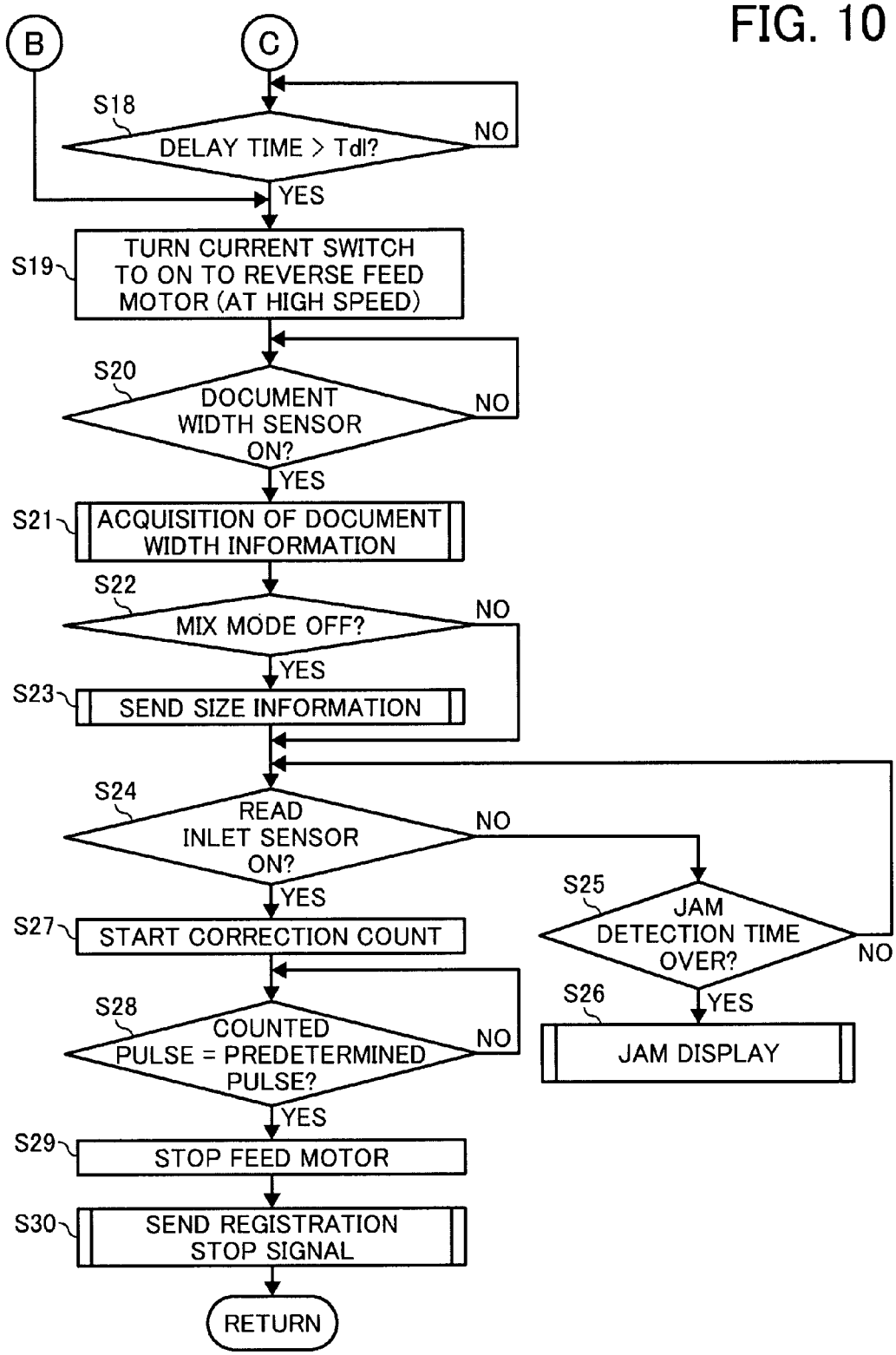
FIG. 10 is a flowchart (according to an example embodiment of the present invention) continued from the flowchart shown in FIG. 9.

In step S18 in the flowchart of FIG. 10, the ADF controller 100 determines whether the delay time is greater than the time Tdl.

When it is determined that the delay time is equal to or smaller than the time Tdl, the result of step S18 is NO, and the ADF controller 100 repeats step S18 until the delay time becomes greater than the time Tdl.

When it is determined that the delay time is greater than the time Tdl, the result of step S18 is YES, and the process proceeds to step S19.

Details of the operation in step S18 will be described later.

In step S19, the ADF controller 100 turns the switch of the current of the document feed motor 102 to ON to drive the document feed motor 102 to rotate at high speed.

When the document feed motor 102 is rotated in a reverse direction, the pair of pull-out rollers 36 is driven whereas the one-way clutch of the pulley 140 prevents the transmission of the driving force to the document pickup roller 31 and the document feeding belt 32. Therefore, the original document is conveyed by the pair of pull-out rollers 36.

After step S19, the process goes to step S20.

In step S20, the ADF controller 100 determines whether the document width detection sensors 38 have been turned on.

When it is determined that the document width detection sensors 38 have not been turned on, the result of step S20 is NO, and the ADF controller 100 repeats step S20 until the document width detection sensors 38 is turned on.

When it is determined that the document width detection sensors 38 have been turned on, the result of step S20 is YES, and the ADF controller 100 obtains information of the width of the original document based on the detection result determined by the document width detection sensors 38 in step S21.

According to the above-described result, the ADF controller 100 can obtain information of the size of the original document stack DS accumulated on the document setting table 24, based on the combination of the length information provided by the document length detection sensors 25, 26, and 27 and the width information provided by the document width detection sensors 38.

At this time, the original document is conveyed toward the scanning position 80 while being sandwiched by the pair of pull-out rollers 36 and the pair of read inlet rollers 37. The transfer speed of the original document is set to high speed. This can reduce the processing time to transfer the original document to the scanning position 80. Specially, when transferring the second original document D2 or after, the document transfer in high speed can reduce the intervals between the preceding original document and the following document, which can enhance the productivity of print images.

After step S21, the ADF controller 100 determines whether the mix mode has been turned off in step S22.

When it is determined that the mix mode has not been turned off, the result of step S22 is NO, and the process goes to step S24.

When it is determined that the mix mode has been turned off, the ADF controller 100 sends the size information of the original document stack DS accumulated on the document setting table 24, to the main body controller 111 in step S23.

After step S23, the ADF controller 100 determines whether the read inlet sensor 39 has been turned on to detect the leading edge of the original document in step S24.

When it is determined that the read inlet sensor 39 has been not been turned on to detect the leading edge of the original document, the result of step S24 is NO, and the ADF controller 100 determines whether the jam detection time has been over in step S25.

When it is determined that the jam detection time has not been over, the result of step S25 is NO, and the process returns to step S24.

When it is determined that the jam detection time has been over, the result of step S25 is YES, and the ADF controller 100 determines that a jam indicating that the leading edge of the original document has not reached the read inlet sensor 39 has occurred and displays a message on the display panel 48 to inform the occurrence of the jam, in step S26.

On the other hand, when it is determined that the read inlet sensor 39 has been turned on, the result of step S24 is YES, and the ADF controller 100 starts the correction count of the amount or length of abutment of the leading edge of the original document, in step S27.

Specifically, the ADF controller 100 starts counting the drive pulses of the document feed motor 102 that corresponds to a reference amount of Y mm, which is an amount greater than the distance between the read inlet sensor 39 and the pair of read inlet rollers 37.

After step S27, the ADF controller 100 determines whether the pulse count of the document feed motor 102 has reached the reference number of pulses that corresponds to the amount or length of abutment (Y mm) in step S28.

When it is determined that the pulse count of the document feed motor 102 has not reached the reference number of pulses, the result of step S28 is NO, and the ADF controller 100 repeats step S28 until the pulse count reaches the reference number of pulses.

When it is determined that the pulse count of the document feed motor 102 has reached the reference number of pulses, the result of step S28 is YES, and the ADF controller 100 causes the document feed motor 102 to stop in step S29.

After step S29, the ADF controller 100 sends the registration stop signal to the main body controller 111 in step S30, and completes the transfer control of the original document to the scanning position 80 to return to the start of the operation for a next original document.

At the timing that the document feed motor 102 has reached the reference number of pulses, the original document is pressed contact to the pair of read inlet rollers 37 while being bowed with a reference amount. Under such condition, the skew caused by the bow with the reference amount is corrected.

Figure 11:
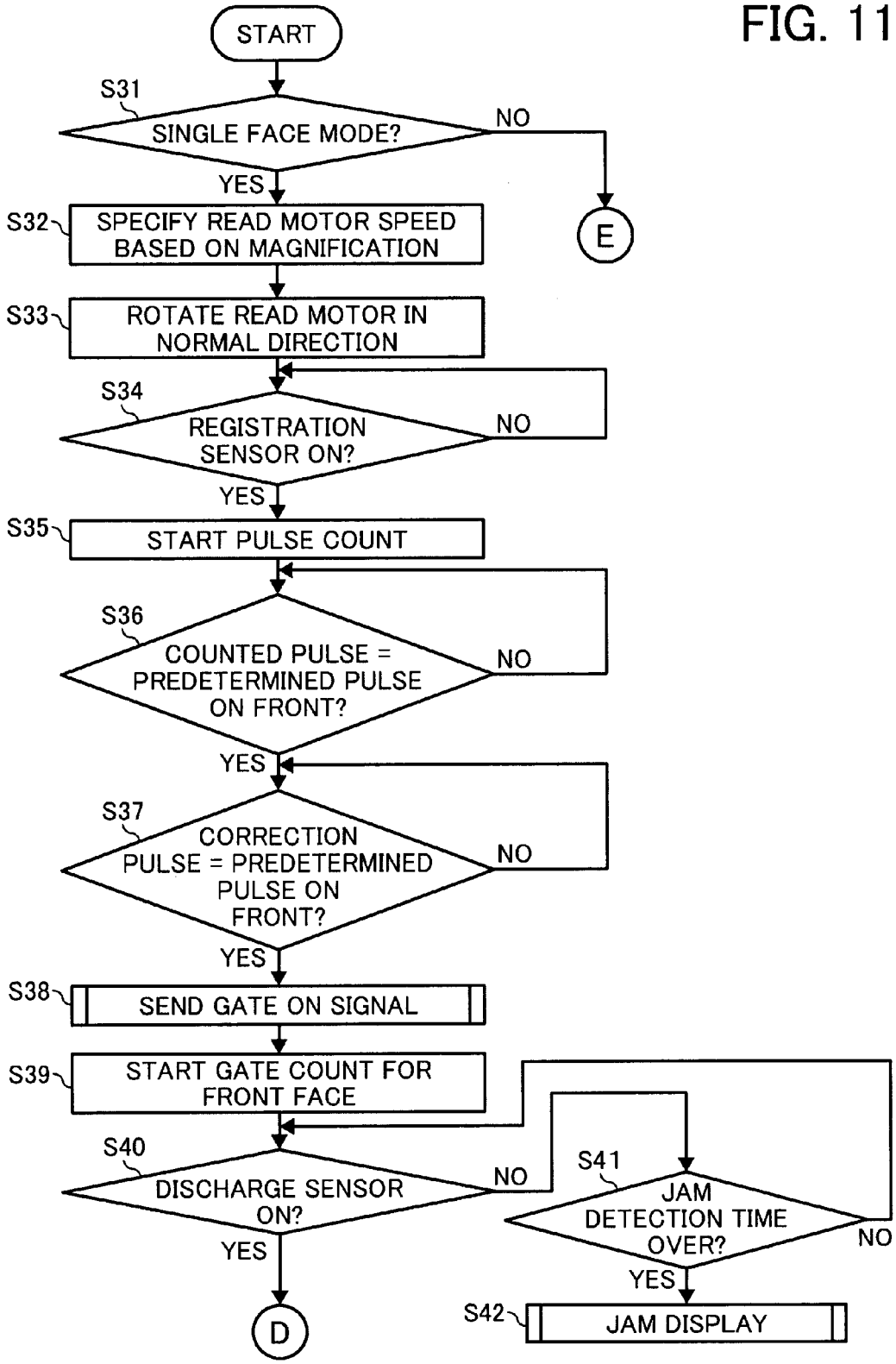
FIG. 11 is a flowchart (according to an example embodiment of the present invention) for starting the reading of an original document.

The flowchart shown in FIG. 11 describes a flow of control program of transferring an original document.

In the flowchart of FIG. 11, the ADF controller 100 determines whether the original document is in the single face mode or not in step S31.

When it is determined that the original document is not in the single face mode, the result of step S31 is NO, and the process proceeds to process E, where process E starts at step S61. Details of the operation of step S61 will be described later.

When it is determined that the original document is in the single face mode, the result of step S31 is YES, the ADF controller 100 specifies the speed of the document read motor 103 based on the read scan magnification in step S32.

After step S32, the ADF controller 100 receives the read start signal from the main body controller 111, and starts to execute the scanning operation of the original document.

Specifically, the ADF controller 100 drives the document read motor 103 to rotate in a normal direction, in step S33, so as to rotate the pair of read inlet rollers 37 and the pair of read outlet rollers 40 at the transfer speed according to the read scan magnification.

After step S33, the ADF controller 100 determines whether the registration sensor 41 has been turned on to detect the leading edge of the original document in step S34.

When it is determined the registration sensor 41 has not been turned on to detect the leading edge of the original document, the result of step S34 is NO, and the ADF controller 100 repeats step S34 until the registration sensor 41 is turned on to detect the leading edge of the original document.

When it is determined that the registration sensor 41 has been turned on to detect the leading edge of the original document, the result of step S34 is YES, and ADF controller 100 starts counting the number of pulses of the document read motor 103 in step S35.

After step S35, the ADF controller 100 determines, in step S36, whether the number of counted pulses of the document read motor 103 has reached a reference number of pulses for the front face of the original document, which corresponds to the distance of the registration sensor 41 and the scanning position 80 on the slit glass 22*b*.

When it is determined that the number of counted pulses of the document read motor 103 has not reached a reference number of pulses for the front face of the original document, the result of step S36 is NO, and the ADF controller 100 repeats step S36 until the number of counted pulse counts of the document read motor 103 reaches a reference number of pulses for the front face of the original document.

When it is determined that the number of counted pulses of the document read motor 103 has reached a reference number of pulses for the front face of the original document, the result of step S36 is YES, and the ADF controller 100 determines, in step S37, whether the number of correction pulses that account for the slip ratio and so forth of the original document has reached a reference number of pulses for the front face of the original document.

When it is determined that the number of correction pulses has not reached a reference number of pulses for the front face of the original document, the result of step S37 is NO, and the ADF controller repeats step S37 until the number of correction pulses reaches a reference number of pulses for the front face of the original document.

When it is determined that the number of correction pulses has reached a reference number of pulses for the front face of the original document, the result of step S37 is YES, the ADF controller 100 sends, in step S38, the gate signal that indicates an image area in a sub-scanning direction, to the main body controller 111 at the timing that the leading edge of the original document reaches the scanning position 80.

After step S38, the ADF controller 100 starts counting the number of the gate counts for the front face of the original document in step S39.

After step S39, the ADF controller 100 determines, in step S40, whether the discharge sensor 50 has been turned on to detect the leading edge of the original document.

When it is determined that the discharge sensor 50 has not been turned on to detect the leading edge of the original document, the result of step S40 is NO, and the ADF controller 100 determines whether the jam detection time has been over or not in step S41.

When it is determined that the jam detection time has not been over, the result of step S41 is NO, and the process goes back to step S40.

When it is determined that the jam detection time has been over, the result of step S41 is YES, and the ADF controller 100 determines a jam indicating that the leading edge of the original document has not reached the discharge sensor 50 has occurred and displays a message on the display panel 48 to inform the occurrence of the jam in step S42.

Figure 12:
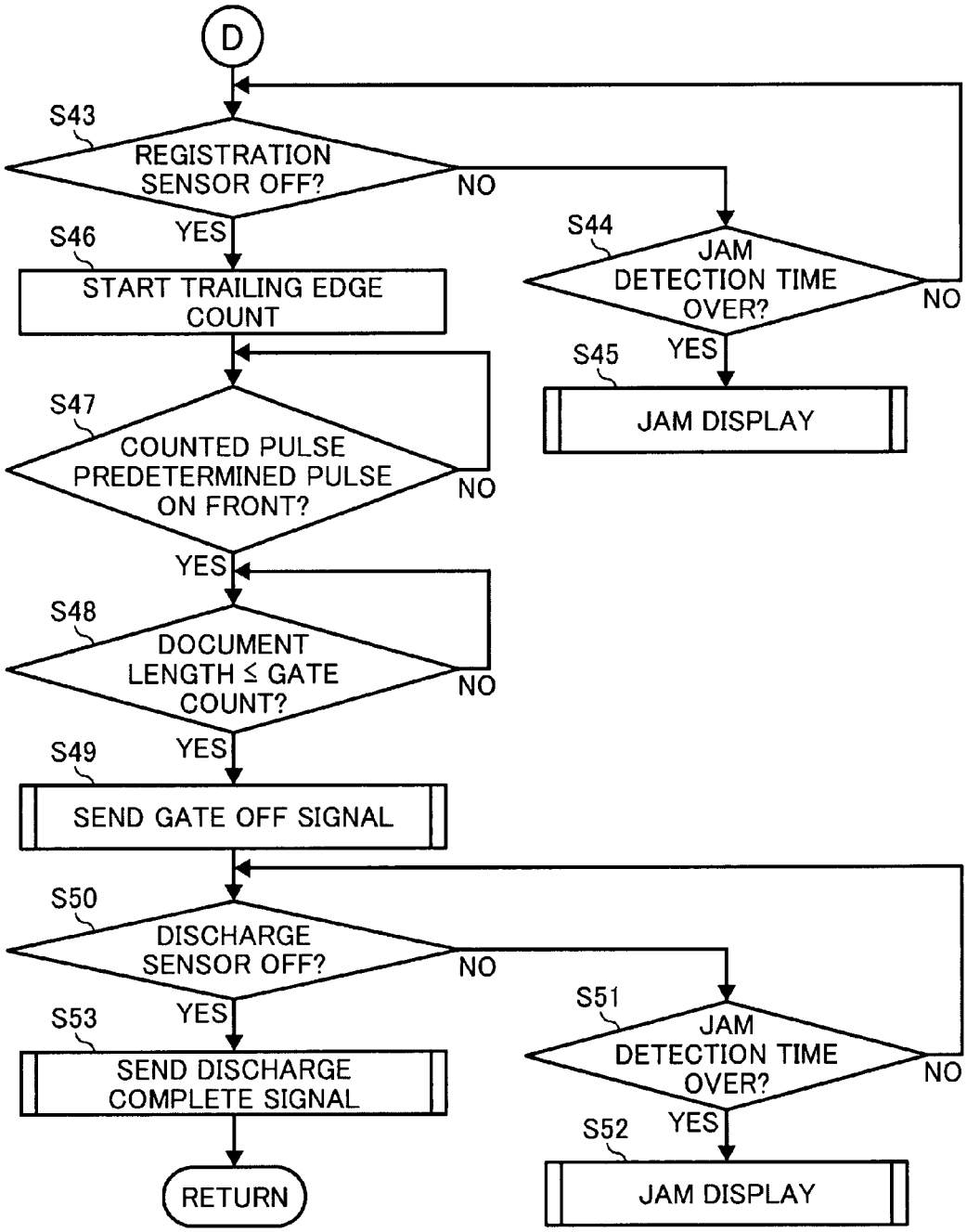
FIG. 12 is a flowchart (according to an example embodiment of the present invention) continued from the flowchart shown in FIG. 11.

On the other hand, when it is determined that the discharge sensor 50 has been turned on to detect the leading edge of the original document, the result of step S40 is YES, the ADF controller 100 determines whether the registration sensor 41 has been turned off in process D starting at step S43, as shown in FIG. 12.

When it is determined that the registration sensor 41 has not been turned off, the result of step S43 is NO, and the ADF controller 100 determines whether the jam detection time has been over in step S44.

When it is determined that the jam detection time has not been over, the result of step S44 is NO, and the process returns to step S43.

When it is determined that the jam detection time has been over, the result of step S44 is YES, and the ADF controller 100 determines that a jam indicating that the original document has not reached the document discharging tray 43 has occurred and displays a message on the display panel 48 to inform the occurrence of the jam in step S45.

On the other hand, when it is determined that the registration sensor 41 has been turned off, the result of step S43 is YES, and ADF controller 100 starts the trailing edge count for counting the number of pulses of the document read motor 103, in step S46.

After step S46, the ADF controller 100 determines, in step S47, whether the number of counted pulses of the document read motor 103 has reached a reference number of pulses for the front face of the original document.

When it is determined that the number of counted pulses of the document read motor 103 has not reached the reference number of pulses for the front face of the original document, the result of step S47 is NO, and the ADF controller 100 repeats step S47 until the number of counted pulses of the document read motor 103 reaches a reference number of pulses for the front face of the original document.

When it is determined that the number of counted pulses of the document read motor 103 has reached a reference number of pulses for the front face of the original document, the result of step S47 is YES, and the ADF controller 100 determines whether the number of counted gate pulses is equal to or greater than the length of the original document, in step S48.

When it is determined that the number of counted gate pulses is smaller than the length of the original document, the result of step S48 is NO, and the ADF controller 100 repeats step S48 until the number of counted gate pulses becomes equal to or greater than the length of the original document.

When it is determined that the number of counted gate pulses is equal to or greater than the length of the original document, the result of step S48 is YES, and the ADF controller 100 sends the gate off signal that indicates the image area in the sub-scanning direction, in step S49.

After step S49, the ADF controller 100 determines whether the discharge sensor 50 has been turned off in step S50.

When it is determined that the discharge sensor 50 has not been turned off, the result of step S50 is NO, and the ADF controller 100 determines whether the jam detection time has been over in step S51.

When it is determined that the jam detection time has not been over, the result of step S51 is NO, and the process goes back to step S50.

When it is determined that the jam detection time has been over, the result of step S51 is YES, the ADF controller 100 determines that a jam indicating that the original document is not completely discharged has occurred and displays a message on the display panel 48 to inform the occurrence of the jam, in step S52.

When it is determined that the discharge sensor 50 has been turned off, the result of step S50 is YES, the ADF controller 100 sends the discharge completion signal to the main body controller 111 in step S53, and completes the procedure to return to the start of the operation for a next original document.

As previously described, when it is determined that the original document is not in the single face mode, the result of step S31 is NO, and the process proceeds to process E, where process E starts at step S61.

Figure 13:
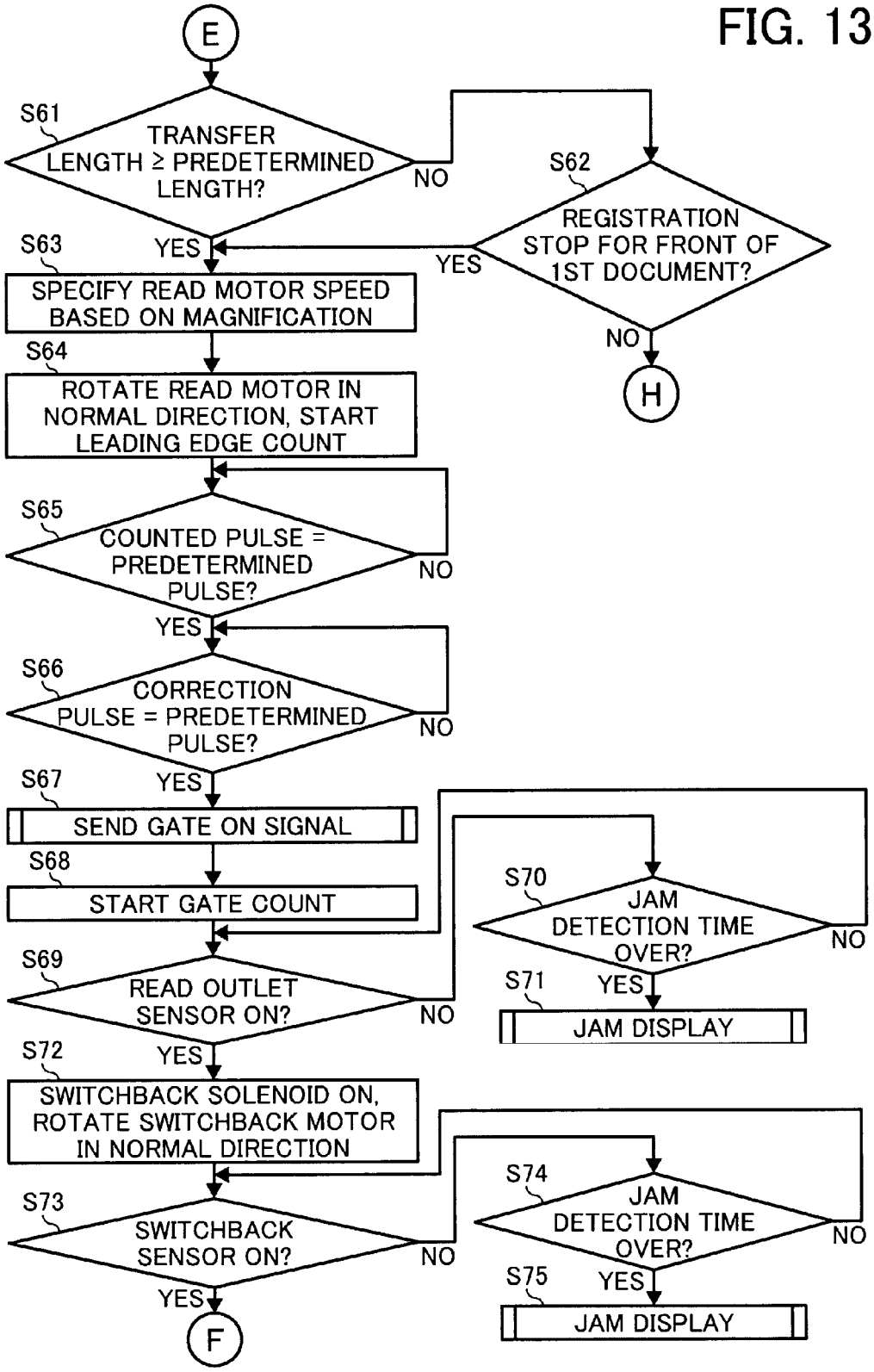
FIG. 13 is a flowchart (according to an example embodiment of the present invention) continued from the flowchart shown in FIG. 12.

In step S61 in the flowchart of FIG. 13, the ADF controller 100 determines whether the transfer length of the original document is equal to or greater than a reference length.

When it is determined that the transfer length of the original document is smaller than the reference length, the result of step S61 is NO, and the ADF controller 100 determines, based on the detection result by the read inlet sensor 39, whether the original document has been stopped at the registration stop position for scanning the front face of the first original document D1, in step S62.

Figure 16:
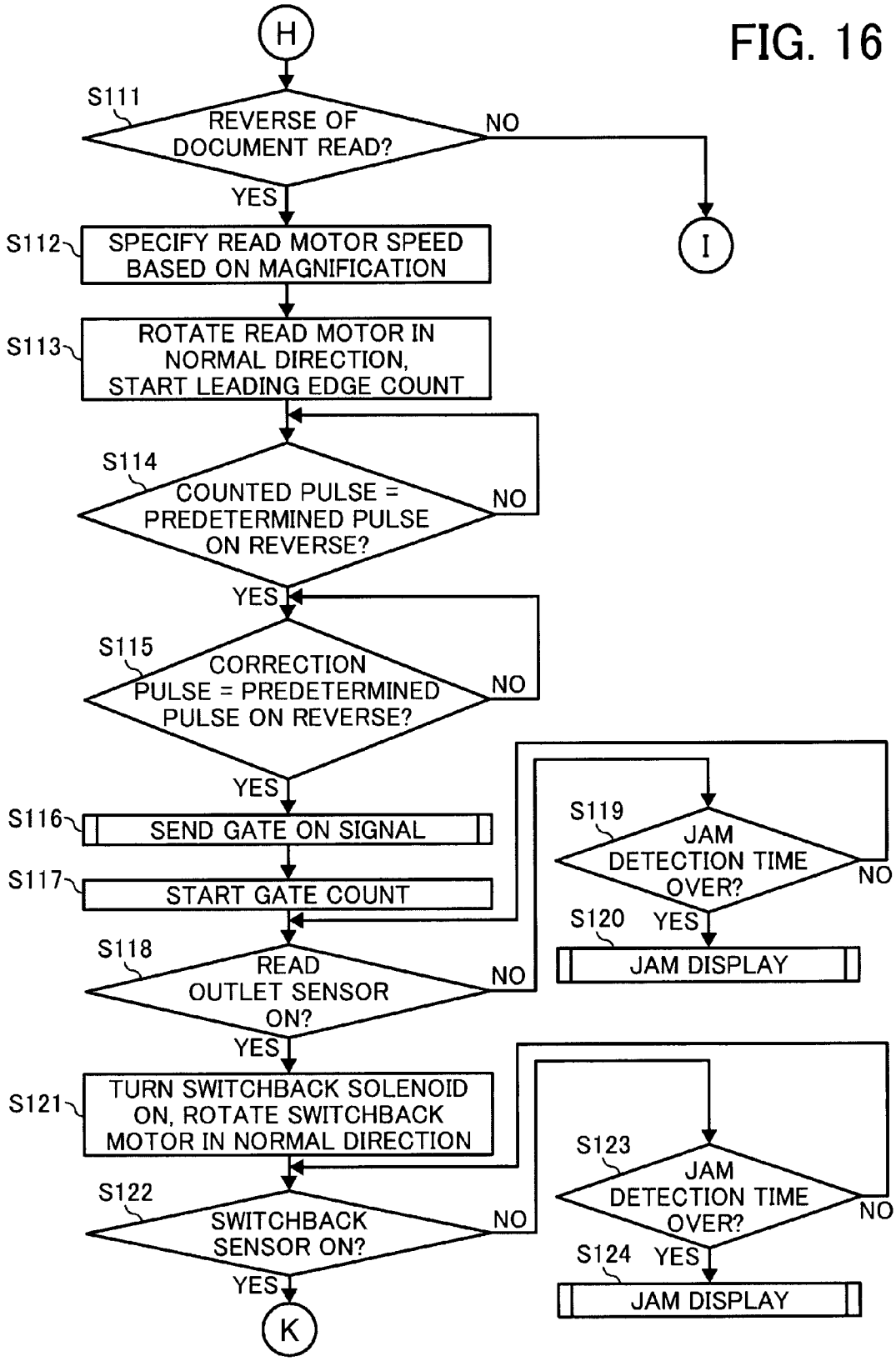
FIG. 16 is a flowchart (according to an example embodiment of the present invention) continued from the flowchart shown in FIG. 13.

When it is determined that the original document has not been stopped at the registration stop position for scanning the front face of the first original document D1, the result of step S62 is NO, and the process proceeds to process H, where process H starts at step S111 in the flowchart of FIG. 16.

Details of the operation of process H starting at step S111 will be described later.

When it is determined that the original document has been stopped at the registration stop position for scanning the front face of the first original document D1, the result of step S62 is YES, and ADF controller 100 specifies, in step S63, the read motor speed of the document read motor 103 based on the read scan magnification.

Then, the ADF controller 100 receives the read start signal from the main body controller 111, and starts reading the original document.

After step S63, the ADF controller 100 drives the document read motor 103 to rotate in a normal direction, in step S64, so as to rotate the pair of read inlet rollers 37 and the pair of read outlet rollers 40 at the transfer speed according to the read scan magnification.

After step S64, the ADF controller 100 determines, in step S65, whether the number of counted pulses of the document read motor 103 has reached a reference number of pulses for the front face of the original document, which corresponds to the distance of the registration sensor 41 and the scanning position 80 on the slit glass 22*b*.

When it is determined that the number of counted pulses of the document read motor 103 has not reached the reference number of pulses for the front face of the original document, the result of step S65 is NO, and the ADF controller 100 repeats step S65 until the number of counted pulses of the document read motor 103 reaches a reference number of pulses for the front face of the original document.

When it is determined that the number of counted pulses of the document read motor 103 has reached a reference number of pulses for the front face of the original document, the result of step S65 is YES, and the ADF controller 100 determines, in step S66, whether the number of correction pulses that account for the slip ratio and so forth of the original document has reached a reference number of pulses for the front face of the original document.

When it is determined that the number of correction pulses has not reached a reference number of pulses for the front face of the original document, the result of step S66 is NO, and the ADF controller repeats step S66 until the number of correction pulses reaches a reference number of pulses for the front face of the original document.

When it is determined that the number of correction pulses has reached a reference number of pulses for the front face of the original document, the result of step S66 is YES, the ADF controller 100 sends, in step S67, the gate signal that indicates an image area in the sub-scanning direction, to the main body controller 111 at the timing that the leading edge of the original document reaches the scanning position 80.

After step S67, the ADF controller 100 starts counting the number of gate pulses for the front face of the original document in step S68.

After step S68, the ADF controller 100 determines, in step S69, whether the read outlet sensor 47 has been turned on to detect the leading edge of the original document.

When it is determined that the read outlet sensor 47 has not been turned on to detect the leading edge of the original document, the result of step S69 is NO, and the ADF controller 100 determines whether the jam detection time has been over or not in step S70.

When it is determined that the jam detection time has not been over, the result of step S70 is NO, and the process goes back to step S69.

When it is determined that the jam detection time has been over, the result of step S70 is YES, and the ADF controller 100 determines that a jam indicating that leading edge of the original document to be discharged has not reached the read outlet sensor 47 has occurred and displays a message on the display panel 48 to inform the occurrence of the jam in step S71.

When it is determined that the read outlet sensor 47 has been turned on to detect the leading edge of the original document, the result of step S69 is YES, the ADF controller 100 turns on the switchback solenoid 105 before the leading edge of the original document that has passed through the scanning position 80 reaches the document discharging roller set 42 when reading the front face of the original document, so that the path switching member 44 can move to the position indicated by a chain double-dashed line shown in FIG. 2, and further drives the document switchback motor 104 to rotate in a normal direction in step S72.

With the above-described operations, the discharge drive roller 42*a* and the upper discharge driven roller 42*b* that are driven by the document read motor 103 and the pair of switchback rollers 45 that is driven by the rotation of the document switchback motor 104 in the normal direction can transfer the original document on the switchback path 46*a* as indicated by arrow B in FIG. 2.

After step S72, the ADF controller 100 determines whether the switchback sensor 49 has been turned on in step S73.

When it is determined that the switchback sensor 49 has not been turned on, the result of step S73 is NO, and the ADF controller 100 determines whether the jam detection time has been over or not in step S74.

When it is determined that the jam detection time has not been over, the result of step S74 is NO, and the process goes back to step S73.

When it is determined that the jam detection time has been over, the result of step S74 is YES, and the ADF controller 100 determines that a jam indicating that the original document has not reached the switchback sensor 49 has occurred and displays a message on the display panel 48 to inform the occurrence of the jam in step S75.

Figure 14A:
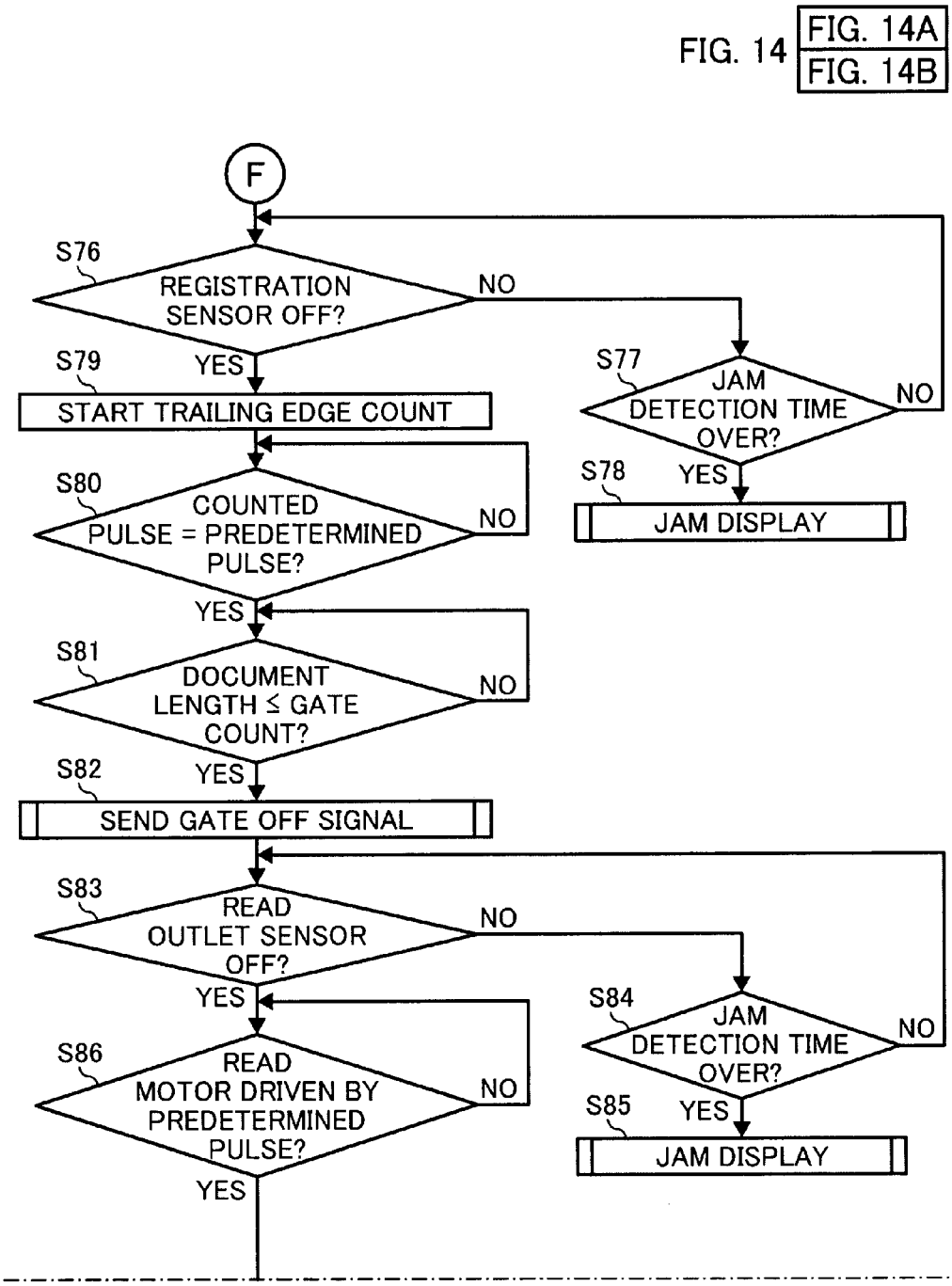
FIG. 14 is (i.e., FIGS. 14A-14B together are) a flowchart (according to an example embodiment of the present invention) continued from the flowchart shown in FIG. 13.
Figure 14B:
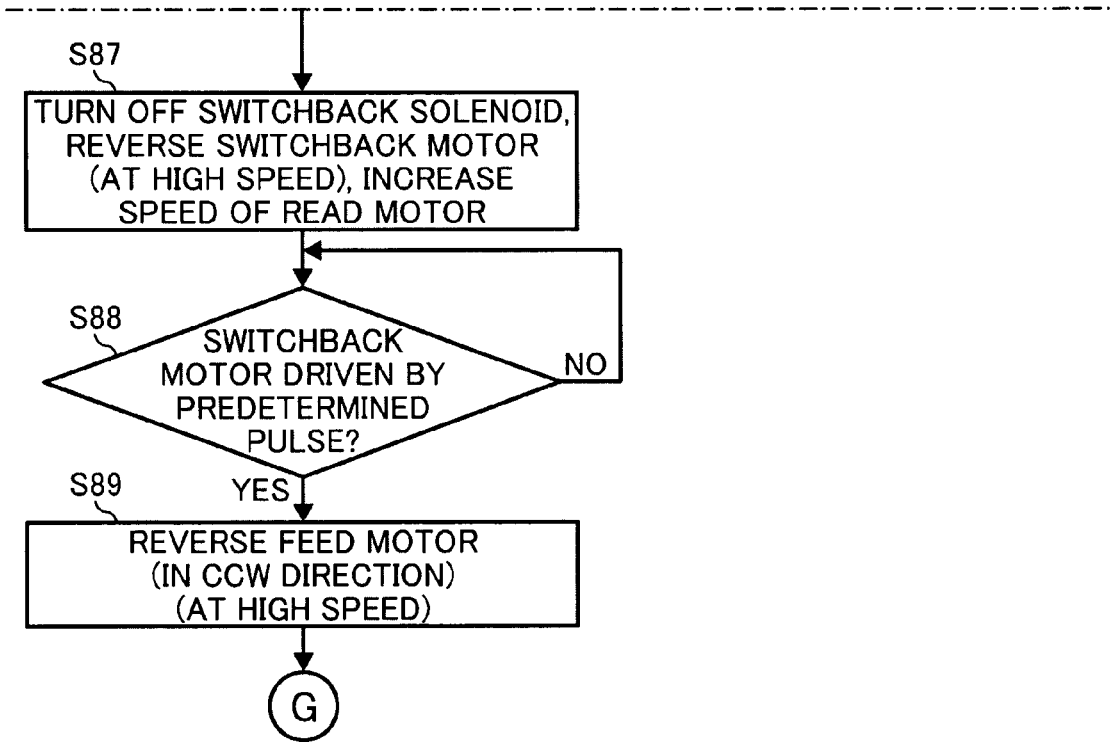

When it is determined that the switchback sensor 49 has been turned on, the result of step S73 is YES, and the process proceeds to process F, where process F starts at step S76 as shown in the flowchart of FIG. 14.

In step S76, the ADF controller 100 determines whether the registration sensor 41 has been turned off.

When it is determined that the registration sensor 41 has not been turned off, the result of step S76 is NO, and the ADF controller 100 determines whether the jam detection time has been over in step S77.

When it is determined that the jam detection time has not been over, the result of step S77 is NO, and the process returns to step S76.

When it is determined that the jam detection time has been over, the result of step S77 is YES, and the ADF controller 100 determines that a jam indicating that the original document has not completely passed the registration sensor 41 has occurred and displays a message on the display panel 48 to inform of the occurrence of the jam in step S78.

On the other hand, when it is determined that the registration sensor 41 has been turned off, the result of step S76 is YES, and ADF controller 100 starts, in step S79, the trailing edge count for counting the number of pulses of the document read motor 103, starting from the time that the trailing edge of the original document is not detected by the registration sensor 41.

After step S79, the ADF controller 100 determines whether the number of counted pulses of the document read motor 103 has reached a reference number of pulses for the front face of the original document in step S80.

When it is determined that the number of counted pulses of the document read motor 103 has not reached a reference number of pulses for the front face of the original document, the result of step S80 is NO, and the ADF controller 100 repeats step S80 until the number of counted pulses of the document read motor 103 reaches a reference number of pulses for the front face of the original document.

When it is determined that the number of counted pulses of the document read motor 103 has reached a reference number of pulses for the front face of the original document, the result of step S80 is YES, and the ADF controller 100 determines, in step S81, whether the number of counted gate pulses is equal to or greater than the length of the original document.

When it is determined that the number of counted gate pulses is smaller than the length of the original document, the result of step S81 is NO, and the ADF controller 100 repeats step S81 until the number of counted gate pulses becomes equal to or greater than the length of the original document.

When it is determined that the number of counted gate pulses is equal to or greater than the length of the original document, the result of step S81 is YES, and the ADF controller 100 sends the gate off signal that indicates the image area in the sub-scanning direction, in step S82.

After step S82, the ADF controller 100 determines whether the read outlet sensor 47 has been turned off in step S83.

When it is determined that the read outlet sensor 47 has not been turned off, the result of step S83 is NO, and the ADF controller 100 determines whether the jam detection time has been over in step S84.

When it is determined that the jam detection time has not been over, the result of step S84 is NO, and the process returns to step S83.

When it is determined that the jam detection time has been over, the result of step S84 is YES, and the ADF controller 100 determines that a jam indicating that the original document has not yet completely been discharged has occurred and displays a message on the display panel 48 to inform of the occurrence of the jam in step S85.

When it is determined that the read outlet sensor 47 has been turned off, the result of step S83 is YES, and the ADF controller 100 determines, in step S86, whether the document read motor 103 is driven by a reference number of pulses after the read outlet sensor 47 has detected the trailing edge of the original document.

When it is determined that the document read motor 103 is not driven by the reference number of pulses after the read outlet sensor 47 has detected the trailing edge of the original document, the result of step S86 is NO, and the ADF controller 100 repeats step S86 until the document read motor 103 is driven to rotate by the reference number of pulses.

When it is determined that the document read motor 103 is driven to rotate by the reference number of pulses after the read outlet sensor 47 has detected the trailing edge of the original document, the result of step S86 is YES, and the ADF controller 100 determines that a reference amount or length of the trailing edge of the original document has been projecting from the portion between the discharge drive roller 42*a* and the upper discharge driven roller 42*b*. At this time, the ADF controller 100 turns off the switchback solenoid 105, and returns the path switching member 44 to the position indicated by the solid line shown in FIG. 2. In addition, after the reference number of pulses has counted, the ADF controller 100 drives the document switchback motor 104 to rotate in a reverse direction at high speed to cause the pair of switchback rollers 45 to rotate in a reverse direction, and increases the speed of the document read motor 103, in step S87. Thereby, the original document may be transferred on the re-entry path 46*b* toward the pair of pull-out rollers 36 as indicated by arrow C in FIG. 2, so as to start scanning the reverse face of the original document that has been stopped at the registration stop position.

At this time, the document read motor 103 drives in the same direction, the document switchback motor 104 drives in the reverse direction, and the document switchback motor 104 and the document read motor 103 are driven in high speed. This can reduce the processing time.

After step S87, the ADF controller 100 determines, in step S88, whether the document switchback motor 104 is driven by a reference number of pulses after the switchback sensor 49 has detected the leading edge of the original document.

When it is determined that the document switchback motor 104 is not driven to rotate by the reference number of pulses after the switchback sensor 49 has detected the leading edge of the original document, the result of step S88 is NO, and the ADF controller 100 repeats step S88 until the document switchback motor 104 is driven by the reference number of pulses.

When it is determined that the document switchback motor 104 is driven to rotate by the reference number of pulses after the switchback sensor 49 has detected the leading edge of the original document, the result of step S88 is YES, and the ADF controller 100 causes the document feed motor 102 to rotate in a counterclockwise direction, which is a direction to drive the pair of pull-out rollers 36, in step S89.

Figures 15, 15A, 15B:
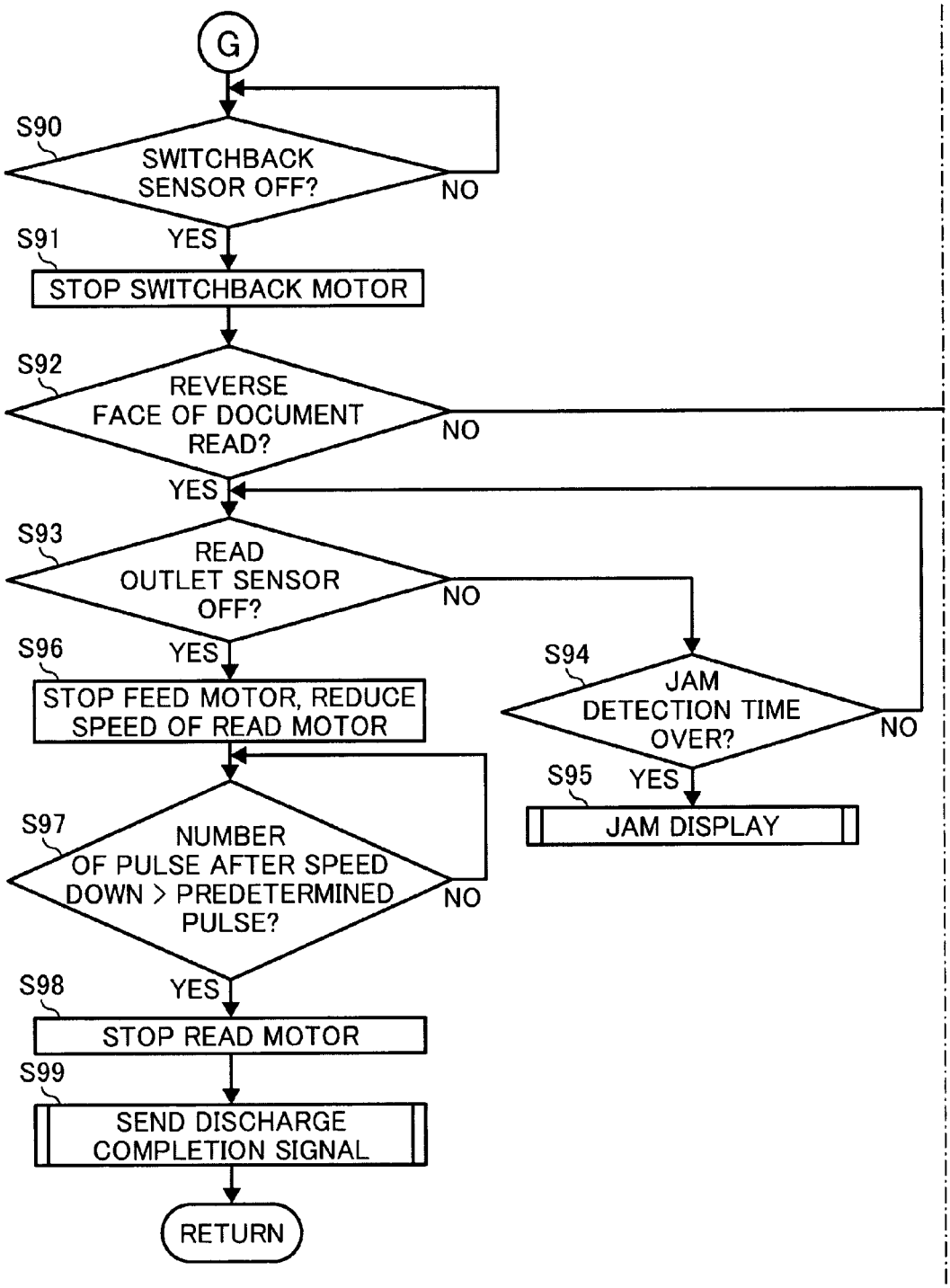
FIG. 15 is (i.e., FIGS. 15A-15B together are) a flowchart (according to an example embodiment of the present invention) continued from the flowchart shown in FIG. 14.
Figure 15B:
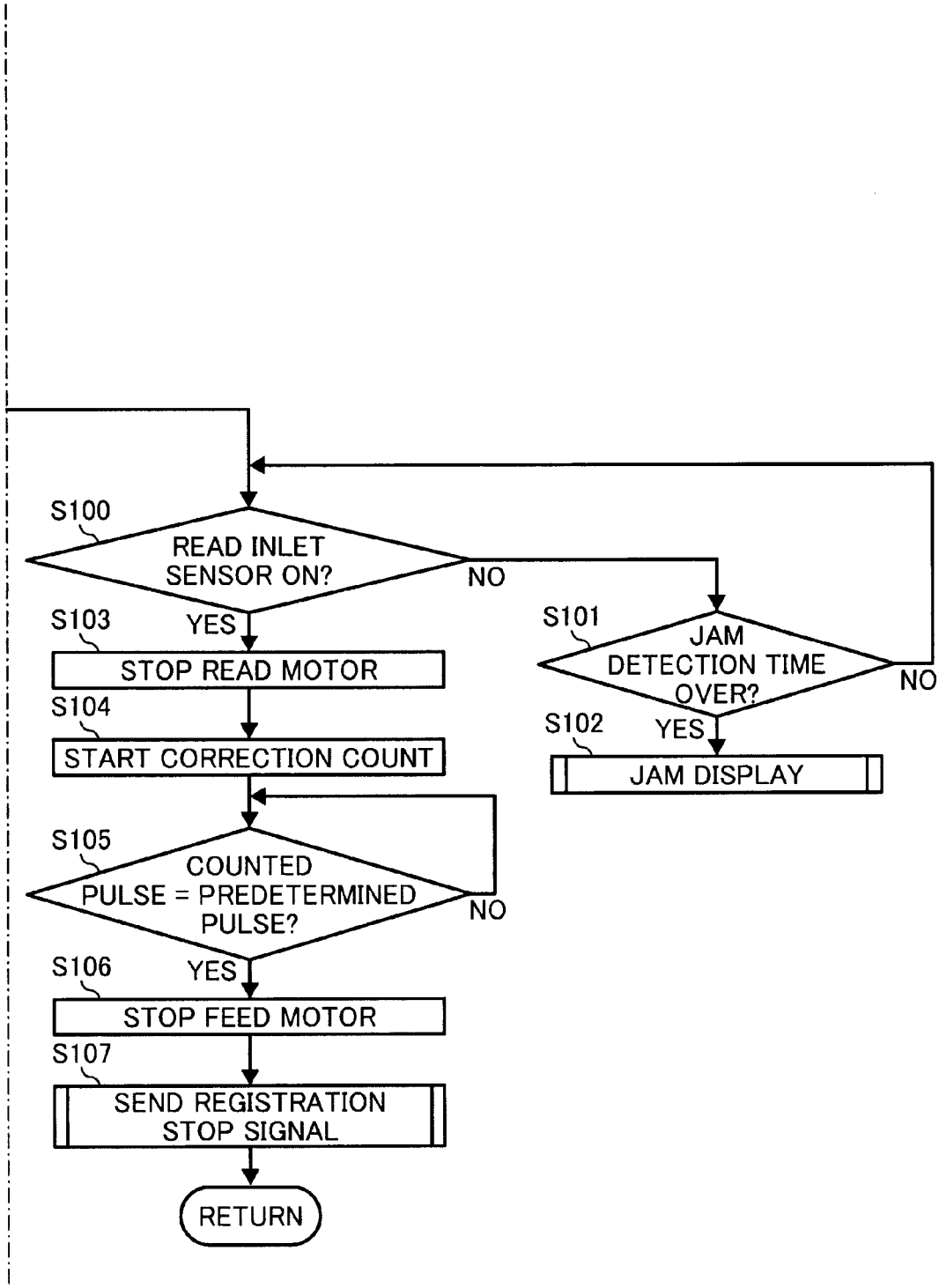

After step S89, the process proceeds to process G, where process G starts at step S90 in the flowchart of FIG. 15.

In step S90, the ADF controller 100 determines whether the switchback sensor 49 has been turned off.

When it is determined that the switchback sensor 49 has not been turned off, the result of step S90 is NO, and the ADF controller 100 repeats step S90 until the switchback sensor 49 is turned off.

When it is determined that the switchback sensor 49 has been turned off, the result of step S90 is YES, the ADF controller 100 stops the document switchback motor 104 in step S91.

After step S91, the ADF controller 100 determines whether the reverse face of the original document has been completely read, in step S92.

When it is determined that the reverse face of the original document has not been completely read, the result of step S92 is NO, and the ADF controller 100 causes the original document to be transferred to the re-entry path 47*b* toward the pair of pull-out rollers 36, as indicated by arrow C in FIG. 2, so as to read the reverse face of the original document. After the skew occurred to the original document has been corrected at the pair of pull-out rollers 36, the ADF controller 100 transfers the original document toward the pair of read inlet rollers 37.

The ADF controller 100 determines whether the read inlet sensor 39 has been turned on, in step S100.

When it is determined that the read inlet sensor 39 has not been turned on, the result of step S100 is NO, the ADF controller 100 determines whether the jam detection time has been over, in step S101.

When it is determined that the jam detection time has not been over, the result of step S101 is NO, and the process returns to step S100.

When it is determined that the jam detection time has been over, the result of step S101 is YES, and the ADF controller 100 determines that a jam indicating that the leading edge of the original document has not passed the read inlet sensor 39 has occurred and displays a message on the display panel 48 to inform of the occurrence of the jam, in step S102.

When it is determined that the read inlet sensor 39 has been turned on, the result of step S100 is YES, the ADF controller 100 causes the document read motor 103 to stop, in step S103, to correct the skew occurred to the original document because of the pair of read inlet rollers 37 when reading the reverse face of the original document.

After step S103, the ADF controller 100 starts counting the number of drive pulses of the document feed motor 102 to correct the skew, in step S104.

After step S104, the ADF controller 100 determines whether the number of counted pulses of the document feed motor 102 has reached a reference number of pulses in step S105.

When it is determined that the number of counted pulses of the document feed motor 102 has not reached the reference number of pulses, the result of step S105 is NO, and the ADF controller 100 repeats step S105 until the number of counted pulses of the document feed motor 102 reaches the reference number of pulses.

When it is determined that the number of counted pulses of the document feed motor 102 has reached the reference number of pulses, the result of step S105 is YES, and the ADF controller 100 causes the document feed motor 102 to stop in step S106, sends the registration stop signal to the main body controller 111 in step S107, and returns to the start of the operation shown in the flowchart in FIG. 11, for a next original document.

When receiving the read start signal from the main body controller 111, the ADF controller 100 executes the procedure from step S63 and after so as to start reading the reverse face of the original document that is stopped at the registration stop position.

For reading the reverse face of the original document, the ADF controller 100 executes steps S63 through S91 in a same manner for reading the front face of the original document.

When reading the reverse face of the original document, the reference number of pulses in steps S65, S66, and S80 represent the reference number of pulses for the reverse face of the original document.

After executing steps S61 through S91, the ADF controller 100 determines, in step S92, whether the reverse face of the original document has been completely read, as previously described.

While the process proceeds to step S100 when it is determined that the reverse face of the original document has not been completely read, the process goes to step S100, when it is determined that the reverse face of the original document has been completely read, the result of step S92 is YES, the ADF controller 100 executes the third transfer of the original document to collate the pages in a proper order, without reading the original document. Then, the ADF controller 100 determines whether the read outlet sensor 47 has been turned off, in step S93.

When it is determined that the read outlet sensor 47 has not been turned off, the result of step S93 is NO, and the ADF controller 100 determines whether the jam detection time has been over in step S94.

When it is determined that the jam detection time has not been over, the result of step S94 is NO, and the process goes back to step S93.

When it is determined that the jam detection time has been over, the result of step S93 is YES, and the ADF controller 100 determines that a jam indicating that the original document has not been completely discharged has occurred and displays a message on the display panel 48 to inform of the occurrence of the jam, in step S95.

When it is determined that the read outlet sensor 47 has been turned off, the result of step S93 is YES, the ADF controller 100 determines that the original document has switched back for the third time and passed through the scanning position 80. After the determination, the ADF controller 100 causes the document feed motor 102 to stop the rotations of the document feed motor 102 and decrease the speed of the document read motor 103, in step S96.

After step S96, the ADF controller 100 determines, in step S97, whether the number of pulses of the document read motor 103 after the decrease of the speed thereof is greater than the reference number of pulses.

When it is determined that the number of pulses of the document read motor 103 after the decrease of the speed thereof is equal to or smaller than the reference number of pulses, the result of step S97 is NO, and the ADF controller 100 repeats step S97 until the number of pulses of the document read motor 103 after the decrease of the speed thereof becomes greater than the reference number of pulses.

When it is determined that the number of pulses of the document read motor 103 after the decrease of the speed thereof is greater than the reference number of pulses, the result of step S97 is YES, and the ADF controller 100 causes the document read motor 103 to stop the rotation thereof in step S98, and to send the document discharge completion signal to the main body controller 111 in step S99.

After step S99, the process returns to the start of the operation in the flowchart of FIG. 11, for a next original document.

As previously described, when it is determined that the original document has not been stopped at a registration stop position for reading the front face of the first original document D1 for the double face original document, the result of step S62 is NO, and the process proceeds to process H, where process H starts at step S111 in the flowchart of FIG. 16.

The procedure from step S111 and after is a flow of reading the reverse face of the original document. Since the flow of reading the front face of the original document is executed in the same manner as the flow of reading the front face of the original document having the same transfer length, the detailed procedure is omitted.

In step S111 in the flowchart of FIG. 16, the ADF controller 100 determines whether the reverse face of the original document is to be read.

Figure 19:
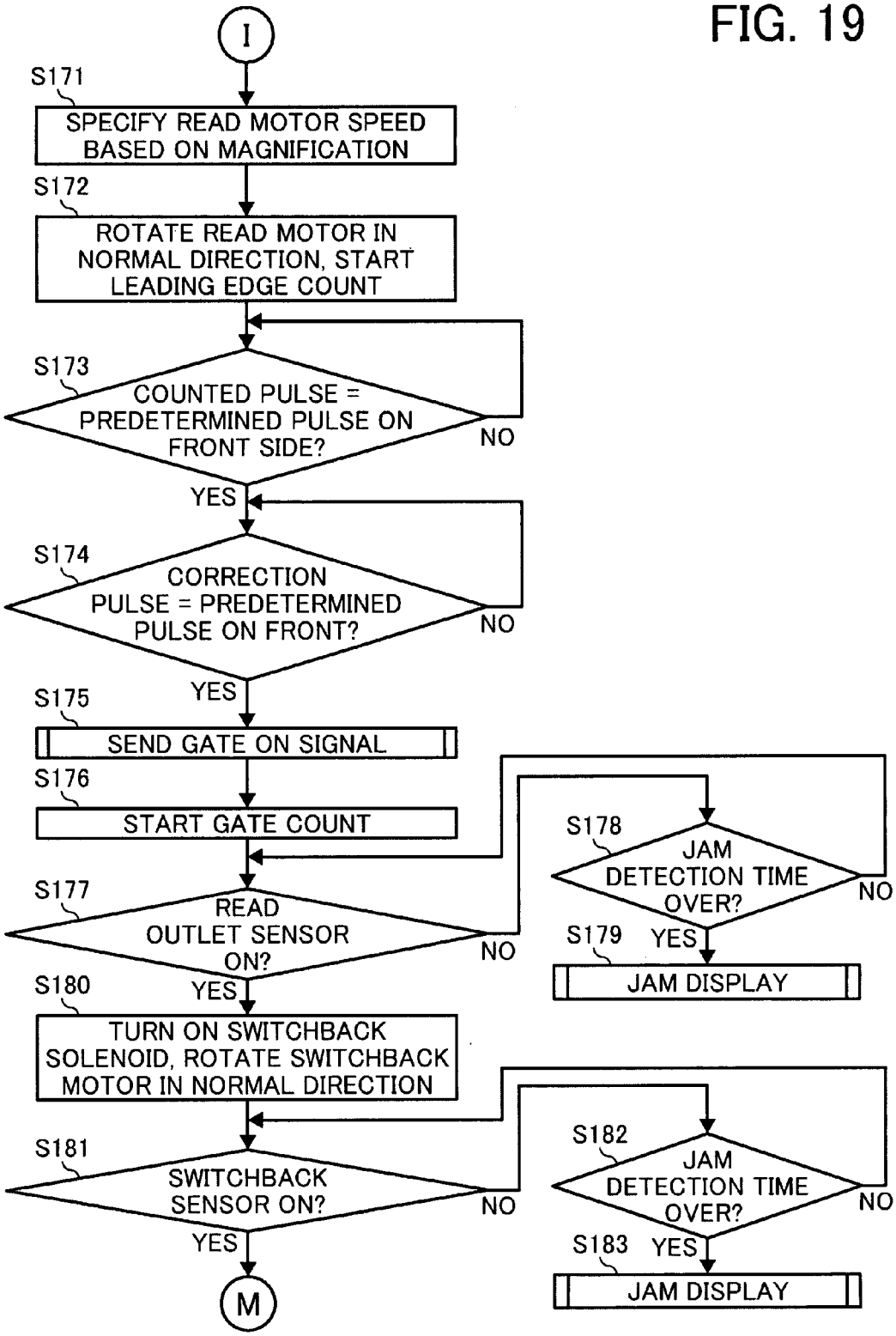
FIG. 19 is a flowchart (according to an example embodiment of the present invention) continued from the flowchart shown in FIG. 16.

When it is determined that the reverse face of the original document is not to be read, the result of step S111 is NO, the process proceeds to process I, where process I starts at step S171 shown in the flowchart of FIG. 19.

When it is determined that the reverse face of the original document is to be read, the result of step S111 is YES, the ADF controller 100 specifies the speed of the document read motor 103 according to the read scan magnification in step S112.

Figure 23B:
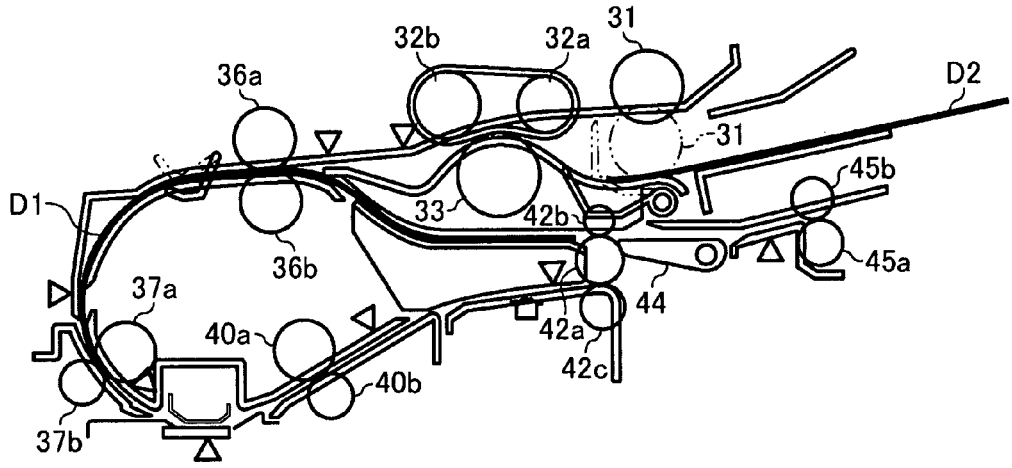

Then, the ADF controller 100 receives the read start signal from the main body controller 111, and starts the scanning operation of the original document (see FIG. 23B).

After step S112, step S113 is executed. In step S113, the ADF controller 100 drives the document read motor 103 to rotate in a normal direction so as to rotate the pair of read inlet rollers 37 and the pair of read outlet rollers 40 according to the read scan magnification, and causes the registration sensor 41 to detect the leading edge of the original document so as to start counting the number of pulses of the document read motor 103.

After step S113, the ADF controller 100 determines, in step S114, whether the number of counted pulses of the document read motor 103 has reached the reference number of pulses for the reverse face of the original document, which corresponds to the distance between the registration sensor 41 and the scanning position 80 on the slit glass 22*b*.

When it is determined that the number of counted pulses of the document read motor 103 has not reached a reference number of pulses for the reverse face of the original document, the result of step S114 is NO, and the ADF controller 100 repeats step S114 until the number of counted pulses of the document read motor 103 reaches a reference number of pulses for the reverse face of the original document.

When it is determined that the pulse count value of the document read motor 103 has reached a reference number of pulses for the reverse face of the original document, the result of step S114 is YES, and the ADF controller 100 determines, in step S115, whether the number of correction pulses that account for the slip ratio and so forth of the original document has reached the reference number of pulses for the reverse face of the original document.

When it is determined that the number of correction pulses has not reached a reference number of pulses for the reverse face of the original document, the result of step S115 is NO, and the ADF controller repeats step S115 until the number of correction pulses reaches a reference number of pulses for the reverse face of the original document.

When it is determined that the number of correction pulses has reached a reference number of pulses for the reverse face of the original document, the result of step S115 is YES, the ADF controller 100 sends the gate signal that indicates an image area in the sub-scanned direction, to the main body controller 111 at the timing that the leading edge of the original document reaches the scanning position 80, in step S116, and starts counting the number of gate pulses of the reverse face of the original document in step S117.

Figure 24A:
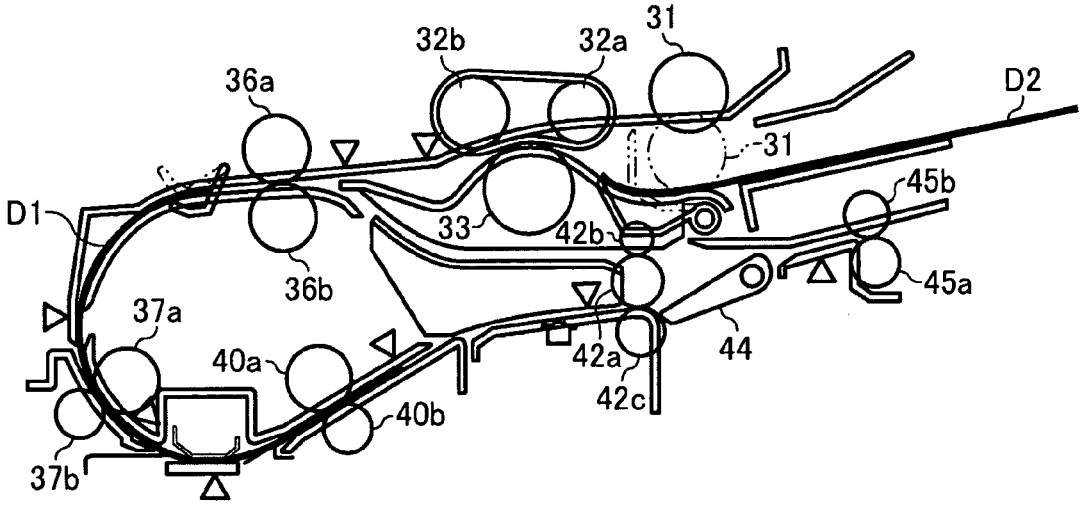
FIGS. 24A-24B are schematic configurations (according to an example embodiment of the present invention) continued vis-a-vis FIGS. 23A-23B.

After step S117, the ADF controller 100 determines, in step S118, whether the read outlet sensor 47 has been turned on to detect the leading edge of the original document (see FIG. 24A).

When it is determined that the read outlet sensor 47 has not been turned on to detect the leading edge of the original document, the result of step S118 is NO, and the ADF controller 100 determines whether the jam detection time has been over or not in step S119.

When it is determined that the jam detection time has not been over, the result of step S119 is NO, and the process goes back to step S118.

When it is determined that the jam detection time has been over, the result of step S119 is YES, and the ADF controller 100 determines that a jam indicating that the original document to be discharged has not passed the read outlet sensor 47 has occurred and displays a message on the display panel 48 to inform of the occurrence of the jam, in step S120.

Figure 24B:
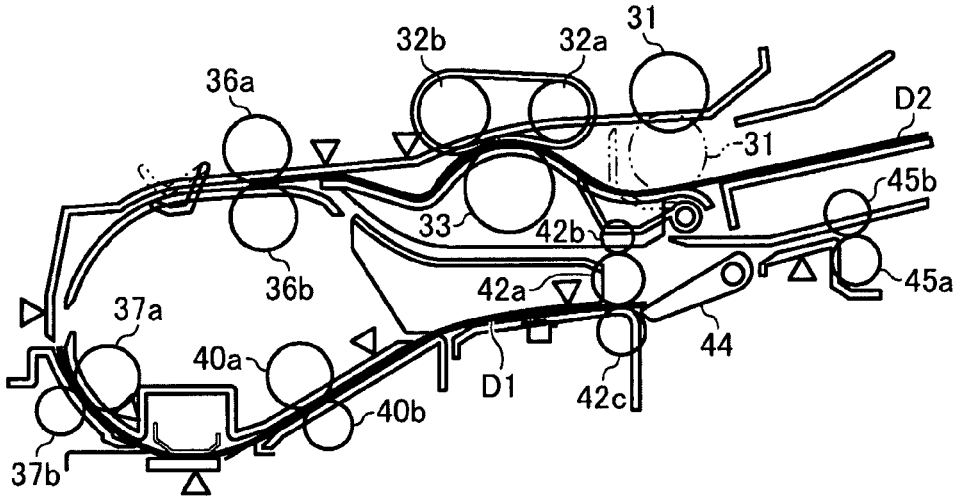

On the other hand, when it is determined that the read outlet sensor 47 has been turned on to detect the leading edge of the original document, the result of step S118 is YES, the ADF controller 100 turns on the switchback solenoid 105 before the leading edge of the original document that has passed through the scanning position 80 reaches the document discharging roller set 42 when reading the reverse face of the original document, so that the path switching member 44 can move to the position indicated by a chain double-dashed line shown in FIG. 2, and drives the document switchback motor 104 to rotate in a normal direction in step S121 (see FIG. 24B).

Figure 25A:
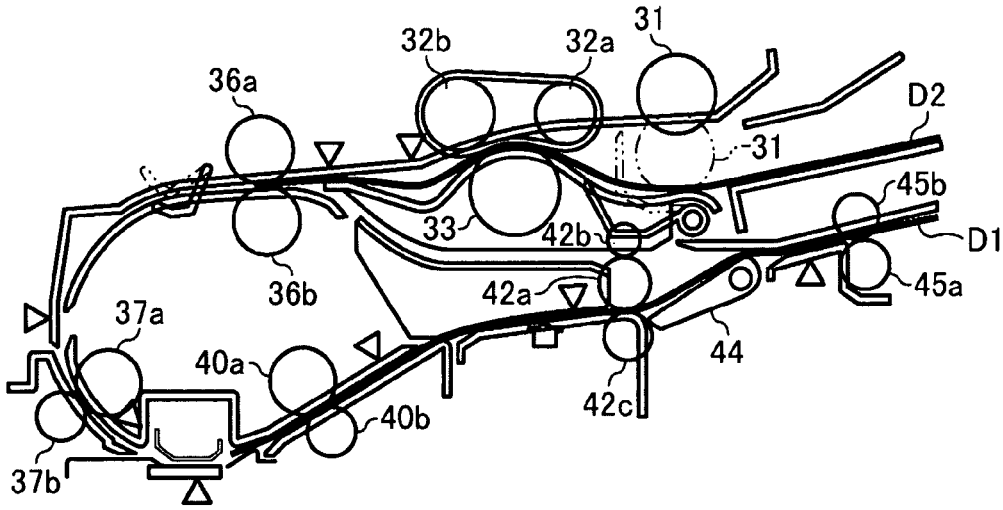
FIGS. 25A-25B are schematic configurations (according to an example embodiment of the present invention) continued vis-a-vis FIGS. 24A-24B.

With the above-described operations, the discharge drive roller 42*a* and the upper discharge driven roller 42*b* that are driven to rotate by the document read motor 103 and the pair of switchback rollers 45 that is driven by the rotation of the document switchback motor 104 in the normal direction can transfer the original document in the switchback path 46*a* as indicated by arrow B in FIG. 2 (see FIG. 25A).

After step S121, the ADF controller 100 determines whether the switchback sensor 49 has been turned on in step S122.

When it is determined that the switchback sensor 49 has not been turned on, the result of step S122 is NO, and the ADF controller 100 determines whether the jam detection time has been over or not in step S123.

When it is determined that the jam detection time has not been over, the result of step S123 is NO, and the process goes back to step S122.

When it is determined that the jam detection time has been over, the result of step S123 is YES, and the ADF controller 100 determines that a jam indicating that the original document has not been switched back has occurred and displays a message on the display panel 48 to inform of the occurrence of the jam, in step S124.

Figures 17, 17A, 17B:
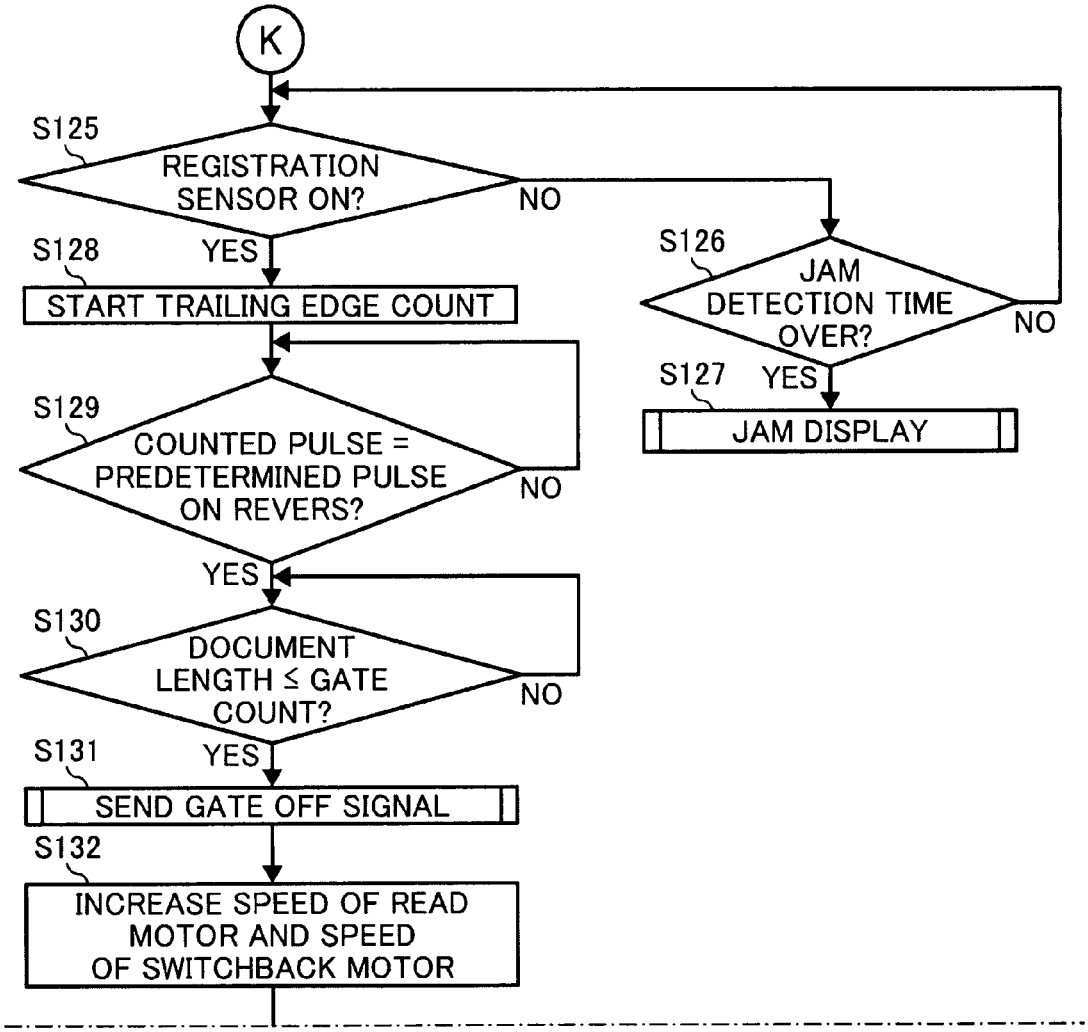
FIG. 17 is (i.e., FIGS. 17A-17B together) a flowchart (according to an example embodiment of the present invention) continued from the flowchart shown in FIG. 16.
Figure 17B:
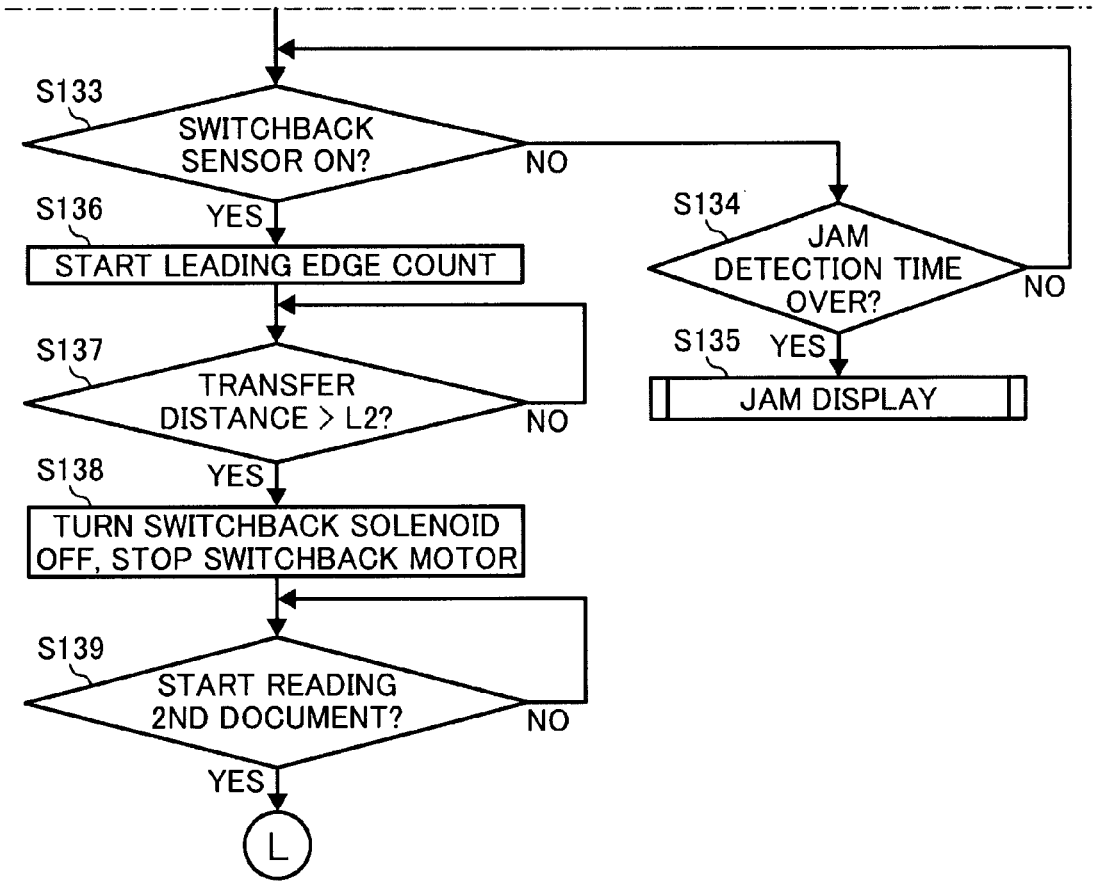

When it is determined that the switchback sensor 49 has been turned on, the result of step S122 is YES, and the process proceeds to process K, where process K starts at step S125 in the flowchart of FIG. 17.

In step S125, the ADF controller 100 determines whether the registration sensor 41 has been turned off.

When it is determined that the registration sensor 41 has not been turned off, the result of step S125 is NO, and the ADF controller 100 determines whether the jam detection time has been over in step S126.

When it is determined that the jam detection time has not been over, the result of step S126 is NO, and the process returns to step S125.

When it is determined that the jam detection time has been over, the result of step S126 is YES, and the ADF controller 100 determines that a jam indicating that the original document has not passed the registration sensor 41 has occurred and displays a message on the display panel 48 to inform of the occurrence of the jam, in step S127.

On the other hand, when it is determined that the registration sensor 41 has been turned off, the result of step S125 is YES, and the ADF controller 100 starts, in step S128, the trailing edge count for counting the pulses of the document read motor 103, starting from the time that the trailing edge of the original document is not detected by the registration sensor 41.

After step S128, the ADF controller 100 determines, in step S129, whether the number of counted pulses of the document read motor 103 has reached a reference number of pulses for the reverse face of the original document.

When it is determined that the number of counted pulses of the document read motor 103 has not reached the reference number of pulses for the reverse face of the original document, the result of step S129 is NO, and the ADF controller 100 repeats step S129 until the number of counted pulses of the document read motor 103 reaches the reference number of pulses for the reverse face of the original document.

When it is determined that the number of counted pulses of the document read motor 103 has reached the reference number of pulses for the reverse face of the original document, the result of step S129 is YES, and the ADF controller 100 determines, in step S130, whether the number of counted gate pulses is equal to or greater than the length of the original document.

When it is determined that the number of counted gate pulses is smaller than the length of the original document, the result of step S130 is NO, and the ADF controller 100 repeats step S130 until the number of counted gate pulses becomes equal to or greater than the length of the original document.

When it is determined that the number of counted gate pulses is equal to or greater than the length of the original document, the result of step S130 is YES, and the ADF controller 100 sends the gate off signal that indicates the image area in the sub-scanning direction, in step S131.

After step S131, the ADF controller 100 increases the speed of the document read motor 103 and the speed of the document switchback motor 104, in step S132.

After step S132, the ADF controller 100 determines whether the switchback sensor 49 has been turned on in step S133.

When it is determined that the switchback sensor 49 has not been turned on, the result of step S132 is NO, the ADF controller 100 determines whether the jam detection time has been over in step S134.

When it is determined that the jam detection time has not been over, the result of step S134 is NO, and the process returns to step S133.

When it is determined that the jam detection time has been over, the result of step S134 is YES, and the ADF controller 100 determines that a jam indicating that the original document has not been completely discharged has occurred and displays a message on the display panel 48 to inform of the occurrence of the jam, in step S135.

Figure 25B:
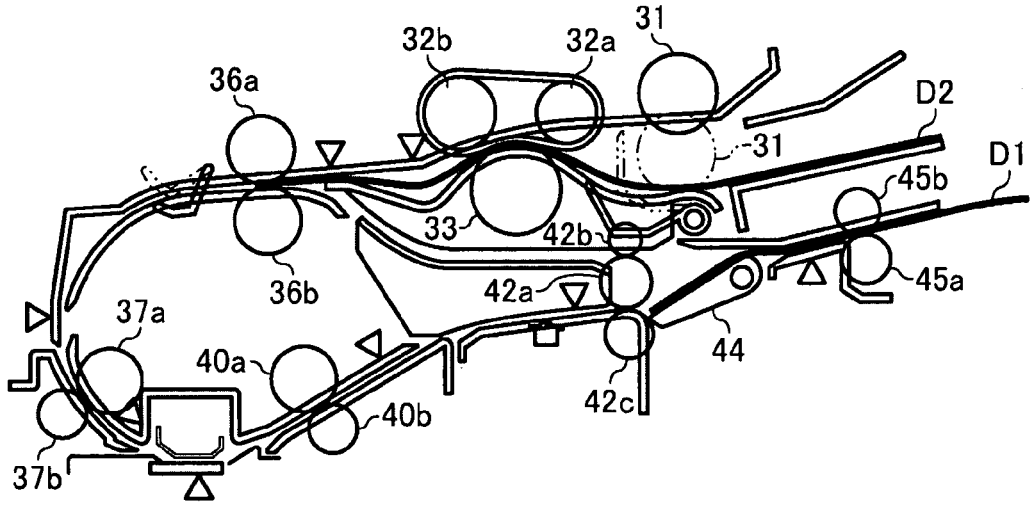

When it is determined that the switchback sensor 49 has been turned on, the result of step S133 is YES, the ADF controller 100 starts, in step S136, the leading edge count for counting the number of drive pulses of the document switchback motor 104, starting from when the switchback sensor 49 detected the leading edge in the document travel direction of the original document transferred to the switchback path 46*a* (see FIG. 25B).

After step S136, the ADF controller 100 determines in step S137 whether the transfer distance of the original document, which is equal to the number of drive pulses of the document switchback motor 104, is greater than the length L2 in the equation (1) that is previously described.

Specifically, in step S137, the ADF controller 100 determines whether the amount or length of the original document projecting beyond the pair of switchback rollers 45 while being sandwiched by the pair of switchback rollers 45 is greater than the length L2, which is set smaller than the length L1 and ranges between the pair of read inlet rollers 37 and the pair of switchback rollers 45.

When it is determined that the transfer distance of the original document is equal to or smaller than the length L2, the result of step S137 is NO, and the ADF controller 100 repeats step S137 until the transfer distance of the original document becomes greater than the length L2.

Figure 26A:
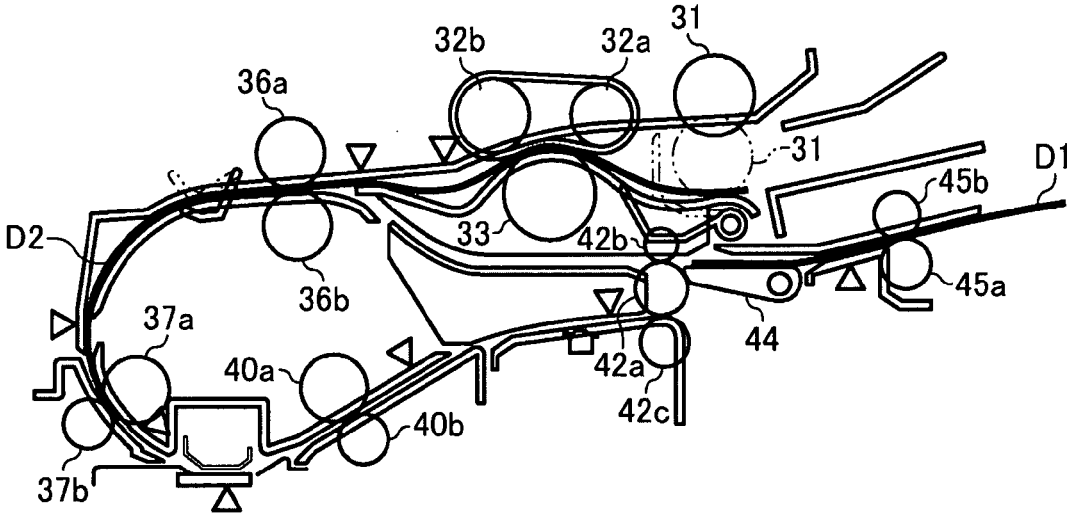
FIGS. 26A-26B are schematic configurations (according to an example embodiment of the present invention) continued vis-a-vis FIGS. 25A-25B.
Figure 26B:
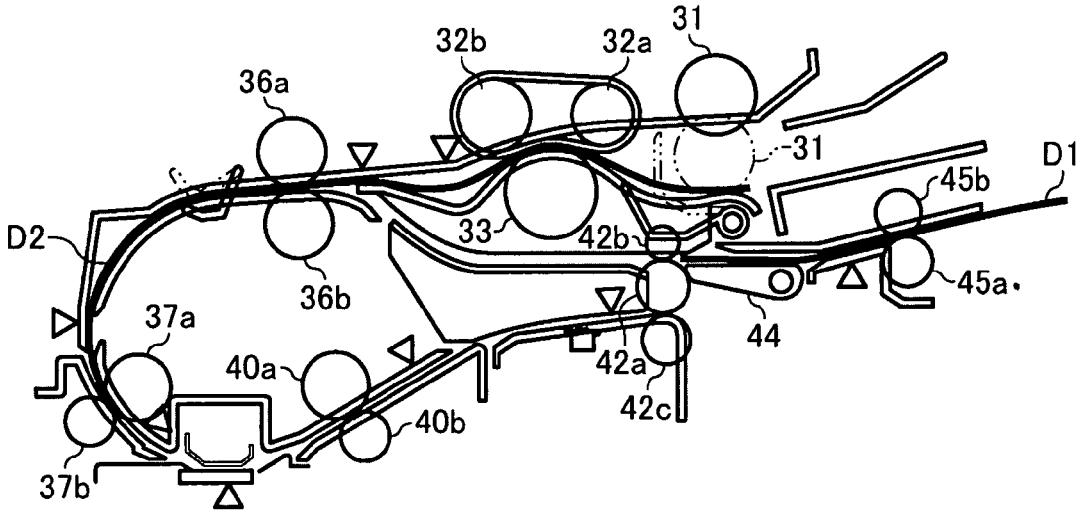

When it is determined that the transfer distance of the original document is greater than the length L2, the result of step S137 is YES, and the ADF controller 100 determines that the original document has been positioned to the switchback stop position ST, turns off the switchback solenoid 105 to move the path switching member 44 to the position indicated by the solid line in FIG. 2 and stops the rotations of the document switchback motor 104, in step S138 (see FIG. 26A).

After step S138, the ADF controller 100 determines whether the reading of a next original document is started, in step S139.

Specifically, step S139 is a process to determine whether the prefeed operation for the next original document is started while the preceding original document has been standing by at the switchback stop position ST after the completion of the reading of the reverse face of the preceding original document.

When it is determined that the reading of the next original document has not been started, the result of step S139 is NO, and the ADF controller repeats step S139 until the reading of the next original document is started.

Figure 18A:
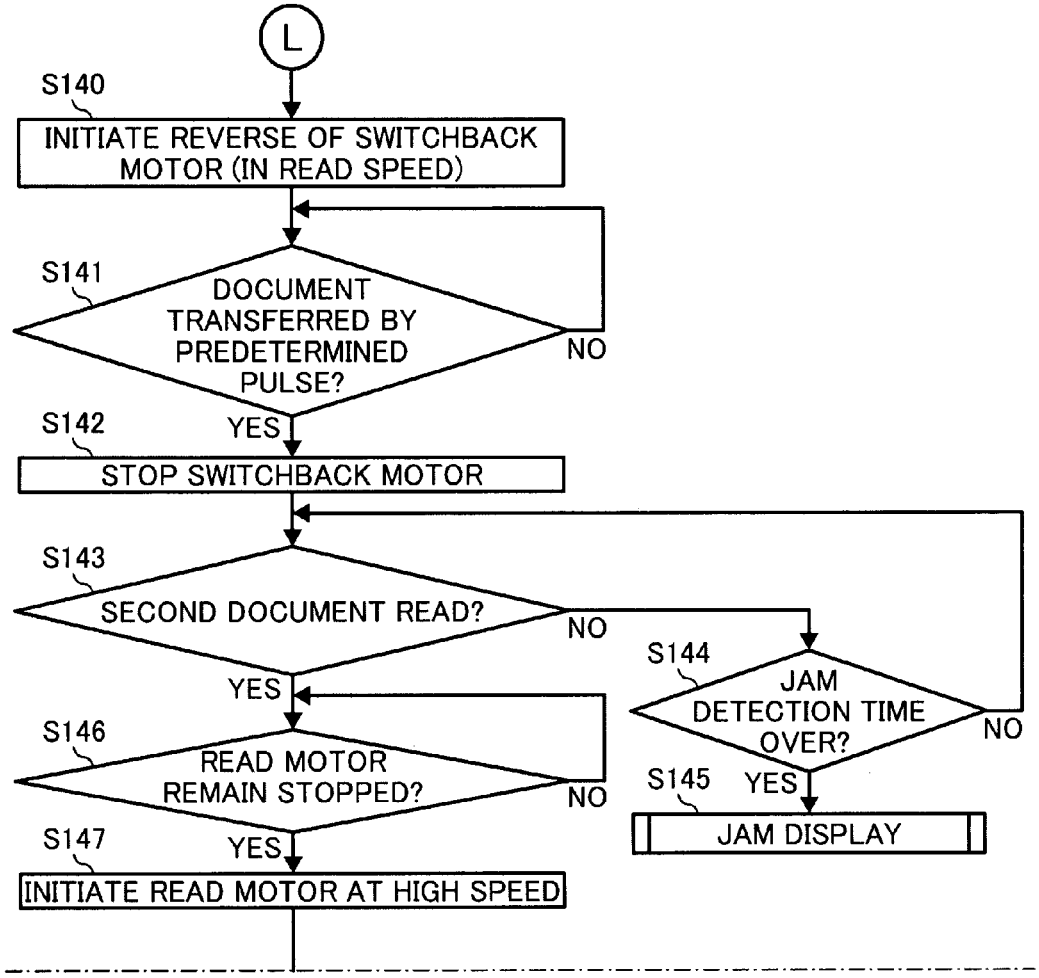
FIG. 18 is (i.e., FIGS. 18A-18B together) a flowchart (according to an example embodiment of the present invention) continued from the flowchart shown in FIG. 17.
Figure 18B:
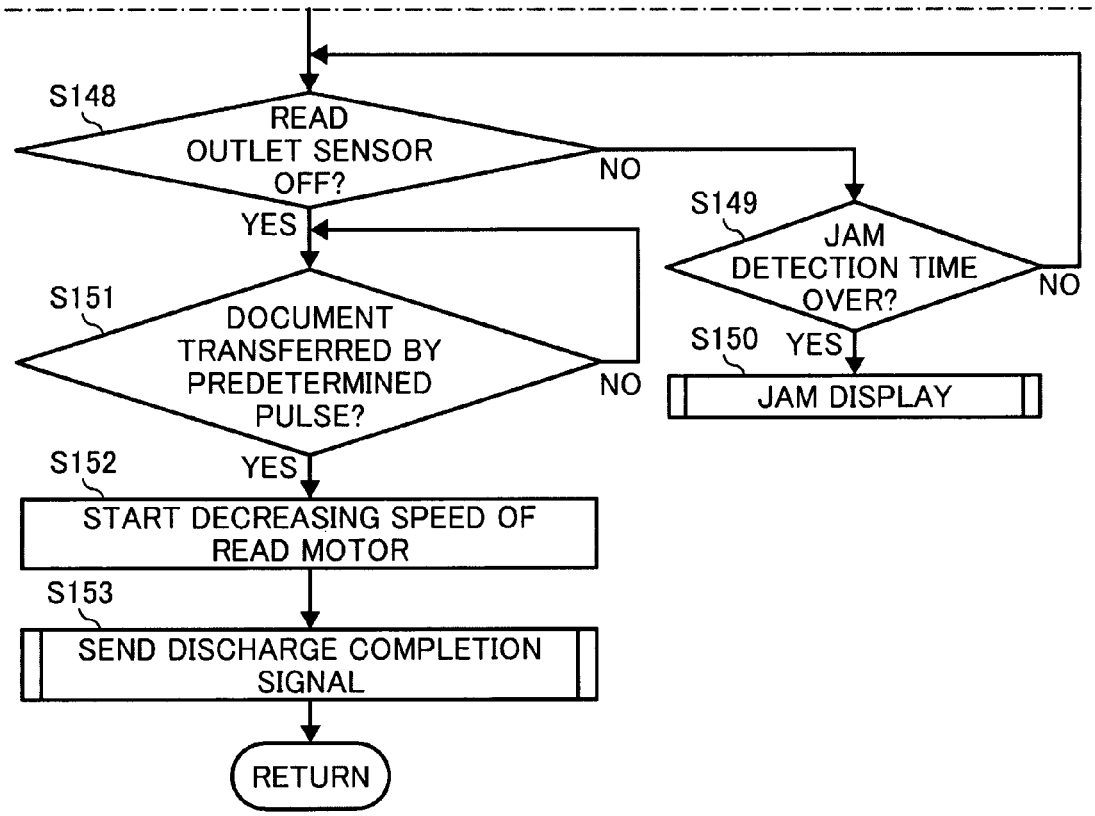

When it is determined that the reading of the next original document has been started, the result of step S139 is YES, and the process proceeds to process L, where process L starts at step S140 in the flowchart of FIG. 18.

Figures 22, 22A:
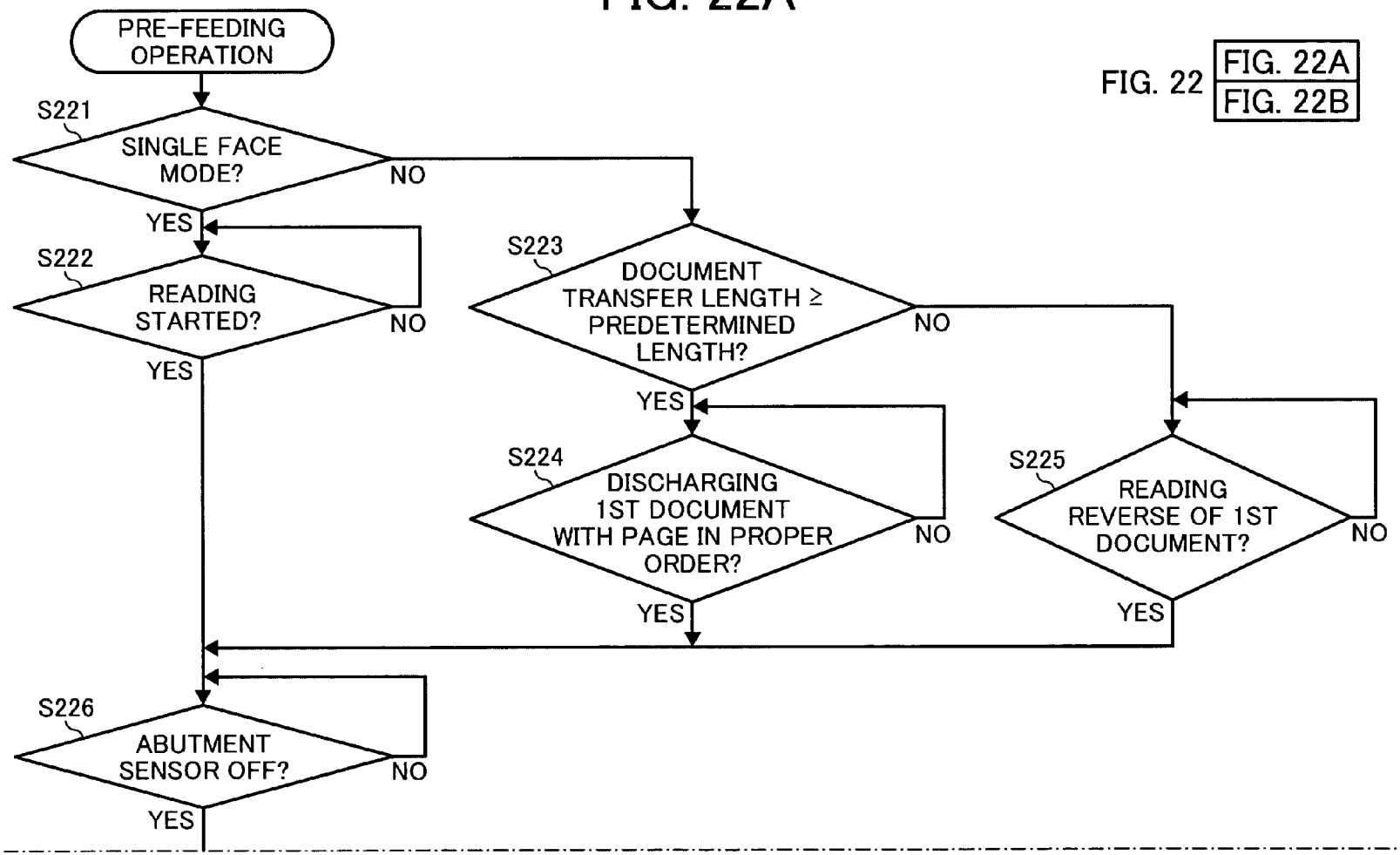
FIG. 22 is (i.e., FIGS. 22A-22B together) a flowchart (according to an example embodiment of the present invention) of a pre-feeding operation of an original document.
Figure 22B:
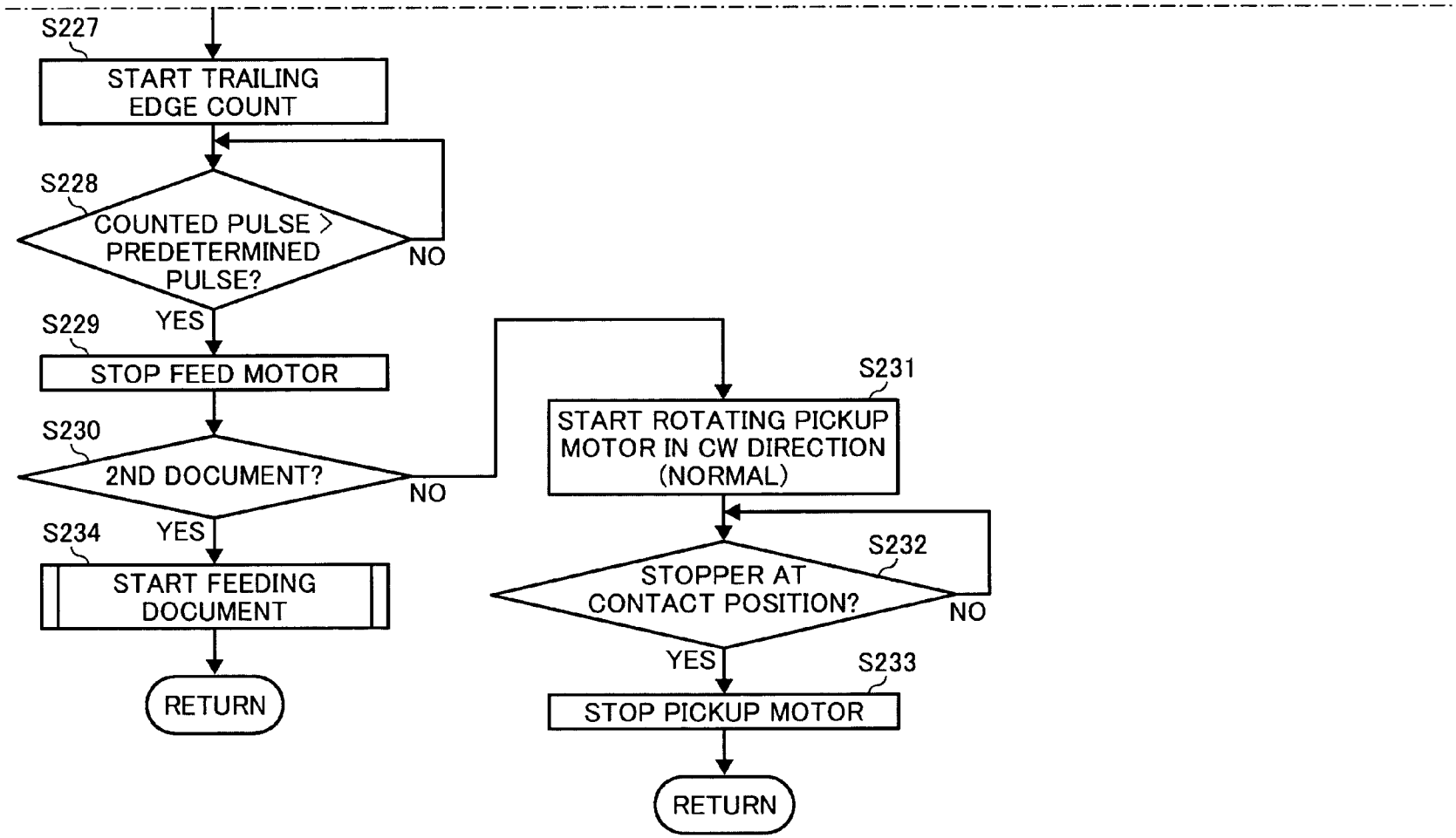

Details of the prefeed operation are shown in the flowchart of FIG. 22, as described below.

In the example embodiment of the present invention, a preceding original document is referred to as a "first original document D1", and a next original document following the preceding or first original document is referred to as a "second original document D2."

In step S221 in the flowchart of FIG. 22, the ADF controller 100 determines whether the first original document D1 is in the single face mode.

When it is determined that the first original document D1 is in the single face mode, the result of step S221 is YES, and the ADF controller 100 receives the read start signal from the main body controller 111, and determines whether the reading of the first original document D1 has been started, in step S222.

When it is determined that the reading of the first original document D1 has not been started, the result of step S222 is NO, and the ADF controller 100 repeats step S222 until the reading of the first original document D1 is started.

When it is determined that the reading of the first original document D1 has been started, the result of step S222 is YES, the process proceeds to step S226.

In step S226, the ADF controller 100 determines whether the abutment sensor 35 has been turned off.

When it is determined that the abutment sensor 35 has not been turned off, the result of step S226 is NO, the ADF controller 100 repeats step S226 until the abutment sensor 35 is turned off.

When it is determined that the abutment sensor 35 has been turned off, the result of step S226 is YES, the ADF controller 100 starts the trailing edge count for counting the number of drive pulses of the document feed motor 102 after the abutment sensor 35 has detected the trailing edge of the first original document D1, in step S227.

After step S227, the ADF controller 100 determines whether the trailing edge count is greater than the reference number of pulses, in step 5228.

The reference number of pulses is set to the number of drive pulses of the document feed motor 102, counting from when the abutment sensor 35 detected the trailing edge of the original document to when the original document passed the pair of pull-out rollers 36.

When it is determined that the trailing edge count is equal to or smaller than the reference number of pulses, the result of step S228 is NO, and the ADF controller 100 repeats step S228 until the trailing edge count becomes greater than the reference number of pulses.

When it is determined that the trailing edge count is greater than the reference number of pulses, the result of step S228 is YES, the ADF controller 100 stops the rotations of the document feed motor 102 rotating in the reverse direction in step S229, and determines whether the second original document D2 is set on the document setting table 24, in step S230.

When it is determined that the second original document is set on the document setting table 24, the result of step S230 is YES, and the ADF controller 100 executes the procedure in the flowcharts shown in FIGS. 8 through 10, so as to feed the second original document D2, in step S234 (see FIGS. 24B, 25A, 25B, 26A, and 26B).

When it is determined that the second original document D2 is not set on the document setting table 24, the result of step S230 is NO, the ADF controller 100 drives the document pickup motor 101 to rotate in a clockwise direction, which is a normal direction, in step S231.

After step S231, the ADF controller 100 determines whether the document stopper 28 has moved to the position indicated by the chain double-dashed line in FIG. 2, in step S232.

When it is determined that the document stopper 28 has not moved to the contact position, the result of step S232 is NO, the ADF controller 100 repeats step S232 until the document stopper 28 moves to the contact position.

When it is determined that the document stopper 28 has moved to the contact position, the result of step S232 is YES, and the ADF controller 100 stops the document pickup motor 101, in step S233.

When it is determined that the original document is not in the single face mode, the result of step S221 is NO, the ADF controller 100 determines whether the transfer length of the first original document D1 is equal to or greater than the reference length in step S223.

When it is determined that the transfer length of the original document is equal to or greater than the reference length, the result of step S223 is YES, and the ADF controller 100 determines whether the pages of the first original document D1 collated in the proper page order is being discharged, in step S224.

When it is determined that the original document in the proper page order is not being discharged, the result of step S224 is NO, and the ADF controller 100 repeats step S224 until the pages of the first original document D1 collated in the proper order is being discharged.

When it is determined that the original document in the proper page order is being discharged, the result of step S224 is YES, the process proceeds to step S226.

Further, when it is determined that the transfer length of the first original document D1 is smaller than the reference length, the result of step S223 is NO, the ADF controller 100 determines whether the reverse face of the first original document D1 is being read, in step S225.

When it is determined that the reverse face of the first original document D1 is not being read, the result of step S225 is NO, the ADF controller 100 repeats step S225 until the first original document D1 is read.

When it is determined that the reverse face of the preceding original document is being read, the result of step S225 is YES, and the process proceeds to step S226.

As shown in the flowchart of FIG. 22, the ADF controller 100, in step S139, starts feeding the second original document D2 after the trailing edge of the first original document D1 has been detected by the abutment sensor 35 and passed the pair of pull-out rollers 36, while the reverse face of the preceding original document having the length smaller than the reference length is being read.

Figure 27A:
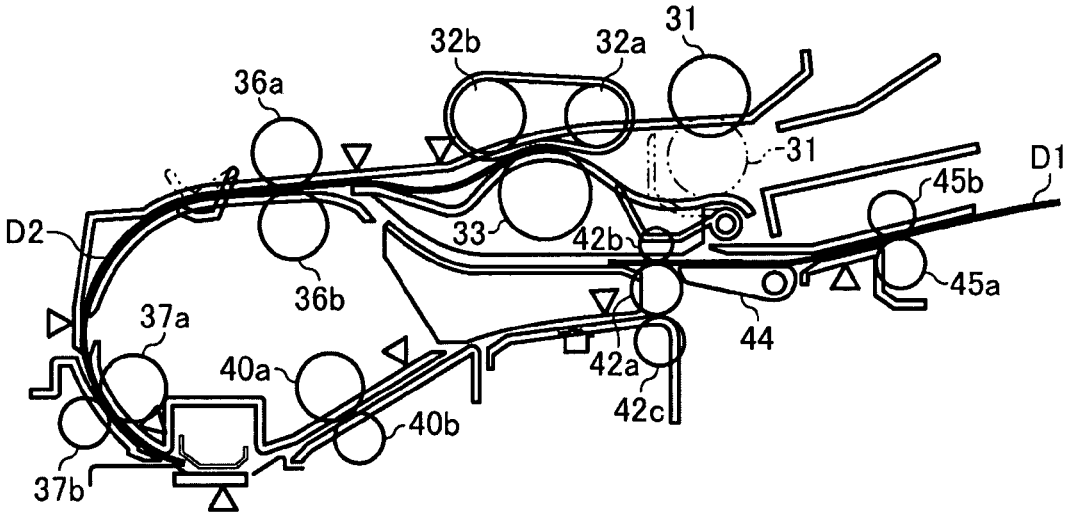
FIGS. 27A-27B are schematic configurations (according to an example embodiment of the present invention) continued vis-a-vis FIGS. 26A-26B.
Figure 27B:
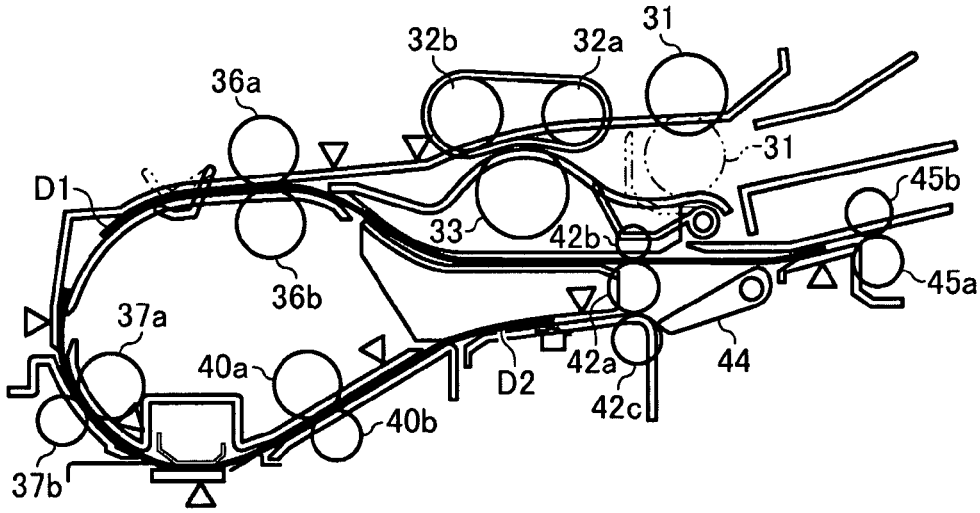
Figure 28A:
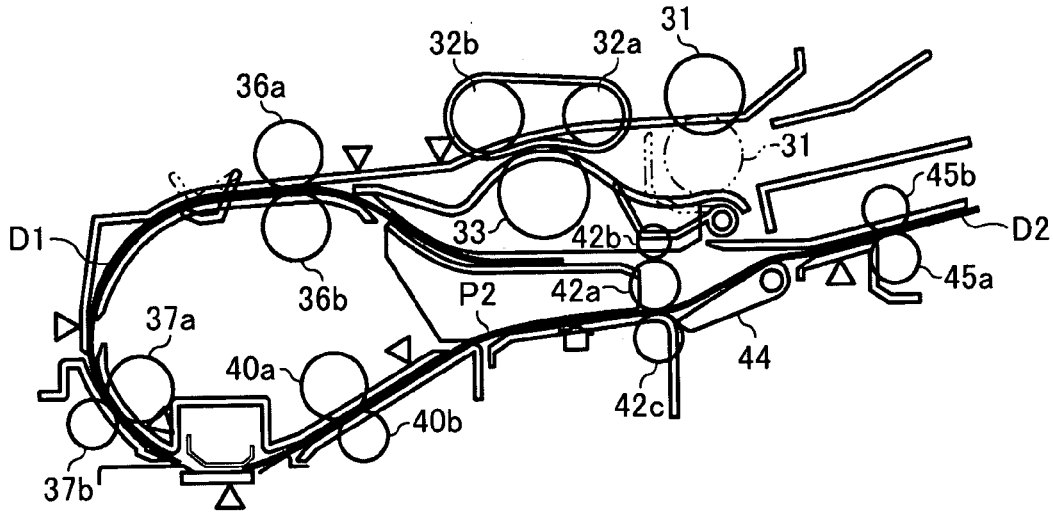
FIGS. 28A-28B are schematic configurations (according to an example embodiment of the present invention) continued vis-a-vis FIGS. 27A-27B.
Figure 28B:
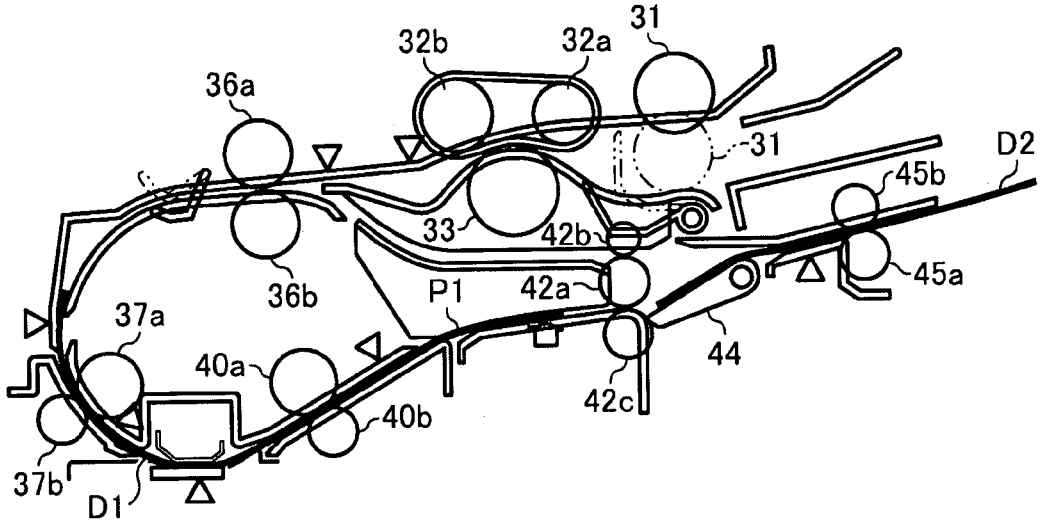

After starting the reading of the second original document D2 in step S139, the ADF controller 100 drives the document switchback motor 104 at the same speed as the document read motor 103, so as to transfer the first original document D1 that has been stopped at the switchback stop position ST at the same speed as the scanning speed of the second original document D2, in step S140 (see FIGS. 27A and 27B).

After step S140, the ADF controller 100 determines whether the leading edge of the second original document D2 is detected by the switchback sensor 49, the number of drive pulses from when the document switchback motor 104 is counted, and the number of drive pulses of the document switchback motor 104 reaches the reference number of pulses. That is, the ADF controller 100 determines, in step S141, whether the document switchback motor 104 has been driven by the reference number of pulses from when the switchback sensor 49 detected the leading edge of the original document (see FIGS. 28A and 28B).

When it is determined that the document switchback motor 104 has not been driven to rotate by the reference number of pulses, the result of step S141 is NO, and the ADF controller 100 repeats step S141 until the document switchback motor 104 is driven to rotate by the reference number of pulses.

When it is determined that the preceding original document is conveyed by the reference number of pulses, in other words, when it is determined that the document switchback motor 104 has been driven to rotate by the reference number of pulses, the result of step S141 is YES, and the ADF controller 100 determines that first original document D1 has been transferred to the reversing path 53 via the re-entry path 46*b*. Then, the ADF controller 100 stops the switchback motor 49 in step S142, and determines whether the reading of the second original document D2 has been completed, in step S143.

When it is determined that the reading of the second original document D2 has not been completed, the result of step S143 is NO, and the ADF controller 100 determines whether the jam detection time has been over in step S144.

When it is determined that the jam detection time has not been over, the result of step S144 is NO, and the process goes back to step S143.

When it is determined that the jam detection time has been over, the result of step S144 is YES, the ADF controller 100 determines that a jam indicating that the second original document D2 has not been completely read has occurred and displays a message to inform the occurrence of the jam, in step S145.

When it is determined that the reading of the next original document has been completed, the result of step S143 is YES, and the ADF controller stops the rotations of the document read motor 103 to temporarily stop the first original document D1 on the scanning position 80. While the first original document D1 is being stopped at the registration stop position, the second original document D2 is stopped at the switchback stop position ST in a standby condition.

Then, the ADF controller 100 determines whether the document read motor 103 remains stopped, in step S146.

When it is determined that the document read motor 103 does not remain stopped, the ADF controller 100 repeats step S146 until the document read motor 103 stops.

When it is determined that the document read motor 103 remains stopped, the ADF initiates the document read motor 103 to rotate at high speed in step S147, so that the first original document D1 that has been stopped at the scanning position 80 by the pair of read inlet rollers 37 and the pair of read outlet rollers 40 can be transferred at high speed.

After step S147, the ADF controller 100 determines whether the read outlet sensor 47 has been turned off, in step S148.

When it is determined that the read outlet sensor 47 has not been turned off, the result of step S148 is NO, and the ADF controller determined whether the jam detection time has been over in step S149.

When it is determined that the jam detection time has not been over, the result of step S149 is NO, and the process goes back to step S148.

When it is determined that the jam detection time has been over, the result of step S149 is YES, the ADF controller 100 determines that a jam indicating that the first original document D1 has not completely passed through the read outlet sensor 47 has occurred and displays a message on the display panel 48 to inform of the occurrence of the jam, in step S150.

When it is determined that the read outlet sensor 47 has been turned off, the result of step S148 is YES, and the ADF controller 100 counts the number of drive pulses of the document read motor 103 from when the read outlet sensor 47 detected the trailing edge of the preceding original document.

In step S151, the ADF controller 100 determines, in step S151, whether the document read motor 103 has been driven by a reference number of pulses since the read outlet sensor 47 detected the trailing edge of the first original document D1.

When it is determined that the document read motor 103 has not been driven to rotate by the reference number of pulses, the result of step S151 is NO, and the ADF controller 100 repeats step S151 until the document read motor 103 is driven to rotate by a reference number of pulses.

When it is determined that the document read motor 103 has been driven to rotate by the reference number of pulses, the result of step S151 is YES, and the ADF controller 100 starts decreasing the speed of rotations of the document read motor 103 in step S152.

After step S152, the ADF controller 100 sends the document discharge completion signal to the main body controller 111, in step S153.

On the other hand, as previously described, when it is determined that the reverse face of the first original document D1 is not to be read, the result of step S111 is NO, the process goes to process I, where process I starts at step S171 shown in FIG. 19.

The procedure from step S171 and after shows an operation flow to start the reading of the front face of the second original document D2.

In step S171 in the flowchart of FIG. 19, the ADF controller 100 specifies the speed of the document read motor 103 according to the read scan magnification. Then, after receiving the read start signal from the main body controller 111, the ADF controller 100 starts the reading or scanning operation of the original document, and the process goes to step S172.

In step S172, the ADF controller 100 drives the document read motor 103 to rotate in a normal direction so as to rotate the pair of read inlet rollers 37 and the pair of read outlet rollers 40 at the transfer speed according to the read scan magnification, and causes the registration sensor 41 to detect the leading edge of the second original document D2 so as to start the pulse count for counting the number of pulses of the document read motor 103.

After step S172, the ADF controller 100 determines, in step S173, whether the number of counted pulses of the document read motor 103 has reached the reference number of pulses for the front face of the second original document D2, which corresponds to the distance of the registration sensor 41 and the scanning position 80 on the slit glass 22*b*.

When it is determined that the number of counted pulses of the document read motor 103 has not reached a reference number of pulses for the front face of the second original document D2, the result of step S173 is NO, and the ADF controller 100 repeats step S173 until the number of counted pulses of the document read motor 103 reaches a reference number of pulses for the front face of the original document.

When it is determined that the number of counted pulses of the document read motor 103 has reached a reference number of pulses for the front face of the original document, the result of step S173 is YES, and the ADF controller 100 determines, in step S174, whether the number of correction pulses that account for the slip ratio and so forth of the original document has reached the reference number of pulses for the front face of the second original document D2.

When it is determined that the number of correction pulses has not reached a reference number of pulses for the front face of the second original document D2, the result of step S174 is NO, and the ADF controller repeats step S174 until the number of correction pulses reaches a reference number of pulses for the front face of the original document.

When it is determined that the number of correction pulses has reached a reference number of pulses for the front face of the original document, the result of step S115 is YES, the ADF controller 100 sends the gate signal that indicates an image area in the sub-scanning direction, to the main body controller 111 at the timing that the leading edge of the second original document D2 reaches the scanning position 80, in step S175, and starts counting the number of gate pulses of the front face of the second original document D2, in step S176.

After step S176, the ADF controller 100 determines whether the read outlet sensor 47 has been turned on to detect the leading edge of the original document in step S177.

When it is determined that the read outlet sensor 47 has not been turned on to detect the leading edge of the original document, the result of step S177 is NO, and the ADF controller 100 determines whether the jam detection time has been over or not in step S178.

When it is determined that the jam detection time has not been over, the result of step S178 is NO, and the process goes back to step S177.

When it is determined that the jam detection time has been over, the result of step S178 is YES, and the ADF controller 100 determines that a jam indicating that the second original document D2 has not passed the read outlet sensor 47 has occurred and displays a message on the display panel 48 to inform of the occurrence of the jam, in step S179.

On the other hand, when it is determined that the read outlet sensor 47 has been turned on to detect the leading edge of the original document, the result of step S177 is YES, the ADF controller 100 turns on the switchback solenoid 105 before the leading edge of the second original document D2 that has passed through the scanning position 80 reaches the document discharging roller set 42 when reading the front face of the second original document D2, so that the path switching member 44 can move to the position indicated by a chain double-dashed line shown in FIG. 2, and drives the document switchback motor 104 to rotate in a normal direction, in step S180.

With the above-described operations, the discharge drive roller 42*a* and the upper discharge driven roller 42*b* that are driven to rotate by the document read motor 103 and the pair of switchback rollers 45 that is driven to rotate by the rotation of the document switchback motor 104 in the normal direction can transfer the second original document D2 in the switchback path 46*a* as indicated by arrow B in FIG. 2.

After step S180, the ADF controller 100 determines whether the switchback sensor 49 has been turned on in step S181.

When it is determined that the switchback sensor 49 has not been turned on, the result of step S181 is NO, and the ADF controller 100 determines whether the jam detection time has been over or not in step S182.

When it is determined that the jam detection time has not been over, the result of step S182 is NO, and the process goes back to step S181.

When it is determined that the jam detection time has been over, the result of step S182 is YES, and the ADF controller 100 determines that a jam indicating that the second original document D2 has not been switched back has occurred and displays a message on the display panel 48 to inform of the occurrence of the jam, in step S183.

Figure 20A:
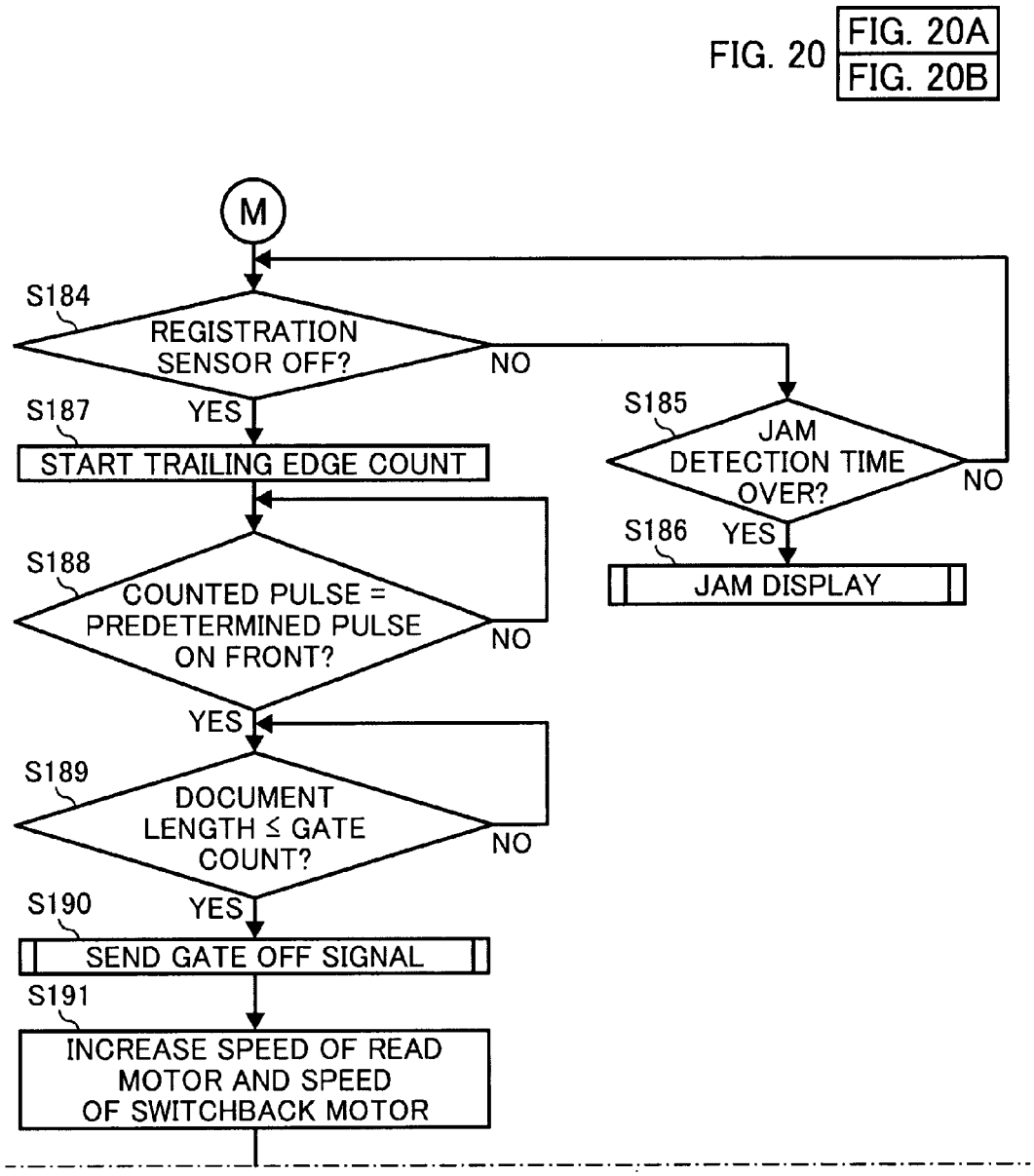
FIG. 20 is (i.e., FIGS. 20A-20B together) a flowchart (according to an example embodiment of the present invention) continued from the flowchart shown in FIG. 19.
Figure 20B:
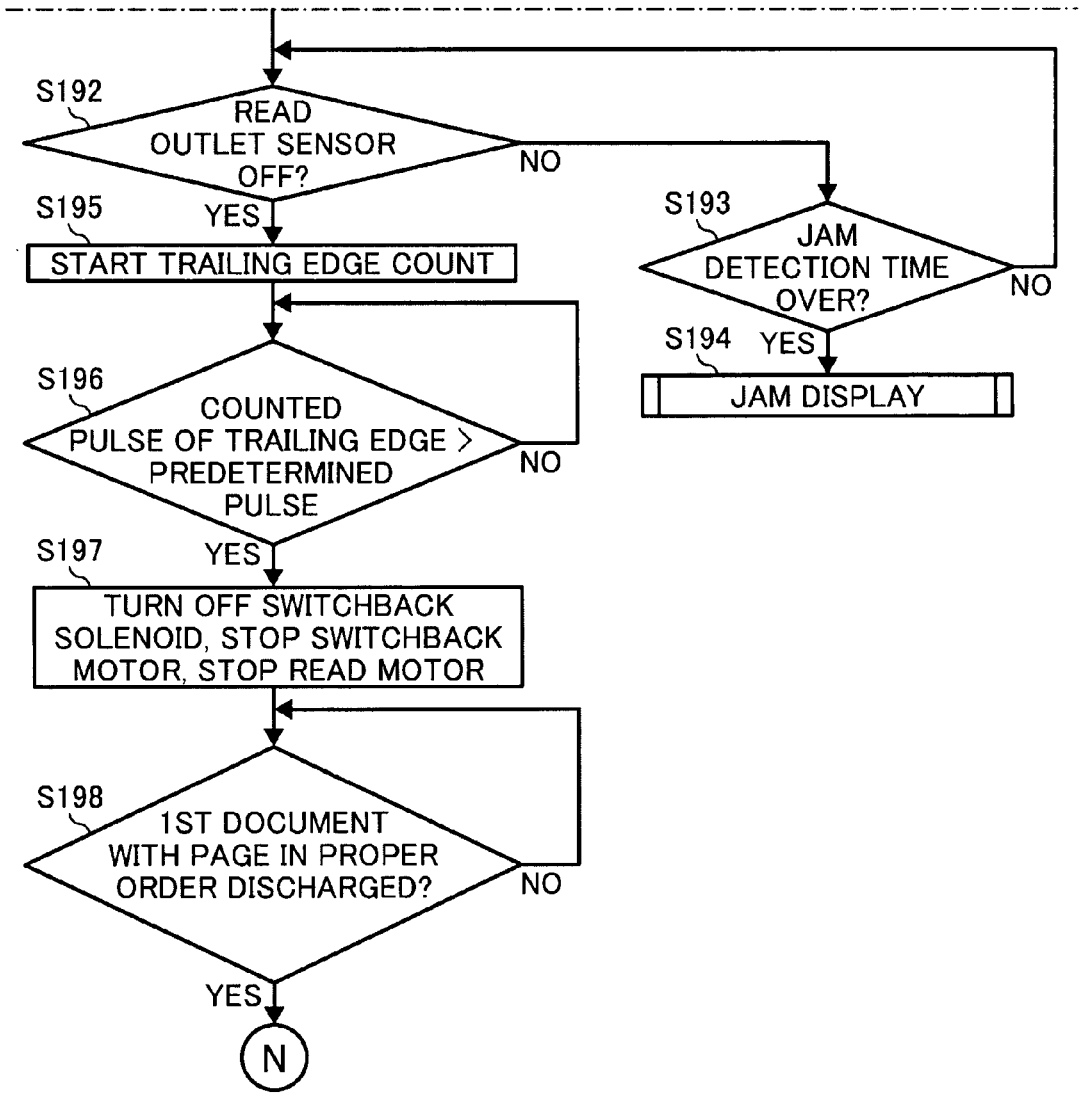

When it is determined that the switchback sensor 49 has been turned on, the result of step S181 is YES, and the process proceeds to process M, where process M starts at step S184 in the flowchart of FIG. 20.

In step S184, the ADF controller 100 determines whether the registration sensor 41 has been turned off.

When it is determined that the registration sensor 41 has not been turned off, the result of step S184 is NO, and the ADF controller 100 determines whether the jam detection time has been over in step S185.

When it is determined that the jam detection time has not been over, the result of step S185 is NO, and the process returns to step S184.

When it is determined that the jam detection time has been over, the result of step S185 is YES, and the ADF controller 100 determines that the second original document D2 has not completely passed the registration sensor 41 has occurred and displays a message on the display panel 48 to inform of the occurrence of the jam, in step S186.

On the other hand, when it is determined that the registration sensor 41 has been turned off, the result of step S184 is YES, and ADF controller 100 starts the trailing edge count for counting the number of pulses of the document read motor 103, starting from the time that the trailing edge of the original document is not detected by the registration sensor 41, in step S187.

After step S187, the ADF controller 100 determines whether the number of counted pulses of the document read motor 103 has reached a reference number of pulses for the front face of the second original document D2 in step S188.

When it is determined that the number of counted pulses of the document read motor 103 has not reached the reference number of pulses for the front face of the second original document D2, the result of step S188 is NO, and the ADF controller 100 repeats step S188 until the number of counted pulses of the document read motor 103 reaches the reference number of pulses for the front face of the second original document D2.

When it is determined that the number of counted pulses of the document read motor 103 has reached the reference number of pulses for the front face of the second original document D2, the result of step S188 is YES, and the ADF controller 100 determines, in step S189, whether the number of counted gate pulses is equal to or greater than the length of the original document, in step S189.

When it is determined that the number of counted gate pulses is smaller than the length of the original document, the result of step S189 is NO, and the ADF controller 100 repeats step S189 until the number of counted gate pulses becomes equal to or greater than the length of the original document.

When it is determined that the number of counted gate pulses is equal to or greater than the length of the original document, the result of step S189 is YES, and the ADF controller 100 sends the gate off signal that indicates the image area in the sub-scanning direction, in step S190.

After step S190, the ADF controller 100 increases both the speed of the document read motor 103 and the speed of the document switchback motor 104, in step S191.

After step S191, the ADF controller 100 determines whether the read outlet sensor 47 has been turned off in step S192.

When it is determined that the read outlet sensor 47 has not been turned on, the result of step S191 is NO, the ADF controller 100 determines whether the jam detection time has been over in step S193.

When it is determined that the jam detection time has not been over, the result of step S193 is NO, and the process returns to step S192.

When it is determined that the jam detection time has been over, the result of step S193 is YES, and the ADF controller 100 determines that a jam indicating that the second original document D2 has not completely passed the read outlet sensor 47 has occurred and displays a message to inform of the occurrence of the jam, in step S194.

When it is determined that the read outlet sensor 47 has been turned on, the result of step S192 is YES, the ADF controller 100 starts the trailing edge count for counting the number of pulses of the document read motor 103, from the time that the trailing edge of the original document is not detected by the read outlet sensor 47, in step S195.

After step S195, the ADF controller 100 determines, in step S196, whether the document read motor 103 has counted the number of counted pulses of the trailing edge of the original document that is greater than the reference number of pulses.

When it is determined that the number of counted pulses of the trailing edge of the original document is not greater than the reference number of pulses, the result of step S196 is NO, and the ADF controller 100 repeats step S196 until the number of counted pulses of the trailing edge of the original document becomes greater than the reference number of pulses.

When it is determined that the number of counted pulses of the trailing edge of the original document is greater than the reference number of pulses, the result of step S196 is YES, and the trailing edge of the original document is transferred to the switchback path 46*a*.

Further, in the operations executed in steps S191, S192, S195, and S196, the speed of the document read motor 103 and the speed of the document switchback motor 104 are increased. Thereby, the first original document D1 and the second original document D2 are transferred at high speed. Accordingly, the first original document D1 and the second original document D2 can pass over the scanning position 80 while the trailing edge of the second original document D2 and the leading edge of the first original document D1 keep a constant interval therebetween.

After step S196, the ADF controller 100 turns off the switchback solenoid 105, switches the path switching member 44 to the position indicated by the solid line in FIG. 2, stops the rotation of the document switchback motor 104, and stops the rotation of the document read motor 103, in step S197.

When the ADF controller 100 causes the switchback stop position ST of the original document after completion of the reading of the front face thereof to be stopped closer to the document discharging roller set 42 than the switchback stop position ST of the original document after the reading of the reverse face thereof. The difference of the distances of the switchback stop positions ST may be necessary for the through up when restarting the document switchback motor 104. By providing such difference between the above-described switchback stop positions ST can reduce the loss time for the processing time to transfer the second original document D2 that is standing by at the switchback stop position ST, to the re-entry path 46*b*, so as to enhance the productivity in transferring the original documents.

Further, when the original document after the completion of the reading of the reverse face thereof is stopped at the switchback stop position ST, the position may be set farther from the document discharging roller set 42 than the switchback stop position ST of the original document after the reading of the front face thereof.

Figure 29A:
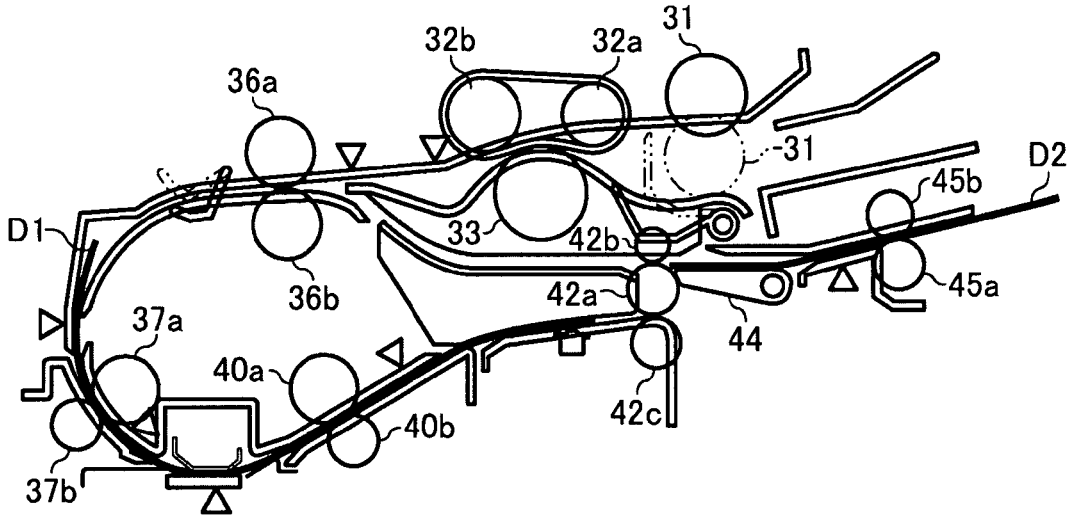
FIGS. 29A-29B are schematic configurations (according to an example embodiment of the present invention) continued vis-a-vis FIGS. 28A-28B.
Figure 29B:
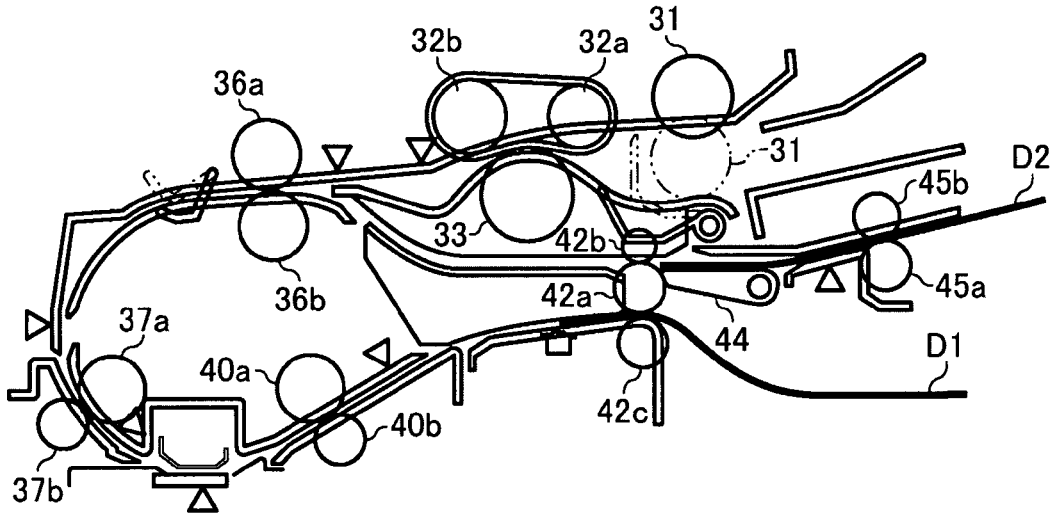

By executing step S197, while the second original document D2 after completion of the reading of the front face thereof stands by at the switchback stop position ST, the first original document D1 stops at the scanning position 80 (see FIG. 29A).

After the ADF controller 100 stops the rotations of the document read motor 103 in step S197, the ADF controller 100 discharges the first original document D1 that has passed the scanning position 80 for three times for collating the pages in the proper order, by driving the document read motor 103 in step S147 in the flowchart of FIG. 18. Accordingly, the first document is discharged to the document discharging tray 43 as indicated by arrow A in FIG. 2, at the transfer speed that is free from the read scan magnification (see FIG. 29B).

Then, the ADF controller 100 determines, in step S198, whether the discharging operation for collating the pages of the first original document D1 in the proper order has been completed.

The document discharge completion signal in step S153 in the flowchart of FIG. 18 represents the signal that determines the completion of the operation.

Until the reception and acknowledgement of the input of the document discharge completion signal, the ADF controller 100 stops the document switchback motor 104 to discharge the first original document D1 while causing the second original document D2 to stand by at the switchback stop position ST.

When it is determined that the discharging operation for collating the pages of the first original document D1 in the proper order has not been completed, the result of step S198 is NO, and the ADF controller 100 repeats step S198 until the discharging operation for collating the pages of the first original document D1 in the proper order is completed.

Figure 21:
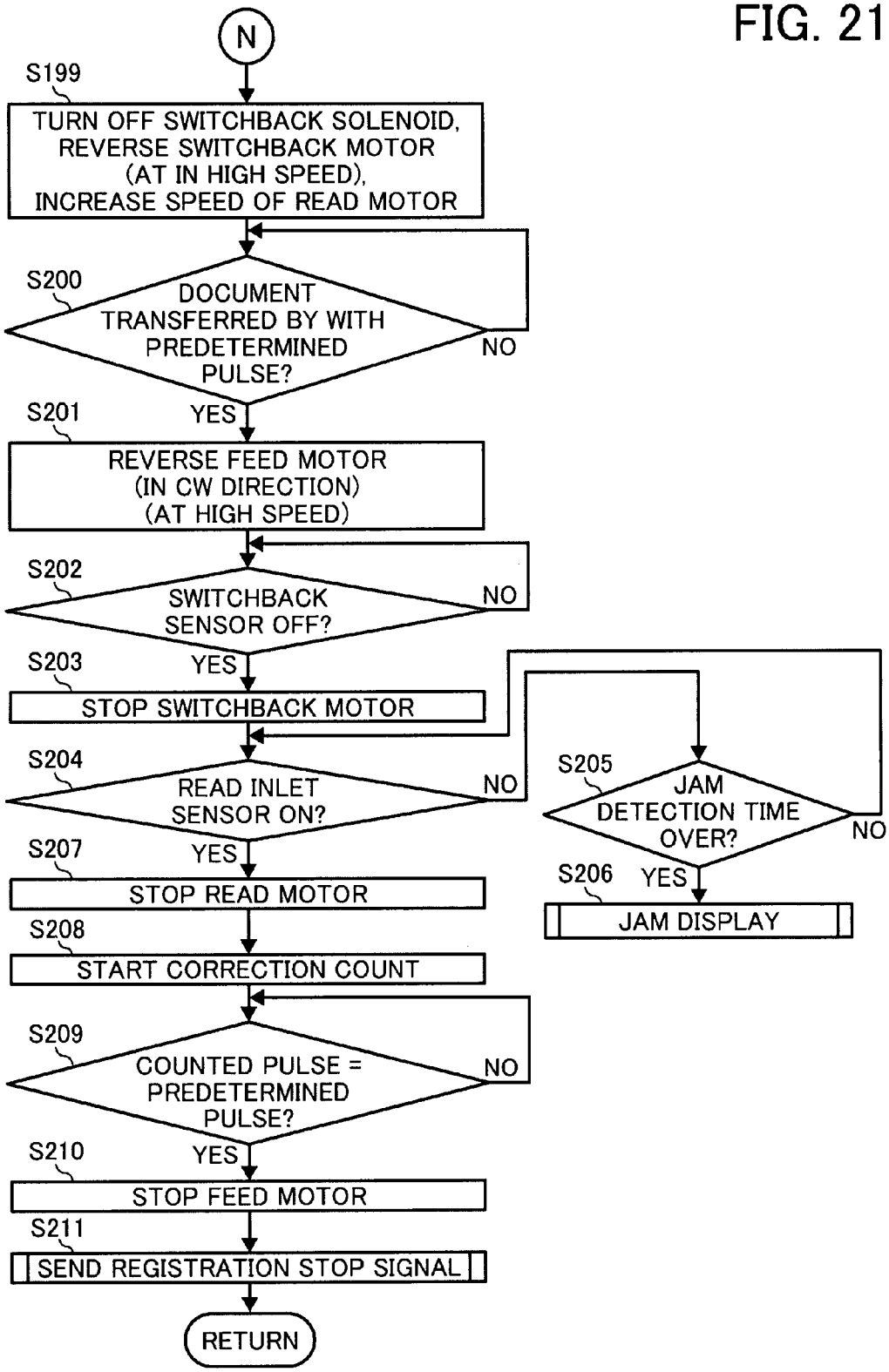
FIG. 21 is a flowchart (according to an example embodiment of the present invention) continued from the flowchart shown in FIG. 21.

When it is determined that the discharging operation for collating the pages of the first original document D1 in the proper order has been completed, the result of step S198 is YES, and the process proceeds to process N, where process N starts at step S199 in the flowchart of FIG. 21.

In step S199, the ADF controller 100 turns off the switchback solenoid 105, and moves the path switching member 44 to the position indicated by the solid line shown in FIG. 2. In addition, after the reference number of pulses has counted, the ADF controller 100 drives the document switchback motor 104 to rotate in a reverse direction at high speed to cause the pair of switchback rollers 45 to rotate in a reverse direction, and increases the speed of the document read motor 103.

Figure 30A:
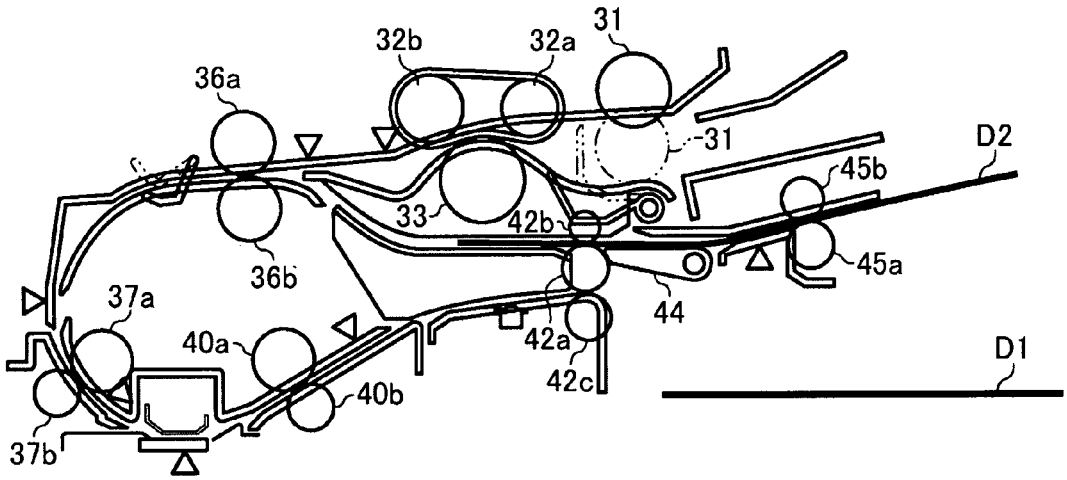
FIGS. 30A-30B are schematic configurations (according to an example embodiment of the present invention) continued vis-a-vis FIGS. 29A-29B.

Thereby, immediately after the first original document D1 is discharged, the second original document D2 that has been in the standby condition at the switchback stop position ST is transferred at high speed through the re-entry path 46*b* toward the reversing path 53 (see FIG. 30A).

After step S199, the ADF controller 100 determines, in step S200, whether the document switchback motor 104 has been driven by a reference number of pulses after the switchback sensor 49 detected the leading edge of the second original document D2 and the second original document D2 has been transferred by the reference number of pulses.

When it is determined that the document switchback motor 104 has not been driven to rotate by the reference number of pulses since the switchback sensor 49 detected the leading edge of the second original document D2, the result of step S200 is NO, and the ADF controller 100 repeats step S200 until the document switchback motor 104 is driven to rotate by the reference number of pulses.

When it is determined that the document switchback motor 104 has been driven to rotate by the reference number of pulses since the switchback sensor 49 detected the leading edge of the second original document D2, the result of step S200 is YES, and the ADF controller 100 causes the document feed motor 102 to rotate at high speed in a counterclockwise direction, which is a direction to drive the pair of pull-out rollers 36, in step S201.

To start the reading of the reverse face of the original document, the second original document D2 is transferred through the re-entry path 46*b* toward the reversing path 53 as indicated by arrow C in FIG. 2.

After step S201, the ADF controller 100 determines whether the switchback sensor 49 has been turned off in step S202.

When it is determined that the switchback sensor 49 has not been turned off, the result of step S202 is NO, and the ADF controller 100 repeats step S202 until the switchback sensor 49 is turned off.

When it is determined that the switchback sensor 49 has been turned off, the result of step S202 is YES, the ADF controller 100 stops the document switchback motor 104 in step S203.

After step S203, the ADF controller 100 determines whether the read inlet sensor 39 has been turned on in step S204.

When it is determined that the read inlet sensor 39 has not been turned on, the result of step S204 is NO, the ADF controller 100 determines whether the jam detection time has been over, in step S205.

When it is determined that the jam detection time has not been over, the result of step S205 is NO, and the process returns to step S204.

When it is determined that the jam detection time has been over, the result of step S205 is YES, and the ADF controller 100 determines that a jam indicating that the leading edge of the second original document D2 has not passed the read inlet sensor 39 has occurred and displays a message on the display panel 48 to inform of the occurrence of the jam, in step S206.

When it is determined that the read inlet sensor 39 has been turned on, the result of step S204 is YES, the ADF controller 100 causes the document read motor 103 to stop in step S207, and starts counting the number of the correction counts of the amount or length of abutment in step S208.

Specifically, the ADF controller 100 starts counting the number of drive pulses of the document feed motor 102 that corresponds to a reference amount or length of Y mm, which is an amount greater than the distance between the read inlet sensor 39 and the pair of read inlet rollers 37.

After step S208, the ADF controller 100 determines whether the number of counted pulses of the document feed motor 102 has reached the reference number of pulses that corresponds to the amount or length of abutment (Y mm) in step S209.

When it is determined that the number of counted pulses of the document feed motor 102 has not reached the reference number of pulses, the result of step S209 is NO, and the ADF controller 100 repeats step S209 until the number of counted pulses reaches the reference number of pulses.

When it is determined that the number of counted pulses of the document feed motor 102 has reached the reference number of pulses, the result of step S209 is YES, and the ADF controller 100 causes the document feed motor 102 to stop in step S210.

Figure 30B:
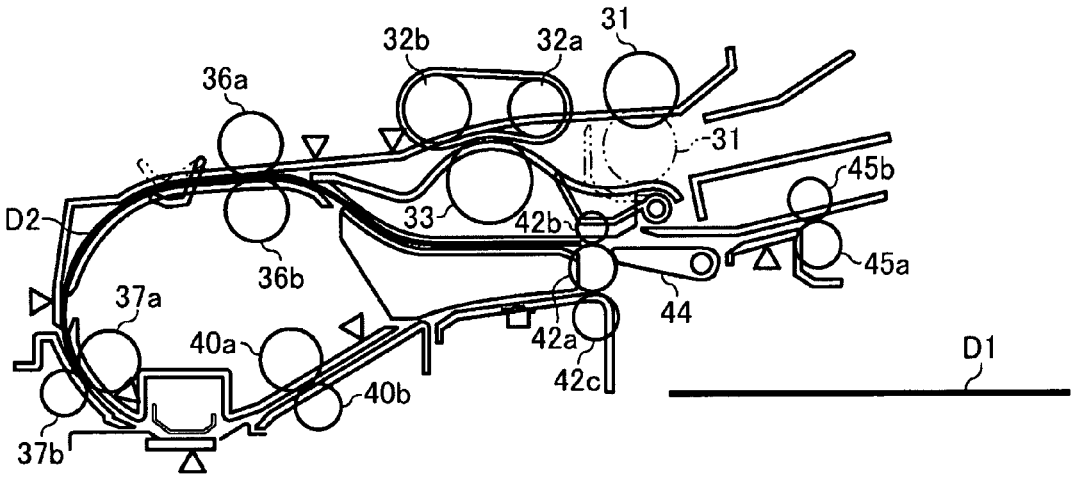

After step S210, the ADF controller 100 sends the registration stop signal to the main body controller 111 in step S211, and completes the transfer control of the original document to the scanning position 80 (see FIG. 30B).

At the timing that the document feed motor 102 reaches the reference number of pulses, the original document is pressed contact to the pair of read inlet rollers 37 while being bowed with a reference amount. Under such condition, the skew caused by the bow with the reference amount is corrected.

As described above, the transfer control in which the second original document D2 passes over the scanning position 80 for the first time before the first original document D1 passes over the scanning position 80 for the third time may be repeated until the entire documents of the original document stack DS accumulated on the document setting table 24 are completely processed.

According to the example embodiment of the present invention, in the transfer control of a double face original document, the first passage of a second original document D2 over the scanning position may be executed prior to the third passage of the first original document D1 over the scanning position 80 for collating the first original document D1 in a proper page order. With the above-described operation, when the first original document D1 is discharged after the third passage over the scanning position 80, the pair of switchback rollers 45 may be stopped for a reference period to cause the second original document D2 to stand by at the switchback stop position ST in the switchback path 46*a*. Thereby, when passing over the scanning position 80, the first original document D1 may be collated in a proper page order without the scanning operation. Therefore, the first original document D1 may not be discharged at the transfer speed according to the read scan magnification.

With the above-described configuration, the copier 21 according to the example embodiment of the present invention can avoid the first original document D1 jumping out to the document discharging tray 43. This can enhance the stackability of original documents in the ADF 23.

Specifically, when a low read scan magnification is set, the transfer speed in discharging the first original document D1 can be set slower than the scanning speed according to the read scan magnification. On the other hand, when a high read scan magnification is set, the transfer speed in discharging the first original document D1 can be set faster than the scanning speed according to the read scan magnification.

The high read scan magnification means a rate or ratio to enlarge or expand an image to, for example, 141%, 200%, and so forth. The low read scan magnification means a rate or ratio to reduce an image to, for example, 71%, 50%, and so forth. When the smaller read scan magnification is set, the transfer speed of an original document may be faster.

In addition, since a plurality of original documents can be transferred to the document transfer path, a transfer operation of original documents per unit of time may be enhanced, resulting in an increase of level of productivity of original document or an increase of the number of original documents per unit of time.

Further, in the example embodiment of the present invention, when the second original document D2 passes over the scanning position 80, the second original document D2 and the first original document D1 standing by at the switchback stop position ST can be transferred at a speed higher than the read scan magnification. Thereby, when the second original document D2 is transferred to the switchback path 46*a* and the first original document D1 is transferred from the switchback path 46*a* to the scanning position 80 for collating in a proper page order, a plurality of original documents can be transferred at high speed. Therefore, a conveying operation of original documents per unit of time may be further enhanced, resulting in a further increase of level of productivity of original documents.

Further, in the example embodiment of the present invention, when the first original document D1 is completely discharged, the second original document D2 standing by at the switchback stop position ST may be transferred at a speed higher than the read scan magnification. Thereby, the second original document D2 standing by at the switchback path 46*a* after completion of the reading of the front face thereof can be transferred at high speed to the scanning position 80. Therefore, a transfer operation of original documents per unit of time may be further enhanced, resulting in a further increase of level of productivity of original documents.

Further, in the example embodiment of the present invention, the pair of switchback rollers 45 may be driven to change the switchback stop position ST of an original document after completion of the reading of the front face thereof and after completion of the reading of the reverse face thereof. That is, the switchback stop position ST of an original document after completion of the reading of the front face thereof may be set closer to the document discharging roller set 42 than the switchback stop position ST of the original document after completion of the reading of the reverse face thereof.

Thereby, when the second original document D2 after completion of the reading of the front face thereof is transferred to the scanning position 80 for the reading of the reverse face thereof, the first original document D1 has been discharged and is out of the document transfer path. Therefore, if the switchback stop position ST can be set or moved closer to the document discharging roller set 42 after completion of the reading of the front face of the original document, a shorter distance may be needed for transferring the original document, which can further enhance the transfer operation of original document per unit of time.

On the contrary, when the first original document D1 is transferred to the scanning position 80 after completion of the reading of the reverse face thereof, the second original document D2 still remains in the document transfer path. Therefore, when the first original document D1 is transferred to the scanning position 80 for collating in a proper page order, the first and second original documents D1 and D2 may be transferred to the scanning position 80 with a constant distance therebetween.

After the second original document D2 has passed over the scanning position 80, the path switching member 44 may be switched to a position connected to the switchback path 46*a*, and the second original document D2 placed before the first original document D1 may be transferred to the switchback path 46*a*. Then, the path switching member 44 may be switched to a position connected to the document discharging tray 43, and the first original document D1 may pass over the scanning position 80 to be discharged to the document discharging tray 43.

At this time, if the interval between the first and second original documents D1 and D2 is small, when the path switching member 44 is switched to the position connected to the document discharging tray 43, the first original document D1 may collide against the path switching member 44, which may cause a jam. Therefore, the switchback stop position ST set after completion of the reading of the reverse face of an original document may be set to a position farther from the re-entry path 46*b* than the switchback stop position ST set after completion of the reading of the front face of the original document. Thereby, the interval between the first and second original documents D1 and D2 may not be affected by the switching operation of the path switching member 44. Accordingly, this can reduce, or prevent if possible, to cause jams of original documents.

Further, in the example embodiment of the present invention, the transfer speed of the original document standing by at the switchback stop position ST may be set to a same speed as the scanning speed when starting to scan or read the front face of the second original document D2. Thereby, the respective drive speeds of the document feed motor 102, the document read motor 103, and the document switchback motor 104 can stay in a constant speed to transfer the first and second original documents D1 and D2. This can maintain a constant interval between original documents during the transfer operation of the original documents.

According to the above-described configuration, as the read scan magnification becomes smaller, the image on the original document can be more reduced, and the distance necessary for the through up at the initiation of the document switchback motor 104 may be greater.

Therefore, if the switchback stop position ST of the original document after completion of the reading of the front face thereof with a high read scan magnification is set closer to the re-entry path 46*b* than the switchback stop position ST of the original document after completion of the reading of the front face thereof with a low read scan magnification. Thereby, after completion of the through up of the document switchback motor 104, the original document that has been switched back can be effectively transferred toward the scanning position 80.

According to the above-described configuration, as the read scan magnification becomes smaller, the image on the original document can be more reduced, and the transfer speed may be greater. Therefore, the distance necessary for the through up at the initiation of the document switchback motor 104 may be greater.

Therefore, if the switchback stop position ST of the original document after completion of the reading of the reverse face thereof with a high read scan magnification is set closer to the re-entry path 46*b* than the switchback stop position ST of the original document after completion of the reading of the front face thereof with a low read scan magnification. Thereby, after completion of the through up of the document switchback motor 104, the original document that has been switched back can be effectively transferred toward the scanning position 80.

Further, in the example embodiment of the present invention, when the first original document D1 is stopped at the switchback stop position ST, the amount or length of the first original document D1 projecting beyond the pair of switchback rollers 45 while being sandwiched by the pair of switchback rollers 45 may be formed smaller than the amount or distance to the pair of switchback rollers 45 from the leading edge of the second original document D2 standing by at the registration stop position arranged upstream of the scanning position 80. Therefore, when the second original document D2 after completion of the reading is conveyed to the switchback path 46*a*, the first original document D1 standing by in the switchback path 46*a* can be transferred to the scanning position 80. Thereby, the first original document D1 can be completely discharged from the switchback path 46*a*. Therefore, the chance of a problem such as overlapping of the leading edge of the second original document D2 and the trailing edge of the first original document D1 on the switchback path 46*a* can be reduced, or prevented if possible. Accordingly, the second original document D2 can be securely transferred to the switchback path 46*a*.

Further, in the example embodiment of the present invention, the leading edge of the second original document D2 may be conveyed to the pair of read inlet rollers 37 so as to correct the skew before the second original document D2 separated from the original document stack DS on the document setting table 24 is transferred to the scanning position 80. At that time, the stop time of the document feed motor 102 is delayed past the stop time of the document read motor 103 so as to make the time required to transfer the second original document D2 to the pair of read inlet rollers 37 longer than the time required from completion of scanning the reverse face of the first original document D1 to transfer of the first original document D1 to the switchback stop position ST. Accordingly, the leading edge of the second original document D2 can be abut against the pair of read inlet rollers 37 while the pair of reading inlet rollers 37 is being stopped, and can correct the skew of the second original document D2.

Further, in the example embodiment of the present invention, when the length in the document travel direction of a double face original document is shorter than a reference length, the second original document D2 may pass over the scanning position 80 for the first time before the first original document D1 passes over the scanning position 80 for the third time. Thereby, when the length of the document travel direction for a double face original document is longer than the reference length, the second original document D2 may standby while the first original document D1 is being transferred. Therefore, the chance of jams such as overlapping of a plurality of original documents in the document transfer path can be reduced, or prevented if possible.

In the example embodiment of the present invention, different switchback stop positions ST may be provided after completion of the reading of the reverse face of an original document and after completion of the reading of the front face of the original document.

Alternatively, different switchback stop positions ST may be provided according to the read scan magnification of original documents.

Specifically, the pair of switchback roller 45 can be controlled to change the switchback stop position ST according to the read scan magnification after completion of the reading of the front face of the original document, so that the switchback stop position ST of the original document after completion of the reading of the front face thereof with a high read scan magnification can be set closer to the document discharging roller set 42 than the switchback stop position ST of the original document after completion of the reading of the front face thereof with a low read scan magnification.

With the above-described configuration, as the read scan magnification becomes lower and the reduction ratio becomes greater, the transfer speed becomes faster. Therefore, by setting the switchback stop position ST of the original document after completion of the reading of the front face of the original document with a high read scan magnification to be closer to the document discharging roller set 42 than the switchback stop position ST of the original document after completion of the reading of the front face thereof with a low read scan magnification, a through up distance of the document switchback motor 104 or an amount of initiating the document switchback motor 104 to transfer the original document at high speed may be smaller. Accordingly, the above-described operation can effectively transfer original documents to the scanning position 80 at high speed.

The pair of switchback roller 45 may further be controlled to change the switchback stop position ST according to the read scan magnification of the original document after completion of the reading of the reverse face thereof, so that the switchback stop position ST of the original document after completion of the reading of the reverse face thereof with a high read scan magnification can be set closer to the document discharging roller set 42 than the switchback stop position ST of the original document after completion of the reading of the reverse face thereof with a low read scan magnification.

With the above-described configuration, as the read scan magnification becomes lower and the reduction ratio becomes greater, the transfer speed becomes faster. Therefore, the distance necessary when initiating the document switchback motor 104 may be made smaller.

Therefore, by setting the switchback stop position ST of the original document after completion of the reading of the reverse face thereof with a high read scan magnification to be closer to the re-entry path 46*b* than the switchback stop position ST of the original document after completion of the reading of the front face thereof with a low read scan magnification, the leading edge of the original document that is switched back after completion of the through up operation of the document switchback motor 104 can be transferred to a portion between the discharge drive roller 42*a* and the upper discharge driven roller 42*b*. Accordingly, the above-described operation can effectively transfer original documents at high speed to the scanning position 80.

As described above, the automatic document feeder, the image reading device, and the image forming apparatus according to one or more embodiments of the present invention can convey a plurality of double face original documents in a substantially concurrent manner regardless of read scan magnification. Specifically, the above-described automatic document feeder, the above-described image reading device including the automatic document feeder, and the above-described image forming apparatus including the automatic document feeder can provide the above-described configurations and operations that can enhance the productivity of original document and the stackability of original document at discharge.

The above-described example embodiments are illustrative, and numerous additional modifications and variations are possible in light of the above teachings. For example, elements and/or features of different illustrative and example embodiments herein may be combined with each other and/or substituted for each other within the scope of this disclosure and appended claims. It is therefore to be understood that within the scope of the appended claims, the disclosure of this patent specification may be practiced otherwise than as specifically described herein.

What is claimed is:

1. An automatic document feeder for transferring an original document through a scanning position three times, the automatic document feeder comprising:

an original document stacker to accumulate a plurality of original documents;

a first transfer mechanism to separate the plurality of original documents one by one from the original document stacker, reverse one of the plurality of original documents via a reversing path, and transfer the reversed original document to a scanning position;

a second transfer mechanism to transfer the reversed original document from the scanning position to one of a switchback path and a document discharging part;

a switchback mechanism to transfer the reversed original document to a lay-by on the switchback path, and transfer the reversed original document in a direction opposite to a previous travel direction thereof towards the reversing path via a re-entry path; and a control unit to control the first transfer mechanism, the second transfer mechanism, and the switchback mechanism, so that a second original document passes through the scanning position a first time before a first original document passes through the scanning position a third time, and so that the switchback mechanism pauses travel of the second original document at the lay-by as the first original document passes through the scanning position a third time enroute to the document discharging part, wherein:

the control unit is further operable to drive the switchback mechanism to change the lay-by of the second original document after completion of the reading of a front face thereof and after completion of the reading of a reverse face thereof, so that the lay-by of the second original document after completion of the reading of the front face thereof is set closer to a set of discharging rollers of the second transfer mechanism than the lay-by of the first original document after completion of the reading of the reverse face thereof.

2. An automatic document feeder for transferring an original document through a scanning position three times, the automatic document feeder comprising:

an original document stacker to accumulate a plurality of original documents;

a first transfer mechanism to separate the plurality of original documents one by one from the original document stacker, reverse one of the plurality original documents via a reversing path, and transfer the reversed original document to a scanning position;

a second transfer mechanism to transfer the reversed original document from the scanning position to one of a switchback path and a document discharging part;

a switchback mechanism to transfer the reversed original document to a lay-by on the switchback path, and transfer the reversed original document in a direction opposite to a previous travel direction thereof towards the reversing path via a re-entry path; and a control unit to control the first transfer mechanism, the second transfer mechanism, and the switchback mechanism, so that a second original document passes through the scanning position a first time before a first original document passes through the scanning position a third time, and so that the switchback mechanism pauses travel of the second original document at the lay-by as the first original document passes through the scanning position a third time enroute to the document discharging part, wherein:

the control unit is further operable to control the switchback mechanism to change the lay-by according to one of the following, the read scan magnification after completion of the reading of the front face of the second original document, so that the lay-by of the second original document after completion of the reading of the front face thereof with a high read scan magnification is set to be closer to a set of discharging rollers of the second transfer mechanism than the lay-by of the first original document after completion of the reading of the front face of the first original document with a low read scan magnification, and the read scan magnification of the second original document after completion of the reading of the reverse face thereof, so that the lay-by of the second original document after completion of the reading of the reverse face thereof with a high read scan magnification is set closer to a set of discharging rollers of the second transfer mechanism than the lay-by of the first original document after completion of the reading of the reverse face of the first original document with a low read scan magnification.

3. An automatic document feeder for transferring an original document through a scanning position three times, the automatic document feeder comprising:

an original document stacker to accumulate a plurality of original documents;

a first transfer mechanism to separate the plurality of original documents one by one from the original document stacker, reverse one of the plurality of original documents via a reversing path, and transfer the given document to a scanning position;

a second transfer mechanism to transfer the reversed one of the original document from the scanning position to one of a switchback path and a document discharging part;

a switchback mechanism to transfer the reversed one of the original document to a lay-by on the switchback path, and transfer the reversed one of the original document in a direction opposite to a previous travel direction thereof towards the reversing path via a re-entry path; and a control unit to control the first transfer mechanism, the second transfer mechanism, and the switchback mechanism, so that a second original document passes through the scanning position a first time before a first original document passes through the scanning position a third lime, and so that the switchback mechanism pauses travel of the second original document at the lay-by as the first original document passes through the scanning position a third time enroute to the document discharging part, wherein:

the second transfer mechanism includes a pair of read inlet rollers configured to correct skew by abutting the leading edge of the original document against the pair of read inlet rollers, and the control unit is further operable to set a stop time of the first transfer mechanism to be delayed past a stop time of the second transfer mechanism, so that a time required to transfer the second original document to the pair of read inlet rollers becomes longer than a time required from completion of scanning the reverse face of the first original document to a transfer of the first original document to the lay-by.

4. The automatic document feeder according to claim 3, wherein:

the control unit is further operable to drive the first and second transfer mechanisms and the switchback mechanism so that the second original document and the first original document standing by at the lay-by are transferred at a speed higher than a read scan magnification speed when the second original document passes over the scanning position.

5. The automatic document feeder according to claim 3, wherein:

the control unit is further operable to drive the switchback mechanism so that the second original document paused at the lay-by is transferred at a speed higher than the read scan magnification speed when the first original document is completely discharged.

6. The automatic document feeder according to claim 3, wherein:

the control unit is further operable to drive the first and second transfer mechanism and the switchback mechanism, so that a transfer speed of the original document standing by at the lay-by is set to a same speed as the scanning speed when starting to scan the front face of the second original document.

7. The automatic document feeder according to claim 3, wherein:

the switchback mechanism includes a pair of switchback rollers mounted on the switchback path and configured to rotate in transferring the original document in both a normal direction and an opposite direction while sandwiching the original document, and the original document after completion of the reading of the reverse face thereof is sandwiched between the pair of switchback rollers, so that an amount of the first original document projecting beyond the pair of switchback rollers while being sandwiched by the pair of switchback rollers is made smaller than an amount to the pair of switchback rollers from a leading edge of the second original document standing by at a registration stop position arranged upstream of the scanning position when the original document is stopped at the lay-by.

8. An automatic document feeder for transferring an original document through a scanning position three times, the automatic document feeder comprising:

an original document stacker to accumulate a plurality of original documents;

a first transfer mechanism to separate the plurality of original documents one by one from the original document stacker, reverse one of the plurality of original document via a reversing path, and transfer the reversed original document to a scanning position;

a second transfer mechanism to transfer the reversed original document from the scanning position to one of a switchback path and a document discharging part;

a switchback mechanism to transfer the reversed original document to a lay-by on the switchback path, and transfer the reversed original document in a direction opposite to a previous travel direction thereof towards the reversing path via a re-entry path;

a control unit to control the first transfer mechanism, the second transfer mechanism, and the switchback mechanism, so that a second original document passes through the scanning position a first time before a first original document passes through the scanning position a third time, and so that the switchback mechanism pauses travel of the second original document at the lay-by as the first original document is passed through the scanning position a third time enroute to the document discharging part, and a document length detecting member to detect a length of the original document in the document travel direction, wherein the control unit is further operable to drive the first and second transfer mechanisms and the switchback mechanisms, so that the second original document passes over the scanning position for the first time before the first original document passes over the scanning position for the third time, when a length in the document travel direction of a double face original document is shorter than a reference length, based on the detection result from the document length detecting member.

* * * * *